US006054260A

United States Patent [19]

Adin et al.

[11] Patent Number: 6,054,260

[45] **Date of Patent: *Apr. 25, 2000**

[54] SILVER HALIDE LIGHT SENSITIVE EMULSION LAYER HAVING ENHANCED PHOTOGRAPHIC SENSITIVITY

[75] Inventors: Anthony Adin; Jerome J. Looker; Samir Y. Farid, all of Rochester; Ian R. Gould, Pittsford; Stephen A. Godleski; Jerome R. Lenhard, both of Fairport; Annabel A. Muenter, Rochester; Lal C. Vishwakarma; Paul A. Zielinski, both of Rochester, all of N.Y.

[73] Assignee: Eastman Kodak Company, Rochester, N.Y.

[ * ] Notice: This patent is subject to a terminal disclaimer.

[21] Appl. No.: 09/118,714

[22] Filed: Jul. 17, 1998

Related U.S. Application Data

[63] Continuation-in-part of application No. 08/900,957, Jul. 25, 1997, abandoned.

[51] Int. Cl.[7] ..... G03C 1/10; G03C 1/12

[52] U.S. Cl. ..... 430/583; 43/577; 43/580; 43/584; 43/588; 43/593; 43/594; 43/599; 43/600; 43/607; 43/610; 43/613

[58] Field of Search ..... 430/583, 600, 430/588, 607, 599, 613, 584, 595, 577, 610, 593, 594, 580

[56] References Cited

U.S. PATENT DOCUMENTS

| | | | |
|---|---|---|---|
| 2,419,975 | 5/1947 | Trivelli et al. . | |
| 2,875,058 | 2/1959 | Carroll et al. . | |
| 2,937,089 | 5/1960 | Jones et al. . | |
| 3,457,078 | 7/1969 | Riester . | |
| 3,458,318 | 7/1969 | Brooks . | |
| 3,615,632 | 10/1971 | Shiba et al. . | |
| 3,695,888 | 10/1972 | Hiller et al. . | |
| 3,706,567 | 12/1972 | Hiller et al. . | |
| 3,809,561 | 7/1974 | Ulbing et al. . | |
| 4,607,006 | 8/1986 | Hirano et al. . | |
| 4,897,343 | 1/1990 | Ikeda et al. . | |
| 4,971,890 | 11/1990 | Okada et al. . | |
| 5,192,654 | 3/1993 | Hioki et al. . | |
| 5,306,612 | 4/1994 | Philip et al. . | |
| 5,436,121 | 7/1995 | Suga et al. . | |
| 5,459,052 | 10/1995 | Skriver et al. . | |
| 5,478,719 | 12/1995 | Hioki et al. . | |
| 5,747,235 | 5/1998 | Farid et al. | 430/583 |
| 5,747,236 | 5/1998 | Farid et al. | 430/583 |

FOREIGN PATENT DOCUMENTS

| | | |
|---|---|---|
| 474047 | 11/1992 | European Pat. Off. . |
| 554856 A1 | 11/1993 | European Pat. Off. . |
| 1064193 | 4/1967 | United Kingdom . |
| 1255084 | 11/1971 | United Kingdom . |

OTHER PUBLICATIONS

*The Theory of the Photographic Process,* Fourth Edition, T.H. James, Ed., pp. 265–266, (Macmillan, 1977).

Co–pending application Serial No. 08/740,536 (our docket No. 69500A) filed Oct. 30, 1996, entitled Silver Halide Light Sensitive Emulsion Layer Having Enhanced Photographic Sensitivity, Inventor(s) Lenhard et al.

Co–pending application Serial No. 08/900,694 (our docket No. 76145 filed Jul. 25, 1997, entitled Silver Halide Light Sensitive Emulsion Layer Having Enhanced Photographic Sensitivity, Inventor(s) Farid et al.

Co–pending application Serial No. 08/739,921 (our docket No. 73258) filed Oct. 30, 1996, entitled Silver Halide Light Sensitive Emulsion Layer Having Enhanced Photographic Sensitivity, Inventor(s) Lenhard et al.

Co–pending application Serial No. 08/900,956 (our docket No. 76146) filed Jul. 25, 1997 entitled Silver Halide Light Sensitive Emulsion Layer Having Enhanced Photographic Sensitivity, Inventor(s) Adin et al.

Co–pending application Serial No. 08/739,911 (our docket No. 73257A) filed Oct. 30, 1996, entitled Silver Halide Light Sensitive Emulsion Layer Having Enhanced Photographic Sensitivity, Inventor(s) Farid et al.

*Primary Examiner*—Thorl Chea
*Attorney, Agent, or Firm*—Edith A. Rice

[57] ABSTRACT

A photographic element comprising at least one silver halide emulsion layer in which the silver halide is sensitized with a compound of the formula:

wherein A is a silver halide adsorptive group that contains at least one atom of N, S, Se, or Te that promotes adsorption to silver halide, and Z is a light absorbing group including for example cyanine dyes, complex cyanine dyes, merocyanine dyes, complex merocyanine dyes, homopolar cyanine dyes, styryl dyes, oxonol dyes, hemioxonol dyes, and hemicyanine dyes, and XY is an fragmentable electron donor moiety in which X is an electron donor group and Y is a leaving group other than hydrogen, and wherein:

1) XY has an oxidation potential between 0 and about 1.4 V; and 2) the oxidized form of XY undergoes a bond cleavage reaction to give the radical $X^{\bullet}$ and the leaving fragment Y.

In a preferred embodiment of the invention, the radical $X^{\bullet}$ has an oxidation potential $\leqq -0.7$ V.

50 Claims, No Drawings

SILVER HALIDE LIGHT SENSITIVE EMULSION LAYER HAVING ENHANCED PHOTOGRAPHIC SENSITIVITY

CROSS-REFERENCE TO RELATED APPLICATIONS

This is a continuation-in-part of application Ser. No. 08/900,957, filed Jul. 25, 1997, now abandoned entitled SILVER HALIDE LIGHT SENSITIVE EMULSION LAYER HAVING ENHANCED PHOTOGRAPHIC SENSITIVITY, by Anthony Adin, Jerome Looker, Samir Farid, Ian Gould, Stephen Godleski, Jerome Lenhard, Annabel Muenter, Lal Vishwakarma and Paul Zielinski, the entire disclosures of which are incorporated herein by reference.

These application are related to the following commonly assigned copending U.S. patent applications:

- Ser. No. 08/740,536 filed Oct. 30, 1996, which is a continuation-in-part of Ser. No. 08/592,106 filed Jan. 26, 1996;
- Ser. No. 08/739,911 filed Oct. 30, 1996, which is a continuation-in-part of Ser. No. 08/592,166 filed Jan. 26, 1996;
- Ser. No. 08/739,921 filed Oct. 30, 1996, which is a continuation-in-part of Ser. No. 08/592,826 filed Jan. 26, 1996;
- Ser. No. 08/900,694 filed Jul. 25, 1997, (Attorney Docket No. 76145); and
- Ser. No. 08/900,956 filed Jul. 25, 1997 (Attorney Docket No. 76146).

The entire disclosures of these applications are incorporated herein by reference.

FIELD OF THE INVENTION

This invention relates to a photographic element comprising at least one light sensitive silver halide emulsion layer which has enhanced photographic sensitivity.

BACKGROUND OF THE INVENTION

A variety of techniques have been used to improve the light-sensitivity of photographic silver halide materials.

Chemical sensitizing agents have been used to enhance the intrinsic sensitivity of silver halide. Conventional chemical sensitizing agents include various sulfur, gold, and group VIII metal compounds.

Spectral sensitizing agents, such as cyanine and other polymethine dyes, have been used alone, or in combination, to impart spectral sensitivity to emulsions in specific wavelength regions. These sensitizing dyes function by absorbing long wavelength light that is essentially unabsorbed by the silver halide emulsion and using the energy of that light to cause latent image formation in the silver halide.

Many attempts have been made to further increase the spectral sensitivity of silver halide materials. One method is to increase the amount of light captured by the spectral sensitizing agent by increasing the amount of spectral sensitizing agent added to the emulsion. However, a pronounced decrease in photographic sensitivity is obtained if more than an optimum amount of dye is added to the emulsion. This phenomenon is known as dye desensitization and involves sensitivity loss in both the spectral region wherein the sensitizing dye absorbs light, and in the light sensitive region intrinsic to silver halide. Dye desensitization has been described in The Theory of the Photographic Process, Fourth Edition, T. H. James, Editor, pages 265–266, (Macmillan, 1977).

It is also known that the spectral sensitivity found for certain sensitizing dyes can be dramatically enhanced by the combination with a second, usually colorless organic compound that itself displays no spectral sensitization effect. This is known as the supersensitizing effect.

Examples of compounds which are conventionally known to enhance spectral sensitivity include sulfonic acid derivatives described in U.S. Pat. Nos. 2,937,089 and 3,706,567, triazine compounds described in U.S. Pat. Nos. 2,875,058 and 3,695,888, mercapto compounds described in U.S. Pat. No. 3,457,078, thiourea compounds described in U.S. Pat. No. 3,458,318, pyrimidine derivatives described in U.S. Pat. No. 3,615,632, dihydropyridine compounds described in U.S. Pat. No. 5,192,654, aminothiatriazoles as described in U.S. Pat. No. 5,306,612 and hydrazines as described in U.S Pat. Nos. 2,419,975, 5,459,052 and U.S. Pat. No. 4,971,890 and European Patent Application No. 554,856 A1. The sensitivity increases obtained with these compounds generally are small, and many of these compounds have the disadvantage that they have the undesirable effect of deteriorating the stability of the emulsion or increasing fog.

Various electron donating compounds have also been used to improve spectral sensitivity of silver halide materials. U.S. Pat. No. 3,695,588 discloses that the electron donor ascorbic acid can be used in combination with a specific tricarbocyanine dye to enhance sensitivity in the infrared region. The use of ascorbic acid to give spectral sensitivity improvements when used in combination with specific cyanine and merocyanine dyes is also described in U.S. Pat. No. 3,809,561, British Patent No. 1,255,084, and British Patent No. 1,064,193. U.S. Pat. No. 4,897,343 discloses an improvement that decreases dye desensitization by the use of the combination of ascorbic acid, a metal sulfite compound, and a spectral sensitizing dye.

Electron-donating compounds that are convalently attached to a sensitizing dye or a silver-halide adsorptive group have also been used as supersensitizing agents. U.S. Pat. Nos. 5,436,121 and 5,478,719 disclose sensitivity improvements with the use of compounds containing electron-donating styryl bases attached to monomethine dyes. Spectral sensitivity improvements are also described in U.S. Pat. No. 4,607,006 for compounds containing an electron-donative group derived from a phenothiazine, phenoxazine, carbazole, dibenzophenothiazine, ferrocene, tris(2,2'-bipyridyl)ruthenium, or a triarylamine skeleton which are connected to a silver halide adsorptive group. However, most of these latter compounds have no silver halide sensitizing effect of their own and provide only minus-blue sensitivity improvements when used in combination with a sensitizing dye.

PROBLEM TO BE SOLVED BY THE INVENTION

There is a continuing need for materials which, when added to photographic emulsions, increase their sensitivity. Ideally such materials should be useable with a wide range of emulsion types, their activity should be controllable and they should not increase fog beyond acceptable limits. This invention provides such materials.

SUMMARY OF THE INVENTION

Commonly assigned, co-pending application Ser. No. 08/740,536, filed Oct. 30, 1996, the entire disclosure of which is incorporated herein by reference, discloses a new class of organic electron donating compounds that, when incorporated into a silver halide emulsion, provide a sensitizing effect alone or in combination with dyes. These compounds donate at least one electron and are fragmentable, i.e., they undergo a bond cleavage reaction other than deprotonation. Commonly assigned, co-pending applications Ser. No. 08/739,911 and Ser. No. 08/739,921 both filed Oct. 30, 1996, the entire disclosures of both these applications are incorporated herein by reference, disclose the attachment of such fragmentable electron donors to sensitizing dyes and other silver halide adsorptive groups. The attachment of the fragmentable electron donors to the sensitizing dyes and other silver halide adsorptive groups is accomplished by a covalent bond comprising an organic linking group that contains at least one C, N, S, or O atom.

We have now discovered that fragmentable electron donors that contain a silver halide adsorptive group or a sensitizing dye moiety directly attached to the fragmentable electron donor moiety improve the sensitivity of photographic emulsions with the added advantage of increased emulsion efficiency at relatively low concentrations.

In accordance with this invention, a silver halide emulsion layer of a photographic element is sensitized with a fragmentable electron donor moiety that upon donating an electron, undergoes a bond cleavage reaction other than deprotonation. The term "sensitization" is used in this patent application to mean an increase in the photographic response of the silver halide emulsion layer of a photographic element. The term "sensitizer" is used to mean a compound that provides sensitization when present in a silver halide emulsion layer.

One aspect of this invention comprises a photographic element comprising at least one silver halide emulsion layer in which the silver halide is sensitized with a compound of the formula:

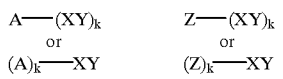

wherein A is a silver halide adsorptive group that contains at least one atom of N, S, P, Se, or Te that promotes adsorption to silver halide, and Z is a light absorbing group including for example cyanine dyes, complex cyanine dyes, merocyanine dyes, complex merocyanine dyes, homopolar cyanine dyes, styryl dyes, oxonol dyes, hemioxonol dyes, and hemicyanine dyes, k is 1 or 2, and XY is a fragmentable electron donor moiety in which X is an electron donor group and Y is a leaving group other than hydrogen, and wherein:

1) XY has an oxidation potential between 0 and about 1.4 V; and
2) the oxidized form of XY undergoes a bond cleavage reaction to give the radical $X^{\bullet}$ and the leaving fragment Y.

Another aspect of this invention comprises a photographic element comprising at least one silver halide emulsion layer in which the silver halide is sensitized with a compound of the formula:

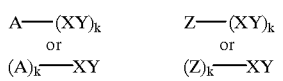

wherein A is a silver halide adsorptive group that contains at least one atom of N, S, P, Se, or Te that promotes adsorption to silver halide, and Z is a light absorbing group including for example cyanine dyes, complex cyanine dyes, merocyanine dyes, complex merocyanine dyes, homopolar cyanine dyes, styryl dyes, oxonol dyes, hemioxonol dyes, and hemicyanine dyes, k is 1 or 2, and XY is a fragmentable electron donor moiety in which X is an electron donor group and Y is a leaving group other than hydrogen, and wherein:

1) XY has an oxidation potential between 0 and about 1.4 V;
2) the oxidized form of XY undergoes a bond cleavage reaction to give the radical $X^{\bullet}$ and the leaving fragment Y; and
3) the radical $X^{\bullet}$ has an oxidation potential $\leqq -0.7$ V (that is, equal to or more negative than about −0.7 V).

Compounds which meet criteria (1) and (2) but not (3) are capable of donating one electron and are referred to herein as fragmentable one-electron donors. Compounds which meet all three criteria are capable of donating two electrons and are referred to herein as fragmentable two-electron donors.

In this patent application, oxidation potentials are reported as "V" which represents "volts versus a saturated calomel reference electrode".

ADVANTAGEOUS EFFECT OF THE INVENTION

This invention provides a silver halide photographic emulsion containing an organic electron donor capable of enhancing both the intrinsic sensitivity and, if a dye is present, the spectral sensitivity of the silver halide emulsion. The activity of these compounds can be easily varied with substituents to control their speed and fog effects in a manner appropriate to the particular silver halide emulsion in which they are used. An important feature of these compounds is that they contain a silver halide adsorptive group, so as to minimize the amount of additive needed to produce a beneficial effect in the emulsion.

This invention relates to novel compounds that contain both the fragmentable electron donor moiety and a sensitizing dye or other silver halide adsorptive group, however, these compounds do not contain a distinct linking group. Because these compounds have no distinct linking group they have an advantage in that they are easier to synthesize than fragmentable electron donor compounds that utilize an organic linking group. The fragmentable electron compounds described herein contain a sensitizing dye moiety or a silver halide adsorptive group that promote adhesion to the silver halide grain surface, thereby allowing the beneficial sensitizing effects at lower concentrations of the fragmentable electron donor.

DETAILED DESCRIPTION OF THE INVENTION

The photographic element of this invention comprises a silver halide emulsion layer which contains a fragmentable electron donating compound represented by the formula:

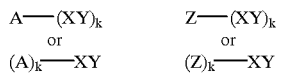

which when added to a silver halide emulsion alone or in combination with a spectral sensitizing dye, can increase photographic sensitivity of the silver halide emulsion. The molecular compounds:

$$A—(XY)_k \quad \text{or} \quad (A)_k—XY \qquad Z—(XY)_k \quad \text{or} \quad (Z)_k—XY$$

are comprised of two parts.

The silver-halide adsorptive group, A, contains at least one N, S, P, Se, or Te atom. The group A preferable comprises a silver-ion ligand moiety or a cationic surfactant moiety. Silver-ion ligands include: i) sulfur acids and their Se and Te analogs, ii) nitrogen acids, iii) thioethers and their Se and Te analogs, iv) phosphines, v) thionamides, selenamides, and telluramides, and vi) carbon acids. The aforementioned carbon acidic compounds should preferably have acid dissociation constants, pKa, greater than about 5 and smaller than about 14. More specifically, the silver-ion ligand moieties which may be used to promote adsorption to silver halide are the following:

i) Sulfur acids, more commonly referred to as mercaptans or thiols, which upon deprotonation can react with silver ion thereby forming a silver mercaptide or complex ion. Thiols with stable C-S bonds that are not sulfide ion precursors have found use as silver halide adsorptive materials as discussed in The Theory of the Photographic Process, fourth Edition, T. H. James, editor, pages 32–34, (Macmillan, 1977). Substituted or unsubstituted alkyl and aryl thiols with the general structure shown below, as well as their Se and Te analogs may be used:

R"—SH and R'"—SH

The group R" is an aliphatic, aromatic, or heterocyclic group, and may be substituted with functional groups comprising halogen, oxygen, sulfur or nitrogen atoms, and R'" is an aliphatic, aromatic, or heterocyclic group substituted with a $SO_2$ functional group. When the group R'" is used the adsorbing group represents a thiosulfonic acid.

Heterocyclic thiols are the more preferred type in this category of adsorbing groups and these may contain O, S, Se, Te, or N as heteroatoms as given in the following general structures:

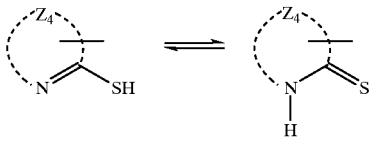

wherein:

$Z_4$ represents the remaining members for completing a preferably 5- or 6-membered ring which may contain one or more additional heteroatoms, such as nitrogen, oxygen, sulfur, selenium or tellurium atom, and is optionally benzo- or naphtho-condensed.

The presence of an —N=adjacent to, or in conjugation with the thiol group introduces a tautomeric equilibrium between the mercaptan [—N=C—SH] and the thionamide structure [—HN—C=S]. The triazolium thiolates of U.S. Pat. No. 4,378,424 represent related mesoionic compounds that cannot tautomerize but are active $Ag^+$ ligands. Preferred heterocyclic thiol silver ligands for use in this invention, which include those common to silver halide technology, are mercaptotetrazole, mercaptotriazole, mercaptothiadiazole, mercaptoimidazole, mercaptooxadiazole, mercaptothiazole, mercaptobenzimidazole, mercaptobenzothiazole, mercaptobenzoxazole, mercaptopyrimidine, mercaptotriazine, phenylmercaptotetrazole, 1,2,4-triazolium 3-thiolate, and 4,5,-diphenyl-1,2,4-triazolium-3-thiolate.

ii) Nitrogen acids which upon deprotonation can serve as silver-ion ligands. A variety of nitrogen acids which are common to silver halide technology may be used, but most preferred are those derived from 5- or 6-membered heterocyclic ring compounds containing one or more of nitrogen, or sulfur, or selenium, or tellurium atoms and having the general formula:

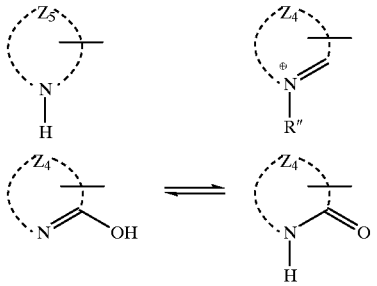

wherein:

$Z_4$ represents the remaining members for completing a preferably 5- or 6-membered ring which may contain one or more additional heteroatoms, such as a nitrogen, oxygen, sulfur, selenium or tellurium atom, and is optionally benzo- or naphtho-condensed, $Z_5$ represents the remaining members for completing a preferably 5- or 6-membered ring which contains at least one additional heteroatom such as nitrogen, oxygen, sulfur, selenium or tellurium and is optionally benzo or naptho-condensed, and R" is an aliphatic, aromatic, or heterocyclic group, and may be substituted with functional groups comprising a halogen, oxygen, sulfur or nitrogen atom.

Preferred are heterocyclic nitrogen acids including azoles, purines, hydroxy azaindenes, and imides, such as those described in U.S. Pat. No. 2,857,274, the disclosure of which is incorporated herein by reference. The most preferred nitrogen acid moieties are: uracil, tetrazole, benzotriazole, benzothiazole, benzoxazole, adenine, rhodanine, and substituted 1,3,3a,7-tetraazaindenes, such as 5-bromo-4-hydroxy-6-methyl-1,3,3a,7-tetraazaindene.

iii) Cyclic and acyclic thioethers and their Se and Te analog. Preferred members of this ligand category are disclosed in U.S. Pat. No. 5,246,827, the disclosure of which is incorporated herein by reference. Structures for preferred thioethers and analogs are given by the general formulae:

$$—S—(CH_2)_b—CH_3$$

$$—Se—(CH_2)_b—CH_3$$

$$—Te—(CH_2)_b—CH_3$$

$$—S—(CH_2)_b—S—(CH_2)_c—CH_3$$

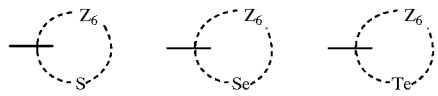

wherein:

b=1–30, c=1–30 with the proviso that b+c is ≦ to 30, and $Z_6$ represents the remaining members for completing a 5- to 18-membered ring, or more preferably a 5- to 8-membered ring. The cyclic structures incorporating $Z_6$ may contain more than one S, Se, or Te atom. Specific examples of this class include: —$SCH_2CH_3$, 1,10-dithia-4,7,13,16-tetraoxacyclooctadecane, —$TeCH_2CH_3$, —$SeCH_2CH_3$, —$SCH_2CH_2SCH_2CH_3$, and thiomorpholine.

iv) Phosphines that are active silver halide ligands in silver halide materials may be used. Preferred phosphine compounds are of the formula:

$$(R'')_2—P$$

wherein each R" is independently an aliphatic, aromatic, or heterocyclic group, and may be substituted with functional groups comprising halogen, oxygen, sulfur or nitrogen atoms. Particularly preferred are $P(CH_2CH_2CN)_2$, and m-sulfophenylmethylphosphine.

v) Thionamides, thiosemicarbazides, telluroureas, and selenoureas of the general formulae:

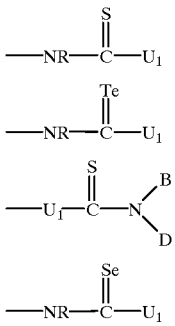

wherein:

$U_1$ represents —$NH_2$, —NHR", —$NR"_2$, —NH-NHR", —SR", OR";

B and D represent R" or, may be linked together, to form the remaining members of a 5- or 6-membered ring; and R" represents an aliphatic, aromatic or heterocyclic group, and R is hydrogen or alkyl or an aryl group.

Many such thionamide $Ag^+$ ligands are described in U.S. Pat. No. 3,598,598, the entire disclosure of which is incorporated herein by reference. Preferred examples of thionamides include N,N'-tetraalkylthiourea, N-hydroxyethyl benzthiazoline-2-thione, and phenyldimethyldithiocarbamate, and N-substituted thiazoline-2-thione.

vi) Carbon acids derived from active methylene compounds that have acid dissociation constants greater than about 5 and less than about 14, such as bromomalonitrile, 1-methyl-3-methyl-1,3,5-trithiane bromide, and acetylenes. Canadian Patent 1,080,532 and U.S. Pat. No. 4,374,279 (both of which are incorporated herein by reference) disclose silver-ion ligands of the carbon acid type for use in silver halide materials. Because the carbon acids have, in general, a lower affinity for silver halide than the other classes of adsorbing groups discussed herein, the carbon acids are less preferred as an adsorbing group. General structures for this class are:

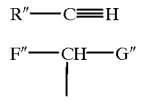

wherein:

R" is an aliphatic, aromatic, or heterocyclic group, and may be substituted with functional groups based on halogen, oxygen, sulfur or nitrogen atoms and where F" and G" are independently selected from —$CO_2R"$, —COR", CHO, CN, $SO_2R"$, SOR", $NO_2$, such that the pKa of the CH is between 5 and 14.

Cationic surfactant moieties that may serve as the silver halide adsorptive group include those containing a hydrocarbon chain of at least 4 or more carbon atoms, which may be substituted with functional groups based on halogen, oxygen, sulfur or nitrogen atoms, and which is attached to at least one positively charged ammonium, sulfonium, or phosphonium group. Such cationic surfactants are adsorbed to silver halide grains in emulsions containing an excess of halide ion, mostly by coulombic attraction as reported in J. Colloid Interface Sci., volume 22, 1966, pp. 391. Examples of useful cationic moieties are:

dimethyldodecylsulfonium, tetradecyltrimethylammonium, N-dodecylnicotinic acid betaine, and decamethylenepyridinium ion.

Preferred examples of A include an alkyl mercaptan, a cyclic or acyclic thioether group, benzothiazole, tetraazaindene, benzotriazole, tetralkylthiourea, and mercapto-substituted hetero ring compounds especially mercaptotetrazole, mercaptotriazole, mercaptothiadiazole, mercaptoimidazole, mercaptooxadiazole, mercaptothiazole mercaptobenzimidazole, mercaptobenzothiazole, mercaptobenzoxazole, mercaptopyrimidine, mercaptotriazine, phenylmercaptotetrazole, 1,2,4-triazolium thiolate, and related structures.

Most preferred examples of A are:

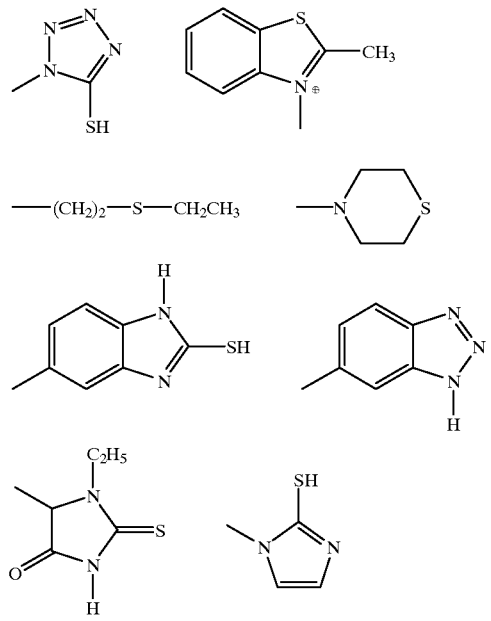

-continued

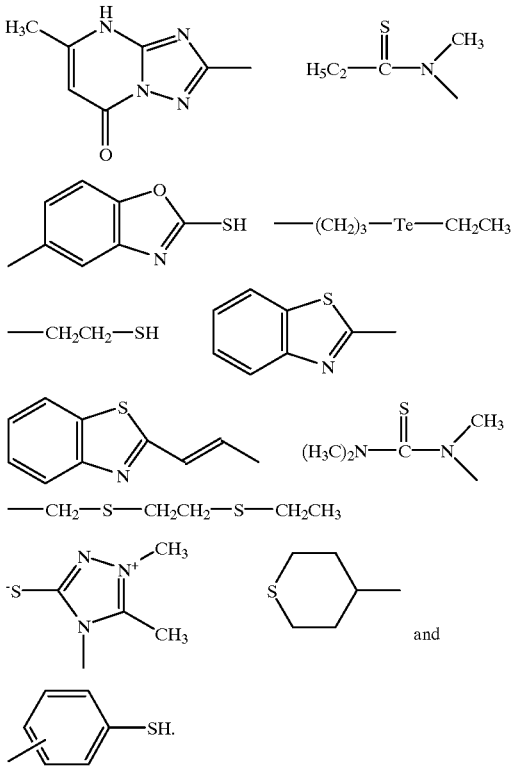

Z is a light absorbing group, preferably a spectral sensitizing dye typically used in color sensitization technology, including for example cyanine dyes, complex cyanine dyes, merocyanine dyes, complex merocyanine dyes, homopolar cyanine dyes, styryl dyes, and hemicyanine dyes. Representative spectral sensitizing dyes are discussed in *Research Disclosure*, Item 36544, September 1994, the disclosure of which, including the disclosure of references cited therein are incorporated herein by reference. These dyes may be synthesized by those skilled in the art according to the procedures described herein or F. M. Hamer, *The Cyanine dyes and Related Compounds* (Interscience Publishers, New York, 1964). Particularly preferred formulae VIII–XII below:

(VIII)

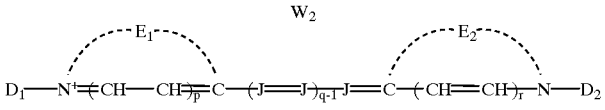

wherein:

$E_1$ and $E_2$ represent the atoms necessary to form a substituted or unsubstituted hetero ring and may be the same or different, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl, and $W_2$ is a counterion as necessary to balance the charge;

(IX)

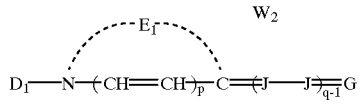

wherein $E_1$, $D_1$, J, p, q and $W_2$ are as defined above for formula (VIII) and G represents

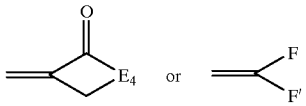

wherein $E_4$ represents the atoms necessary to complete a substituted or unsubstituted heterocyclic nucleus, and F and F' each independently represents a cyano group, an ester group, an acyl group, a carbamoyl group or an alkylsulfonyl group;

(X)

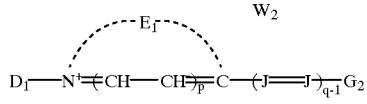

wherein $D_1$, $E_1$, J, p, q and $W_2$ are as defined above for formula (VIII), and $G_2$ represents a substituted or unsubstituted amino group or a substituted or unsubstituted aryl group;

(XI)

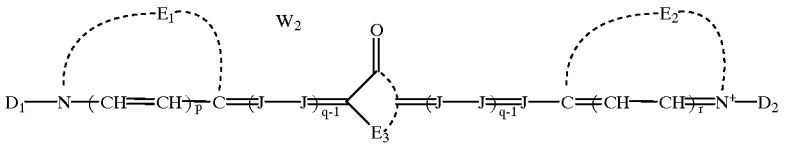

wherein $D_1$, $E_1$, $D_2$, $E_2$, J, p, q, r and $W_2$ are as defined for formula (VIII) above, and $E_3$ is defined the same as $E_4$ for formula (IX) above;

(XII)

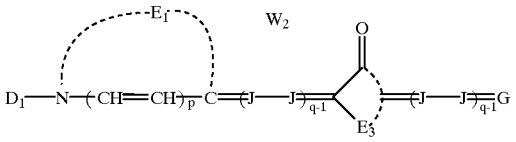

wherein $D_1$, $E_1$, J, G, p, q, r and $W_2$ are as defined above for formula (VIII) above and $E_3$ is as defined for formula (XI) above.

In the above formulas, $E_1$ and $E_2$ each independently represents the atoms necessary to complete a substituted or unsubstituted 5- or 6-membered heterocyclic nucleus. These include a substituted or unsubstituted: thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art.

In one embodiment of the invention, when dyes according to formula (VIII) are used $E_1$ and $E_2$ each independently represent the atoms necessary to complete a substituted or unsubstituted thiazole nucleus, a substituted or unsubstituted selenazole nucleus, a substituted or unsubstituted imidazole nucleus, or a substituted or unsubstituted oxazole nucleus.

Examples of useful nuclei for $E_1$ and $E_2$ include: a thiazole nucleus, e.g., thiazole, 4-methylthiazole, 4-phenylthiazole, 5-methylthiazole, 5-phenylthiazole, 4,5-dimethyl-thiazole, 4,5-diphenylthiazole, 4-(2-thienyl) thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5-methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylbenzothiazole, 5-hydroxybenzothiazole, 6-5-dihydroxybenzothiazole, naphtho[2,1-d]thiazole, 5-ethoxynaphtho[2,3-d]thiazole, 8-methoxynaphtho[2,3-d]thiazole, 7-methoxynaphtho[2,3-d]thiazole, 4'-methoxythianaphtheno-7', 6'-4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole,, 5,6-dimethylbenzoxazole, 4,6-dimethylbenzoxazole, 5-ethoxybenzoxazole, 5-chlorobenzoxazole, 6-methoxybenzoxazole, 5-hydroxybenzoxazole, 6-hydroxybenzoxazole, naphtho[2,1-d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4-pyridine, 3-methyl-4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, etc.; a tellurazole nucleus, e.g., benzotellurazole, naphtho[1.2-d] benzotellurazole, 5,6-dimethoxybenzotellurazole, 5-methoxybenzotellurazole, 5-methylbenzotellurazole; a thiazoline nucleus, e.g.,thiazoline, 4-methylthiazoline, etc.; a benzimidazole nucleus, e.g., benzimidazole, 5-trifluoromethylbenzimidazole, 5,6-dichlorobenzimidazole; and indole nucleus, 3,3-dimethylindole, 3,3-diethylindole, 3,3,5-trimethylindole; or a diazole nucleus, e.g., 5-phenyl-1,3,4-oxadiazole, 5-methyl-1,3,4-thiadiazole.

F and F' are each a cyano group, an ester group such as ethoxy carbonyl, methoxycarbonyl, etc., an acyl group, a carbamoyl group, or an alkylsulfonyl group such as ethylsulfonyl, methylsulfonyl, etc. Examples of useful nuclei for $E_2$ include a 2-thio-2,4-oxazolidinedione nucleus (i.e., those of the 2-thio-2,4-(3H,5H)-oxaazolidinone series) (e.g., 3-ethyl-2-thio-2,4 oxazolidinedione, 3-(2-sulfoethyl)-2-thio-2,4 oxazolidinedione, 3-(4-sulfobutyl)-2-thio-2,4 oxazolidinedione, 3-(3-carboxypropyl)-2-thio-2,4 oxazolidinedione, etc.; a thianaphthenone nucleus (e.g., 2-(2H)-thianaphthenone, etc.), a 2-thio-2,5-thiazolidinedione nucleus (i.e., the 2-thio-2,5-(3H,4H)-thiazolidinedione series) (e.g., 3-ethyl-2-thio-2,5-thiazolidinedione, etc.); a 2,4-thiazolidinedione nucleus (e.g., 2,4-thiazolidinedione, 3-ethyl-2,4-thiazolidinedione, 3-phenyl-2,4-thiazolidinedione, 3-a-naphthyl-2,4-thiazolidinedione, etc.); a thiazolidinone nucleus (e.g., 4-thiazolidinone, 3-ethyl-4-thiazolidinone, 3-phenyl-4-thiazolidinone, 3-a-naphthyl-4-thiazolidinone, etc.); a 2-thiazolin-4-one series (e.g., 2-ethylmercapto-2-thiazolin-4-one, 2-alkylphenyamino-2-thiazolin-4-one, 2-diphenylamino-2-thiazolin-4-one, etc.) a 2-imino-4-oxazolidinone (i.e., pseudohydantoin) series (e.g., 2,4-imidazolidinedione (hydantoin) series (e.g., 2,4-imidazolidinedione, 3-ethyl-2,4-imidazolidinedione, 3-phenyl-2,4-imidazolidinedione, 3-a-naphthyl-2,4-imidazolidinedione, 1,3-diethyl-2,4-imidazolidinedione, 1-ethyl-3-phenyl-2,4-imidazolidinedione, 1-ethyl-2-a-naphthyl-2,4-imidazolidinedione, 1,3-diphenyl-2,4-imidazolidinedione, etc.); a 2-thio-2,4-imidazolidinedione (i.e., 2-thiohydantoin) nucleus (e.g., 2-thio-2,4-imidazolidinedione, 3-ethyl-2-thio-2,4-imidazolidinedione, 3-(2-carboxyethyl)-2-thio-2,4-imidazolidinedione, 3-phenyl-2-thio-2,4-imidazolidinedione, 1,3-diethyl- 2-thio-2,4-imidazolidinedione, 1-ethyl-3-phenyl-2-thio-2,4-imidazolidinedione, 1-ethyl-3-naphthyl-2-thio-2,4-imidazolidinedione, 1,3-diphenyl-2-thio-2,4-imidazolidinedione, etc.); a 2-imidazolin-5-one nucleus.

G2 represents a substituted or unsubstituted amino radical (e.g., primary amino, anilino), or a substituted or unsubstituted aryl radical (e.g., phenyl, naphthyl, dialkylaminophenyl, tolyl, chlorophenyl, nitrophenyl).

According to the formulas (VIII)–(XII), each J represents a substituted or unsubstituted methine group. Examples of substituents for the methine groups include alkyl (preferably of from 1 to 6 carbon atoms, e.g., methyl, ethyl, etc.) and aryl (e.g., phenyl). Additionally, substituents on the methine groups may form bridged linkages.

W2 represents a counterion as necessary to balance the charge of the dye molecule. Such counterions include cations and anions for example sodium, potassium, triethylammonium, tetramethylguanidinium, diisopropylammonium and tetrabutylammonium, chloride, bromide, iodide, para-toluene sulfonate and the like.

D1 and D2 are each independently substituted or unsubstituted aryl (preferably of 6 to 15 carbon atoms), or more preferably, substituted or unsubstituted alkyl (preferably of from 1 to 6 carbon atoms). Examples of aryl include phenyl, tolyl, p-chlorophenyl, and p-methoxyphenyl. Examples of alkyl include methyl, ethyl, propyl, isopropyl, butyl, hexyl, cyclohexyl, decyl, dodecyl, etc., and substituted alkyl groups (preferably a substituted lower alkyl containing from 1 to 6 carbon atoms), such as a hydroxyalkyl group, e.g., 2-hydroxyethyl, 4-hydroxybutyl, etc., a carboxyalkyl group, e.g., 2-carboxyethyl, 4-carboxybutyl, etc., a sulfoalkyl group, e.g., 2-sulfoethyl, 3-sulfobutyl, 4-sulfobutyl, etc., a sulfatoalkyl group, etc., an acyloxyalkyl group, e.g., 2-acetoxyethyl, 3-acetoxypropyl, 4-butyroxybutyl, etc., an alkoxycarbonlyalkyl group, e.g., 2-methoxycarbonlyethyl, 4-ethoxycarbonylbutyl, etc., or an aralkyl group, e.g., benzyl, phenethyl, etc., The alkyl or aryl group may be substituted by one or more of the substituents on the above-described substituted alkyl groups.

Particularly preferred as the light absorbing group Z are dyes 1 thru 19 shown below:

Dye 1

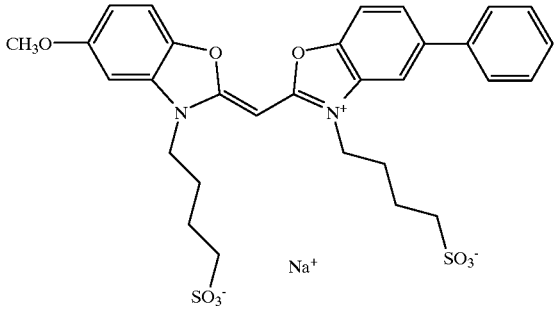

Dye 2

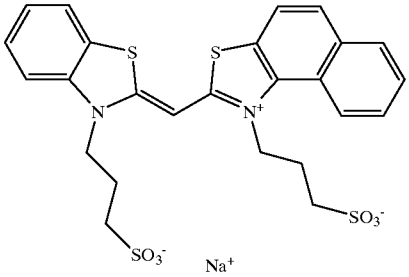

Dye 3

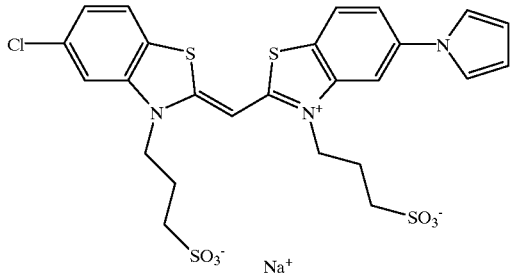

-continued
Dye 4
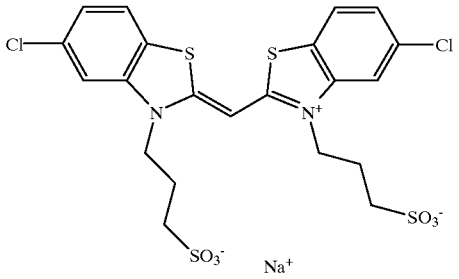
Dye 5
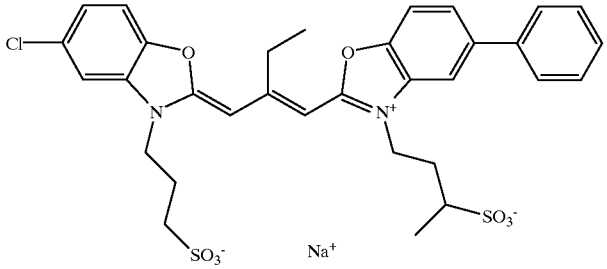
Dye 6
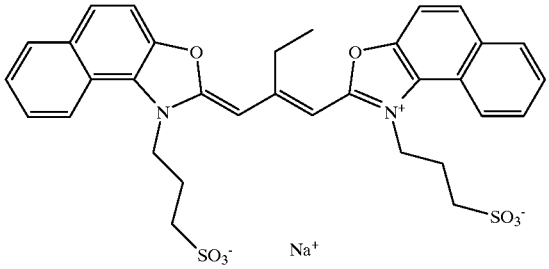
Dye 7
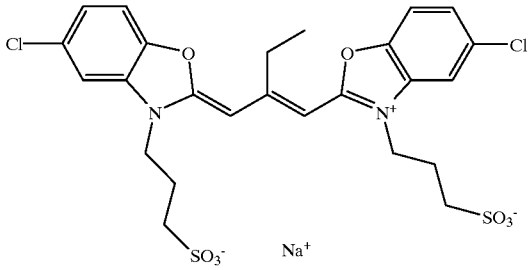
Dye 8
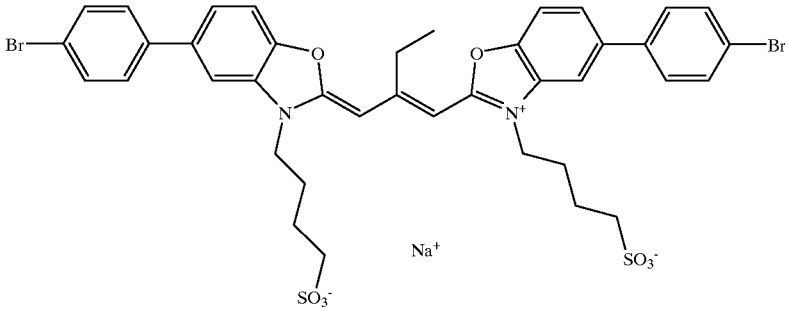

-continued
Dye 9
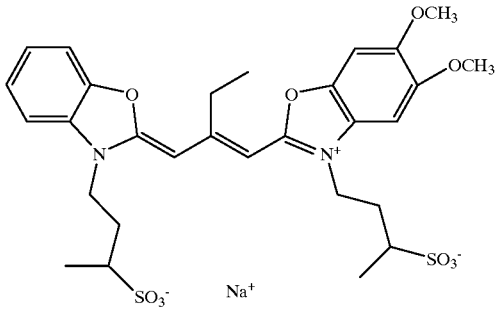
Dye 10
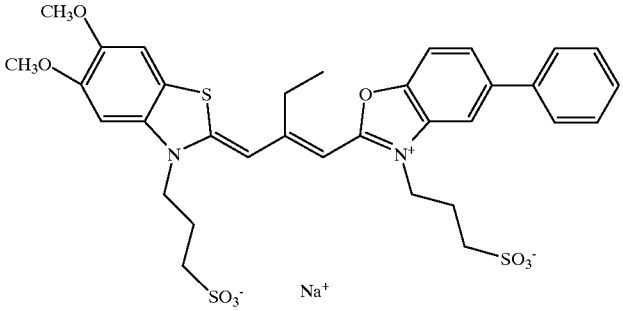
Dye 11
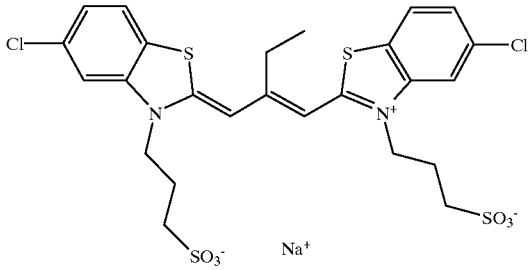
Dye 12
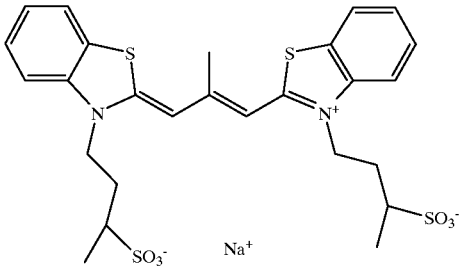
Dye 13
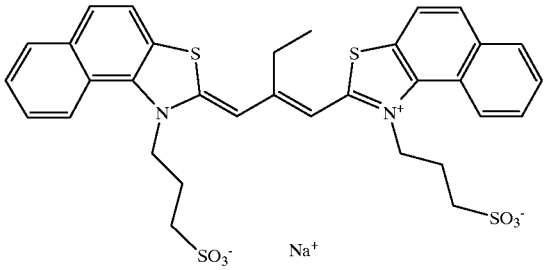

-continued
Dye 14
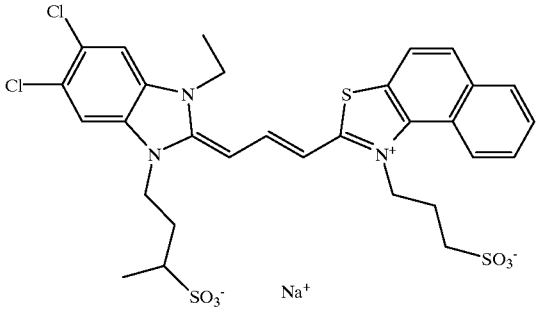
Dye 15
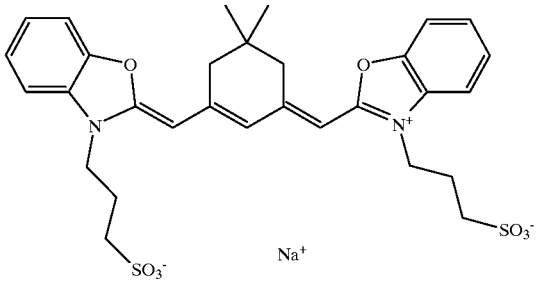
Dye 16
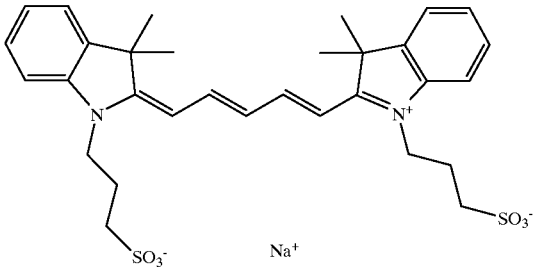
Dye 17
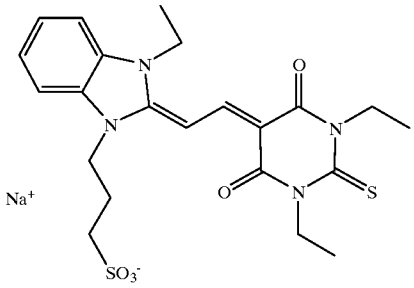
Dye 18
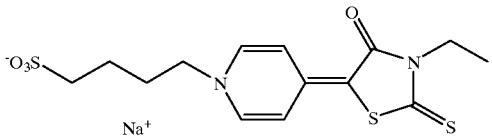
and -continued

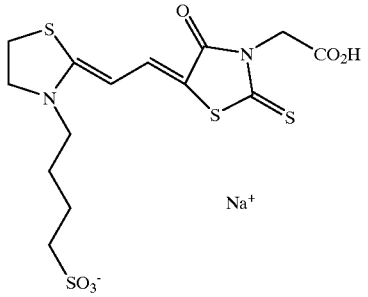

Dye 19

The point of attachment of XY to the silver halide adsorptive group A or the light absorbing group Z will vary depending on the structure of A or Z, and may be at one (or more) of the heteroatoms, or at one (or more) of the aromatic or heterocyclic rings.

XY is a fragmentable electron donor moiety, wherein X is an electron donor group and Y is a leaving group. The preparation of compounds of the formula X-Y is disclosed in commonly assigned co-pending application Ser. No. 08/740,536 filed Oct. 30, 1996, the entire disclosure of which is incorporated herein by reference. The following represents the reactions believed to take place when the XY moiety undergoes oxidation and fragmentation to produce a radical $X^{\bullet}$, which in a preferred embodiment undergoes further oxidation.

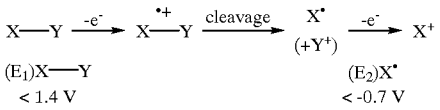

The structural features of the moiety XY are defined by the characteristics of the two parts, namely the fragment X and the fragment Y. The structural features of the fragment X determine the oxidation potential of the XY moiety ($E_1$) and that of the radical $X^{\bullet}(E_2)$, whereas both the X and Y fragments affect the fragmentation rate of the oxidized moiety $XY^{\bullet+}$.

Preferred X groups are of the general formula:

(I)

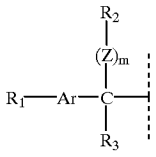

(II)

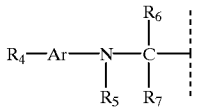

(III)

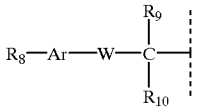

or

-continued (IV)

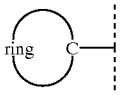

The symbol "R" (that is R without a subscript) is used in all structural formulae in this patent application to represent a hydrogen atom or an unsubstituted or substituted alkyl group.

In structure (I):

m: 0, 1;

Z: O, S, Se, Te;

Ar: aryl group (e.g., phenyl, naphthyl, phenanthryl, anthryl); or heterocyclic group (e.g., pyridine, indole, benzimidazole, thiazole, benzothiazole, thiadiazole, etc.);

$R_1$: R, carboxyl, amide, sulfonamide, halogen, $NR_2$, $(OH)_n$, $(OR')_n$ or $(SR)_n$;

R': alkyl or substituted alkyl;

n: 1–3;

$R_2$: R, Ar';

$R_3$: R, Ar';

$R_2$ and $R_3$ together can form 5- to 8-membered ring;

$R_2$ and Ar: can be linked to form 5- to 8-membered ring;

$R_3$ and Ar: can be linked to form 5- to 8-membered ring;

Ar': aryl group such as phenyl, substituted phenyl, or heterocyclic group (e.g., pyridine, benzothiazole, etc.)

R: a hydrogen atom or an unsubstituted or substituted alkyl group.

In structure (II):

Ar: aryl group (e.g., phenyl, naphthyl, phenanthryl); or heterocyclic group (e.g., pyridine, benzothiazole, etc.);

$R_4$: a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$: R, Ar'

$R_6$ and $R_7$: R, Ar'

$R_5$ and Ar: can be linked to form 5- to 8-membered ring;

$R_6$ and Ar: can be linked to form 5- to 8-membered ring (in which case, $R_6$ can be a hetero atom);

$R_5$ and $R_6$: can be linked to form 5- to 8-membered ring;

$R_6$ and $R_7$: can be linked to form 5- to 8-membered ring;

Ar': aryl group such as phenyl, substituted phenyl, or heterocyclic group;

R: hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar: aryl group (e.g., phenyl, naphthyl, phenanthryl, anthryl); or heterocyclic group (e.g., indole, benzimidazole, etc.)

$R_8$: R, carboxyl, $NR_2$, $(OR)_n$, or $(SR)_n$ (n=1–3);

$R_9$ and $R_{10}$: R, Ar';

$R_9$ and Ar: can be linked to form 5- to 8-membered ring;

Ar': aryl group such as phenyl, substituted phenyl, or heterocyclic group;

R: a hydrogen atom or an unsubstituted or substituted alkyl group.

In structure (IV):

"ring" represents a substituted or unsubstituted 5-, 6- or 7-membered unsaturated ring, preferrably a heterocyclic ring.

Since X is an electron donor group, (i.e., an electron rich organic group), the substituents on the aromatic groups (Ar and/or Ar'), for any particular X group should be selected so that X remains electron rich. For example, if the aromatic group is highly electron rich, e.g. anthracene, electron withdrawing substituents can be used, providing the resulting XY moiety has an oxidation potential of 0 to about 1.4 V. Conversely, if the aromatic group is not electron rich, electron donating substituents should be selected.

When reference in this application is made to a substituent "group" this means that the substituent may itself be substituted or unsubstituted (for example "alkyl group" refers to a substituted or unsubstituted alkyl). Generally, unless otherwise specifically stated, substituents on any "groups" referenced herein or where something is stated to be possibly substituted, include the possibility of any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 12 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 12 carbon atoms; substituted and unsubstituted aryl, particularly those having from 6 to 20 carbon atoms (for example, phenyl); and substituted or unsubstituted heteroaryl, particularly those having a 5- or 6-membered ring containing 1 to 3 heteroatoms selected from N, O, or S (for example, pyridyl, thienyl, furyl, pyrrolyl); and others known in the art. Alkyl substituents preferably contain 1 to 12 carbon atoms and specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

The group A or Z is usually attached to the X group of the XY moiety, although in certain circumstances, may be attached to the Y group (see below). The A or Z group may be attached to X at the nitrogen atom or to the aryl group of X in structures (I)–(III), or to the ring in structure (IV). Illustrative examples of preferred X groups are given below. For simplicity and because of the multiple possible sites, the attachment of the A or Z group is not specifically indicated in the structures. Specific structures for A-$(XY)_k$, $(A)_k$-XY, Z-$(XY)_k$, or $(Z)_k$-XY compounds are provided hereinafter.

Preferred X groups of general structure I are:

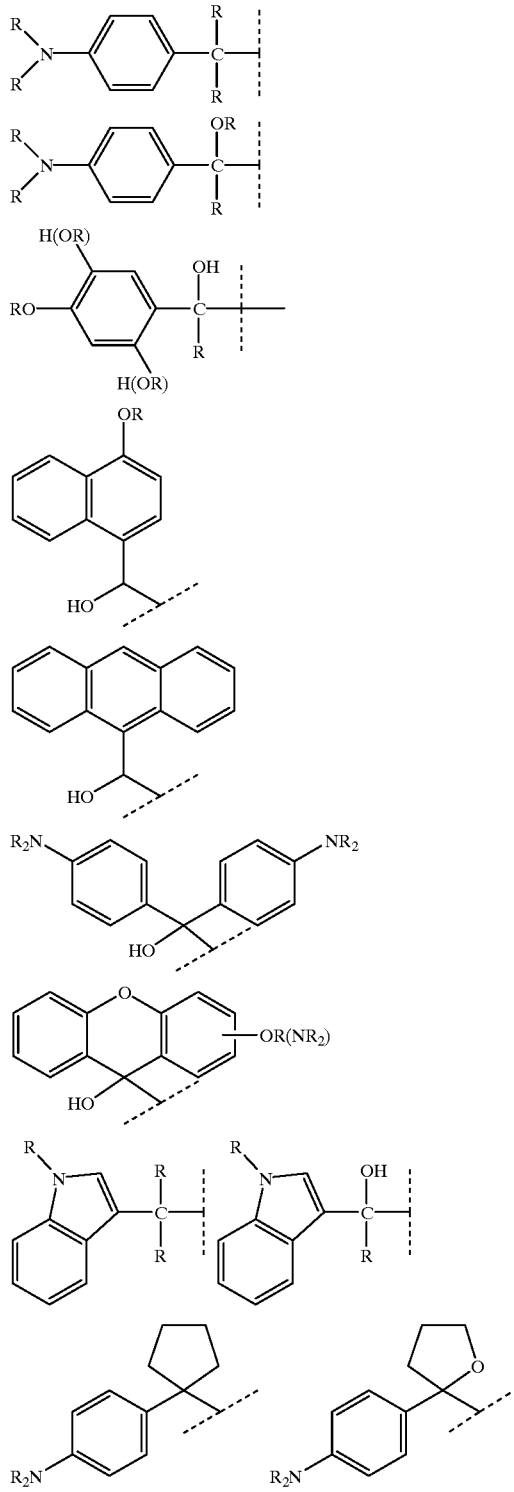

-continued

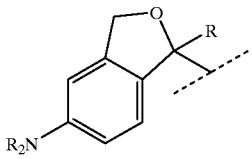

In the structures of this patent application a designation such as —OR($NR_2$) indicates that either —OR or —$NR_2$ can be present.

The following are illustrative examples of the group X of general structure II:

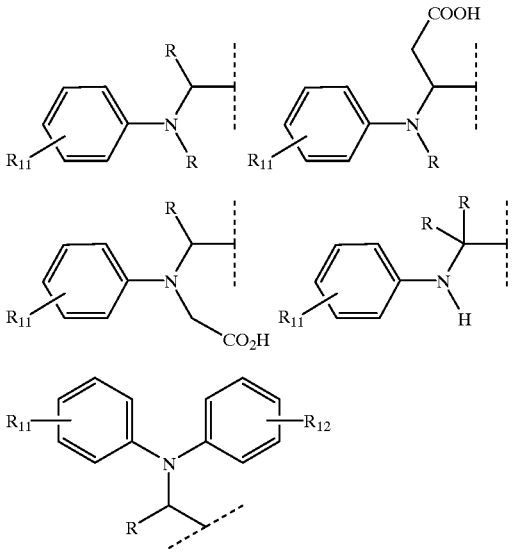

$R_{11}$ and $R_{12}$ = { H, alkyl, alkoxy, alkylthio, halo, carbamoyl; carboxyl, amido, formyl, sulfonyl, sulfonamido, nitrile }

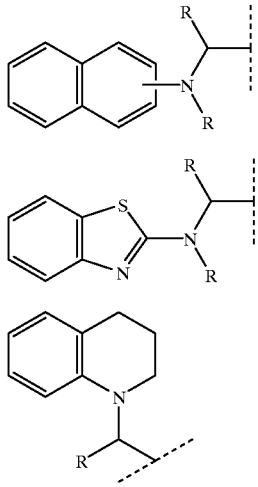

-continued

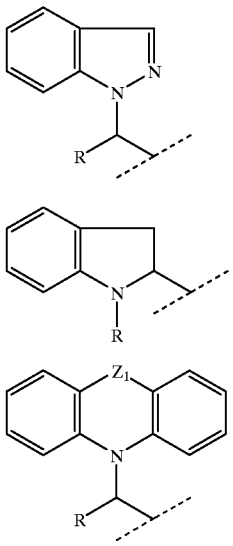

$Z_1$⊙a covalent bond, S, O, Se, NR, $CR_2$, CR═CR, or $CH_2CH_2$.

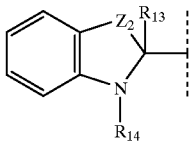

$Z_2$═S, O, Se, NR, $CR_2$, CR═CR, $R_{13}$=alkyl, substituted alkyl or aryl, and $R_{14}$═H, alkyl, substituted alkyl or aryl.

The following are illustrative examples of the group X of the general structure III:

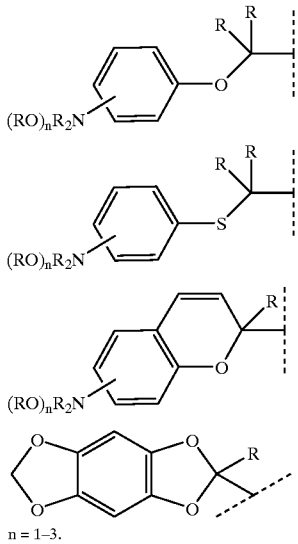

n = 1–3.

The following are illustrative examples of the group X of the general structure IV:

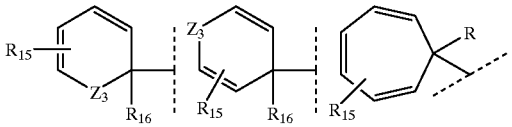

$Z_3$ = O, S, Se, NR
$R_{15}$ = R, OR, $NR_2$ $R_{16}$=alkyl, substituted alkyl

Preferred Y groups are:

(1) X', where X' is an X group as defined in structures I–IV and may be the same as or different from the X group to which it is attached (2)

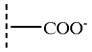

(3)

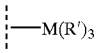

(4)

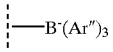

The groups A or Z may be attached to the Y group in the case of (3) and (4). For simplicity, the attachment of the A or Z group is not specifically indicated in the generic formulae.

In preferred embodiments of this invention Y is —COO— or —Si(R')$_3$ or —X'. Particularly preferred Y groups are —COO— or —Si(R')$_3$.

Preferred XY moieties are derived from X-Y compounds of the formulae given below (for simplicity, and because of the multiple possible sites, the attachment of the A or Z group is not specified):

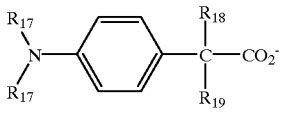

| Cpd. No. | $R_{17}$ | $R_{18}$ | $R_{19}$ |
|---|---|---|---|
| 1 | $CH_3$ | H | H |
| 2 | $C_2H_5$ | OH | H |
| 3 | $CH_3$ | OH | H |
| 4 | $C_2H_5$ | OH | $CH_3$ |
| 5 | $CH_3$ | OH | $CH_3$ |
| 6 | $C_2H_5$ | $OCH_3$ | $CH_3$ |
| 7 | $CH_3$ | $OCH_3$ | $CH_3$ |
| 8 | $C_2H_5$ | $OCH_3$ | H |

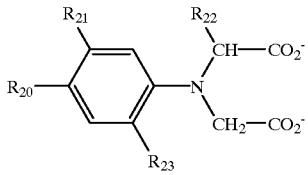

| Cpd. No. | $R_{20}$ | $R_{21}$ | $R_{22}$ | $R_{23}$ |
|---|---|---|---|---|
| 9 | $OCH_2CO_2^-$ | H | H | H |
| 10 | $OCH_3$ | H | H | H |
| 11 | $CH_3$ | H | H | H |
| 12 | Cl | H | H | H |
| 13 | H | H | H | H |
| 14 | H | H | $CH_3$ | H |
| 15 | $OCH_3$ | H | $CH_3$ | H |
| 16 | $CH(CH_3)C_2H_5$ | H | $CH_3$ | H |
| 17 | CHO | H | $CH_3$ | H |
| 18 | $SO_3^-$ | H | $CH_3$ | H |
| 19 | $SO_2N(C_2H_5)_2$ | H | $CH_3$ | H |
| 20 | $CH_3$ | H | $CH_3$ | H |
| 21 | $OCH_3$ | $OCH_3$ | H | H |
| 22 | H | H | H | $OCH_2CO_2^-$ |

-continued
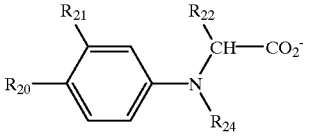
| Cpd. No. | $R_{20}$ | $R_{22}$ | $R_{24}$ | $R_{21}$ |
|---|---|---|---|---|
| 23 | $OCH_3$ | $CH_3$ | H | H |
| 24 | H | $CH_3$ | H | H |
| 25 | $CO_2^-$ | $CH_3$ | H | H |
| 26 | Cl | $CH_3$ | H | H |
| 27 | $CONH_2$ | $CH_3$ | H | H |
| 28 | $CO_2C_2H_5$ | $CH_3$ | H | H |
| 29 | $CH_3$ | $CH_2CO_2^-$ | H | H |
| 30 | H | $CH_2CO_2^-$ | H | H |
| 31 | $CO_2^-$ | $CH_2CO_2^-$ | H | H |
| 32 | H | $CH_3$ | H | $CONH_2$ |
| 33 | $CO_2^-$ | $CH_3$ | $CH_3$ | H |
| 34 | H | $CH_3$ | $C_2H_5$ | $CONH_2$ |
| 35 | $CH_3$ | $CH_3$ | $(CH_2)_3CH_3$ | H |
| 36 | $OCH_3$ | $CH_3$ | $(CH_2)_3CH_3$ | H |
| 37 | H | $CH_3$ | $(CH_2)_3CH_3$ | H |
| 38 | $CO_2^-$ | $CH_3$ | $(CH_2)_3CH_3$ | H |
| 39 | Cl | $CH_3$ | $(CH_2)_3CH_3$ | H |
| 40 | $CH_3$ | $CH_2CO_2^-$ | $(CH_2)_3CH_3$ | H |
| 41 | H | $CH_2CO_2^-$ | $(CH_2)_3CH_3$ | H |
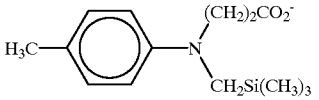
Cpd. 42
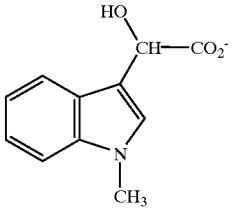
Cpd. 43
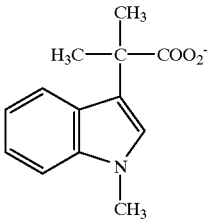
Cpd. 44
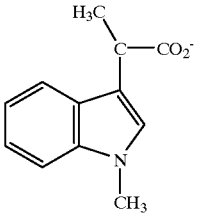
Cpd. 45
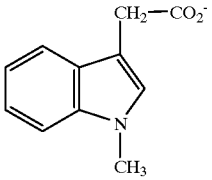
Cpd. 46
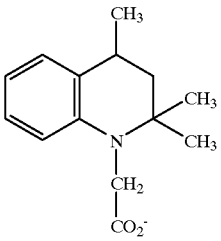
Cpd. 47
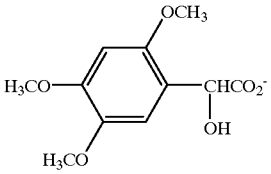
Cpd. 48
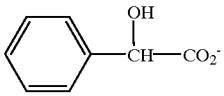
Cpd. 49

-continued

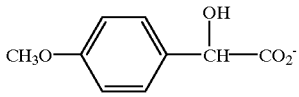
Cpd. 50

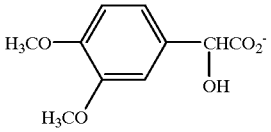
Cpd. 51

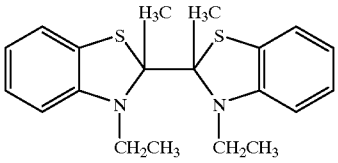
Cpd. 52

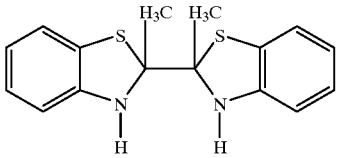
Cpd. 53

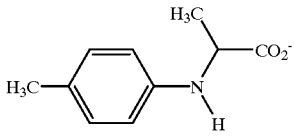
Cpd. 54

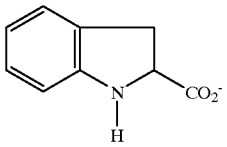
Cpd. 55

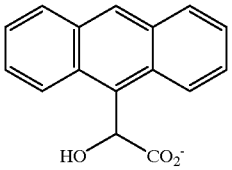
Cpd. 56

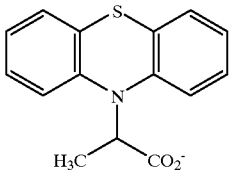
Cpd. 57

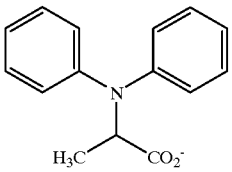
Cpd. 58

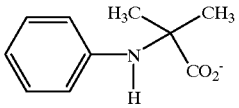
Cpd. 59

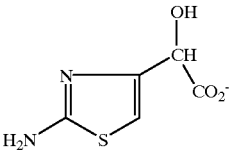
Cpd. 60

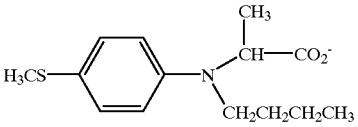
Cpd. 61

In the above formulae, counterion(s) required to balance the charge of the XY moiety are not shown as any counterion can be utilized. Common counterions are sodium, potassium, triethylammonium ($TEA^+$), tetramethylguanidinium ($TMG^+$), diisopropylammonium ($DIPA^+$), and tetrabutylammonium ($TBA^+$).

Fragmentable electron donor moieties XY are derived from electron donors X-Y which can be fragmentable one electron donors which meet the first two criteria set forth below or fragmentable two electron donors which meet all three criteria set forth below. The first criterion relates to the oxidation potential of X-Y ($E_1$). $E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably of from about 0.3 V to about 1.0 V.

Oxidation potentials are well known and can be found, for example, in "Encyclopedia of Electrochemistry of the Elements", Organic Section, Volumes XI–XV, A. Bard and H. Lund (Editors) Marcel Dekker Inc., NY (1984). $E_1$ can be measured by the technique of cyclic voltammetry. In this technique, the electron donating compound is dissolved in a solution of 80%/20% by volume acetonitrile to water containing 0.1 M lithium perchlorate. Oxygen is removed from the solution by passing nitrogen gas through the solution for 10 minutes prior to measurement. A glassy carbon disk is used for the working electrode, a platinum wire is used for the counter electrode, and a saturated calomel electrode (SCE) is used for the reference electrode. Measurement is conducted at 25° C. using a potential sweep rate of 0.1 V/sec. The oxidation potential vs. SCE is taken as the peak potential of the cyclic voltammetric wave. $E_1$ values for typical X-Y compounds useful in preparing the compounds of this invention are given in Table A.

TABLE A

| Oxidation Potential of X—Y | | | |
|---|---|---|---|
| Compound | $E_1$ (V vs SCE) | Compound | $E_1$ (V vs SCE) |
| 1 | 0.53 | 30 | 0.60 |
| 2 | 0.50 | 26 | 0.51 |
| 5 | 0.51 | 27 | 0.62 |
| 4 | 0.49 | 38 | 0.48 |
| 7 | 0.52 | 39 | 0.40 |
| 6 | 0.51 | 41 | 0.48 |
| 8 | 0.49 | 34 | 0.52 |
| 48 | 0.70 | 28 | 0.61 |
| 51 | 0.91 | 17 | 0.74 |
| 49 | ~1.2 | 18 | 0.70 |
| 50 | ~1.05 | 19 | 0.68 |
| 43 | 0.61 | 31 | 0.61 |
| 44 | 0.64 | 22 | 0.65 |
| 45 | 0.64 | 59 | 0.53 |
| 46 | 0.68 | 56 | 0.65 |
| 42 | 0.30 | 57 | 0.49 |
| 9 | 0.38 | 58 | 0.49 |
| 10 | 0.38 | 52 | 0.07 |
| 11 | 0.46 | 54 | 0.44 |
| 23 | 0.37 | | |
| 20 | 0.46 | | |
| 14 | 0.50 | | |
| 15 | 0.36 | | |
| 16 | 0.47 | | |
| 36 | 0.22 | | |
| 29 | 0.52 | | |
| 40 | 0.38 | | |
| 35 | 0.34 | | |
| 25 | 0.62 | | |
| 33 | 0.54 | | |
| 13 | 0.54 | | |
| 12 | 0.58 | | |
| 21 | 0.36 | | |
| 24 | 0.52 | | |
| 37 | 0.43 | | |
| 32 | 0.58 | | |
| 60 | 0.80 | | |

The second criterion defining the fragmentable XY groups is the requirement that the oxidized form of X-Y, that is the radical cation $X\text{-}Y^{+\bullet}$, undergoes a bond cleavage reaction to give the radical $X^{\bullet}$ and the fragment $Y^{+}$ (or in the case of an anionic compound the radical $X^{\bullet}$ and the fragment Y). This bond cleavage reaction is also referred to herein as "fragmentation". It is widely known that radical species, and in particular radical cations, formed by a one-electron oxidation reaction may undergo a multitude of reactions, some of which are dependent upon their concentration and on the specific environment wherein they are produced. As described in "Kinetics and Mechanisms of Reactions of Organic Cation Radicals in Solution", Advances in Physical Organic Chemistry, vol 20, 1984, pp 55–180, and "Formation, Properties and Reactions of Cation Radicals in Solution", Advances in Physical Organic Chemistry, vol 13, 1976, pp 156–264, V. Gold Editor, 1984, published by Academic Press, NY, the range of reactions available to such radical species includes: dimerization, deprotonation, hydrolysis, nucleophilic substitution, disproportionation, and bond cleavage. With compounds useful in accordance with our invention, the radical formed on oxidation of X-Y undergoes a bond cleavage reaction.

The kinetics of the bond cleavage or fragmentation reaction can be measured by conventional laser flash photolysis. The general technique of laser flash photolysis as a method to study properties of transient species is well known (see, for example, "Absorption Spectroscopy of Transient Species". Herkstroeter and I. R. Gould in Physical Methods of Chemistry Series, second Edition, Volume 8, page 225, edited by B. Rossiter and R. Baetzold, John Wiley & Sons, New York, 1993). The specific experimental apparatus we used to measure fragmentation rate constants and radical oxidation potentials is described in detail below. The rate constant of fragmentation in compounds useful in accordance with this invention is preferably faster than about 0.1 per second (i.e., 0.1 $s^{-1}$ or faster, or, in other words, the lifetime of the radical cation $X\text{-}Y^{+\bullet}$ should be 10 sec or less). The fragmentation rate constants can be considerably higher than this, namely in the $10^2$ to $10^{13}$ $s^{-1}$ range. The fragmentation rate constant is preferably about 0.1 $sec^{-1}$ to about $10^{13}$ $s^{-1}$, more preferably about $10^2$ to about $10^9$ $s^{-1}$. Fragmentation rate constants $k_{fr}$ ($s^{-1}$) for typical compounds XY useful in preparing compounds of this invention are given in Table B.

TABLE B

Rate Constants for Decarboxylation of Radical Cations in $CH_3CN/H_2O$ (4:1)

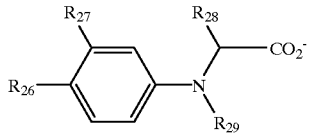

| COMP'D | $R_{26}$ | $R_{27}$ | $R_{28}$ | $R_{29}$ | $k_{fr}$ ($s^{-1}$) |
|---|---|---|---|---|---|
| 14 | H | H | Me | $CH_2CO_2^-$ | >2.0 × $10^7$ |
| 13 | H | H | H | $CH_2CO_2^-$ | 1.7 × $10^7$ |
| 20 | Me | H | Me | $CH_2CO_2^-$ | 8.1 × $10^6$ |
| 11 | Me | H | H | $CH_2CO_2^-$ | 1.6 × $10^6$ |
| 15 | OMe | H | Me | $CH_2CO_2^-$ | 9.0 × $10^4$ |
| 10 | OMe | H | H | $CH_2CO_2^-$ | 9.3 × $10^3$ |
| 21 | OMe | OMe | H | $CH_2CO_2^-$ | 1 × $10^3$ |
| 36 | OMe | H | Me | n-Bu | 1.1 × $10^6$ |
| 40 | Me | H | $CH_2CO_2^-$ | n-Bu | 1.3 × $10^7$ |
| 29 | Me | H | $CH_2CO_2^-$ | H | 5.4 × $10^6$ |
| 54 | Me | H | Me | H | 1.4 × $10^7$ |

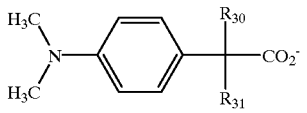

| COMPOUND | $R_{30}$ | $R_{31}$ | $k_{fr}$ ($s^{-1}$) |
|---|---|---|---|
| 3 | OH | Me | 5.5 × $10^5$ |
| 1 | H | H | ~3.0 × $10^5$ |

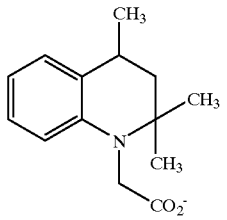

| COMPOUND | $k_{fr}$ ($s^{-1}$) |
|---|---|

TABLE B-continued

| | |
|---|---|
| 47 | $>10^7$ |

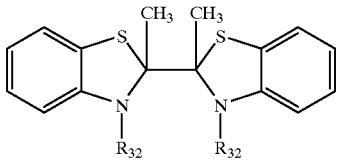

| COMPOUND | $R_{32}$ | $k_{fr}$ ($s^{-1}$) |
|---|---|---|
| 52 | H | $>10^9$ |
| 53 | Et | $>10^9$ |

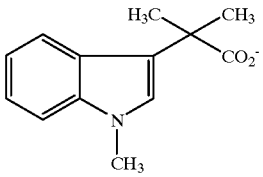

| COMPOUND | $k_{fr}$ ($s^{-1}$) |
|---|---|
| 44 | $5.3 \times 10^5$ |

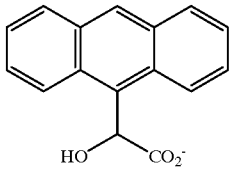

| COMPOUND | $k_{fr}$ ($s^{-1}$) |
|---|---|
| 56 | $1.2 \times 10^5$ |

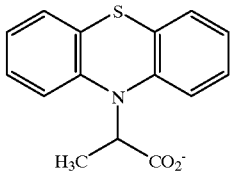

| COMPOUND | $k_{fr}$ ($s^{-1}$) |
|---|---|
| 57 | ca. $1 \times 10^5$ |

In a preferred embodiment of the invention, the XY moiety is a fragmentable two-electron donor moiety and meets a third criterion, that the radical $X^{\bullet}$ resulting from the bond cleavage reaction has an oxidation potential equal to or more negative than −0.7 V, preferably more negative than about −0.9 V. This oxidation potential is preferably in the range of from about −0.7 to about −2 V, more preferably from about −0.8 to about −2 V and most preferably from about −0.9 to about −1.6 V.

The oxidation potential of many radicals have been measured by transient electrochemical and pulse radiolysis techniques as reported by Wayner, D. D.; McPhee, D. J.; Griller, D. in *J. Am. Chem. Soc.* 1988, 110, 132; Rao, P. S,; Hayon, E. *J. Am. Chem. Soc.* 1974, 96, 1287 and Rao, P. S,; Hayon, E. *J Am. Chem. Soc.* 1974, 96, 1295. The data demonstrate that the oxidation potentials of tertiary radicals are less positive (i.e., the radicals are stronger reducing agents) than those of the corresponding secondary radicals, which in turn are more negative than those of the corresponding primary radicals. For example, the oxidation potential of benzyl radical decreases from 0.73 V to 0.37 V to 0.16 V upon replacement of one or both hydrogen atoms by methyl groups.

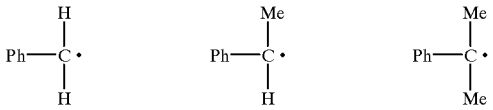

$E^{OX}$ (V) +0.73 +0.37 +0.16

A considerable decrease in the oxidation potential of the radicals is achieved by a hydroxy or alkoxy substituents. For example the oxidation potential of the benzyl radical (+0.73 V) decreases to −0.44 when one of the a hydrogen atoms is replaced by a methoxy group.

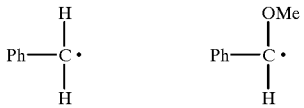

$E^{OX}$ (V) +0.73 -0.44

An a-amino substituent decreases the oxidation potential of the radical to values of about −1 V.

In accordance with our invention we have discovered that compounds which provide a radical $X^{\bullet}$ having an oxidation potential more negative than −0.7 are particularly advantageous for use in sensitizing silver halide emulsions. As set forth in the above-noted articles, the substitution at the a carbon atom influences the oxidation potential of the radical. We have found that substitution of the phenyl moiety with at least one-electron donating substituent or replacement of the phenyl with an electron donating aryl or heterocyclic group also influences the oxidation potential of $X^{\bullet}$. Illustrative examples of $X^{\bullet}$ having an oxidation potential more negative than −0.7 are given below in Table C. The oxidation potential of the transient species $X^{\bullet}$, can be determined using a laser flash photolysis technique as described in greater detail below.

In this technique, the compound X-Y is oxidized by an electron transfer reaction initiated by a short laser pulse. The oxidized form of X-Y then undergoes the bond cleavage reaction to give the radical $X^{\bullet}$. $X^{\bullet}$ is then allowed to interact with various electron acceptor compounds of known reduction potential. The ability of $X^{\bullet}$ to reduce a given electron acceptor compound indicates that the oxidation potential of $X^{\bullet}$ is nearly equal to or more negative than the reduction potential of that electron acceptor compound. The experimental details are set forth more fully below. The oxidation potentials ($E_2$) for radicals $X^{\bullet}$ for typical compounds useful in accordance with our invention are given in Table C. Where only limits on potentials could be determined, the following notation is used: <−0.90 V should be read as "more negative than −0.90 V" and >−0.40 V should be read as "less negative than −0.40 V".

Illustrative $X^{\bullet}$ radicals useful in accordance with the third criterion of our invention are those given below having an oxidation potential $E_2$ more negative than −0.7 V. Some comparative examples with $E_2$ less negative than −0.7 V are also included.

TABLE C

Oxidation Potentials of Radicals ($X^{\bullet}$), $E_2$

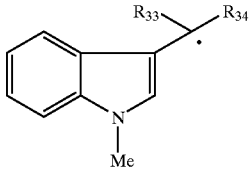

| Parent X-Y compound | $R_{33}$ | $R_{34}$ | $E_2$ |
|---|---|---|---|
| 46 | H | H | ~−0.34 |
| 45 | Me | H | −0.56 |
| 44 | Me | Me | −0.81 |
| 43 | OH | H | −0.89 |

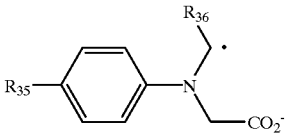

| Parent X-Y compound | $R_{35}$ | $R_{36}$ | $E_2$ |
|---|---|---|---|
| 13 | H | H | ~−0.85 |
| 14 | H | Me | <−0.9 |
| 11 | Me | H | ~−0.9 |
| 16 | i-Bu | H | ~−0.9 |
| 20 | Me | Me | <−0.9 |
| 10 | OMe | H | <−0.9 |
| 15 | OMe | Me | <−0.9 |

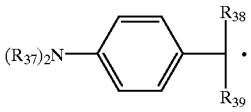

| Parent X-Y compound | $R_{37}$ | $R_{38}$ | $R_{39}$ | $E_2$ |
|---|---|---|---|---|
| 8 | Et | H | OMe | ~−0.85 |
| 2 | Et | H | OH | <−0.9 |
| 7 | Me | Me | OMe | <−0.9 |
| 5 | Me | Me | OH | <−0.9 |
| 1 | Me | H | H | >−0.5 |

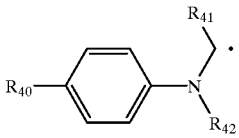

| Parent X-Y compound | $R_{40}$ | $R_{41}$ | $R_{42}$ | $E_2$ |
|---|---|---|---|---|
| 36 | OMe | Me | n-Bu | <−0.9 |
| 33 | $CO_2^-$ | Me | Me | <−0.9 |

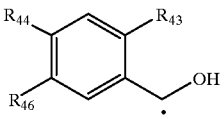

| Parent X-Y compound | $R_{44}$ | $R_{43}$ | $R_{46}$ | $E_2$ |
|---|---|---|---|---|
| 48 | OMe | OMe | OMe | <−0.9 |

TABLE C-continued

| | | | | |
|---|---|---|---|---|
| 51 | OMe | H | OMe | <−0.9 |
| 49 | H | H | H | −0.75 |
| 50 | OMe | H | H | <−0.9 |

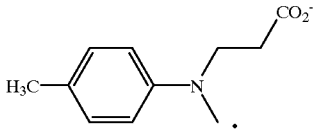

| Parent X-Y compound | $E_2$ |
|---|---|
| 42 | ~−0.9 |

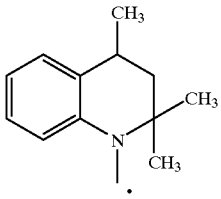

| Parent X-Y compound | $E_2$ |
|---|---|
| 47 | <−0.9 |

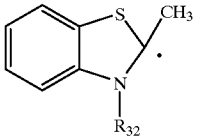

| Parent X-Y compound | $R_{32}$ | $E_2$ |
|---|---|---|
| 52 | H | <−0.9 |
| 53 | Et | <−0.9 |

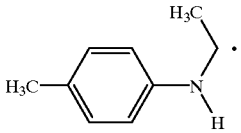

| Parent X-Y compound | $E_2$ |
|---|---|
| 54 | <−0.9 |

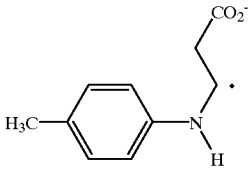

| Parent X-Y compound | $E_2$ |
|---|---|
| 29 | <−0.9 |

TABLE C-continued

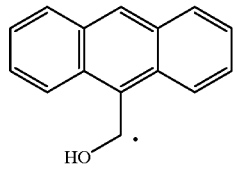

| Parent X-Y compound | $E_2$ |
|---|---|
| 56 | <−0.9 |

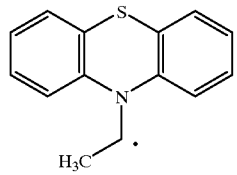

| Parent X-Y compound | $E_2$ |
|---|---|
| 57 | <−0.9 |

Specific inventive compounds according to the general formulae given above are listed below, but the present invention should not be construed as being limited thereto. As is demonstrated in these examples, the point of attachment of A to XY or of Z to XY may be at one (or more) of the heteroatoms, or at one (or more) of the aromatic or heterocyclic rings on the X portion of XY. Some specific examples follow:

INV 1

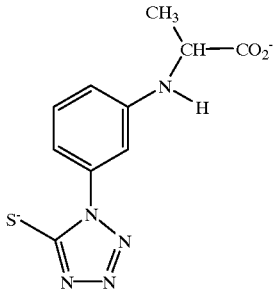

INV 2

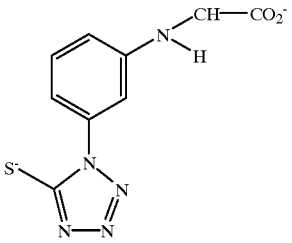

INV 3

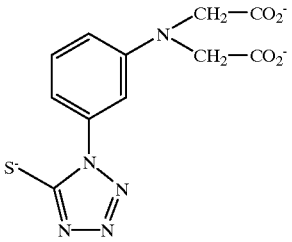

-continued
INV 4
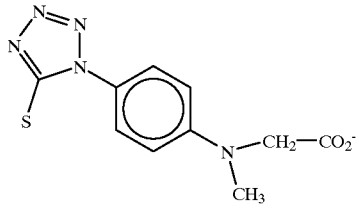
INV 5
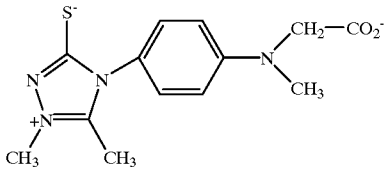
INV 6
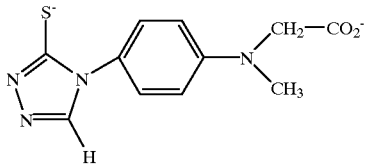
INV 7
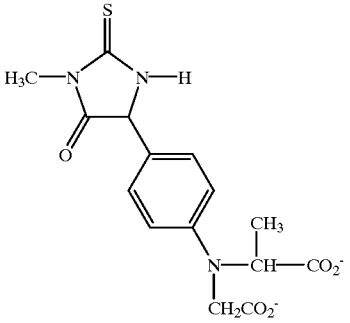
INV 8
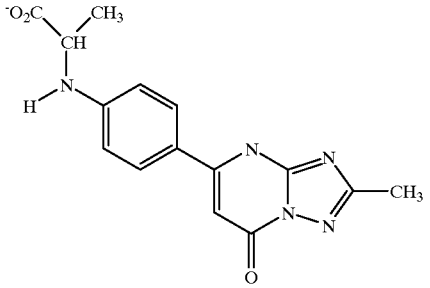
INV 9
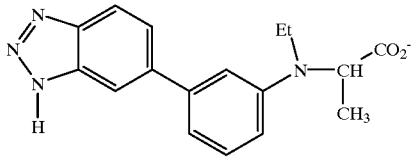
INV 10
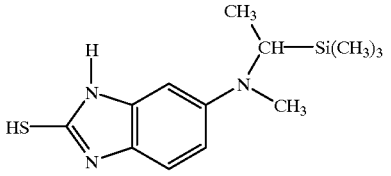

-continued
INV 11
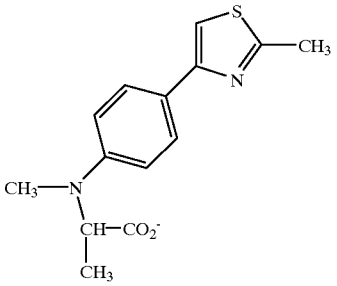
INV 12
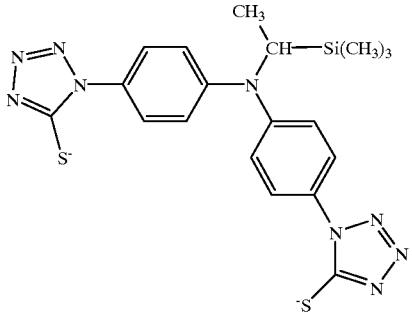
INV 13
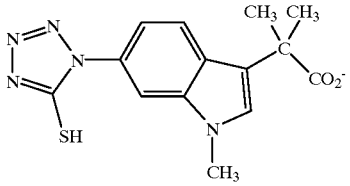
INV 14
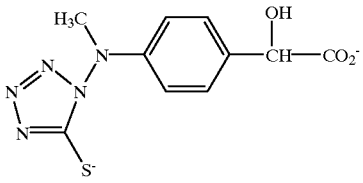
INV 15
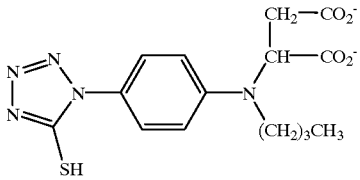
INV 16
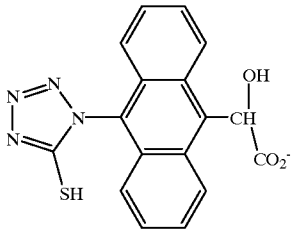

-continued
INV 17
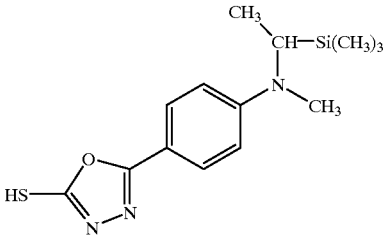
INV 18
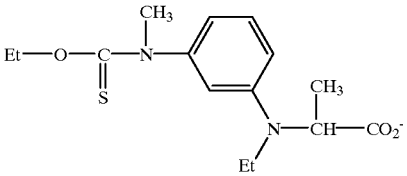
INV 19
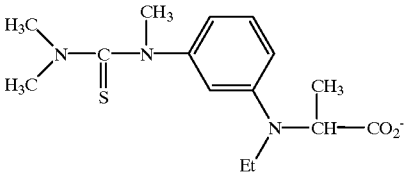
INV 20
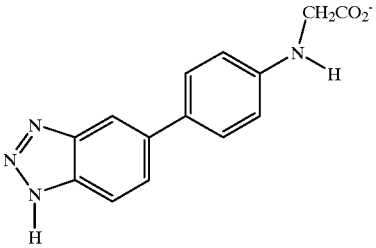
INV 21
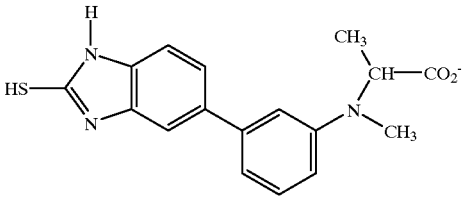
INV 22
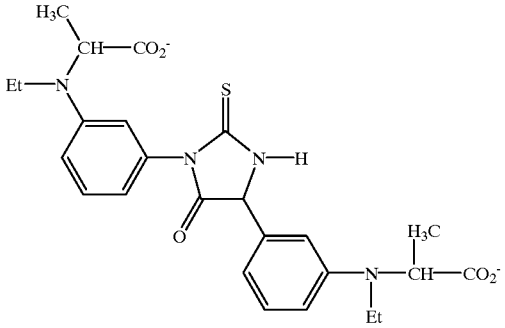
INV 23
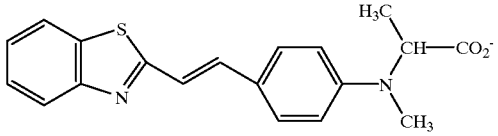

-continued
INV 24
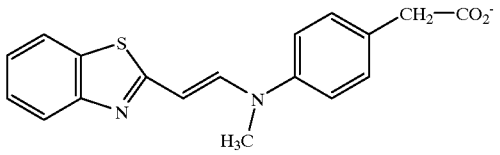
INV 25
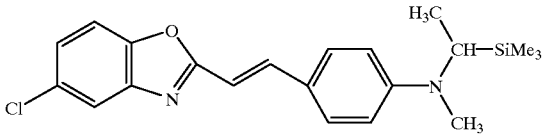
INV 26
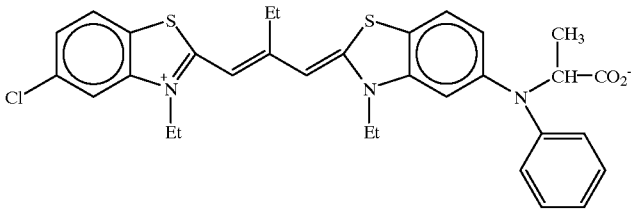
INV 27
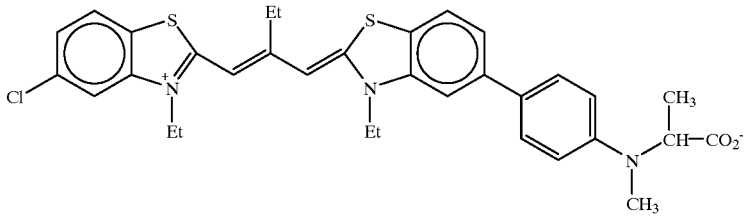
INV 28
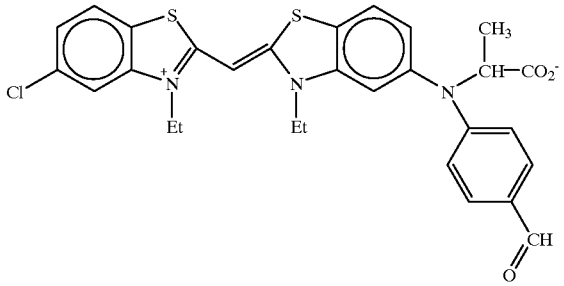
INV 29
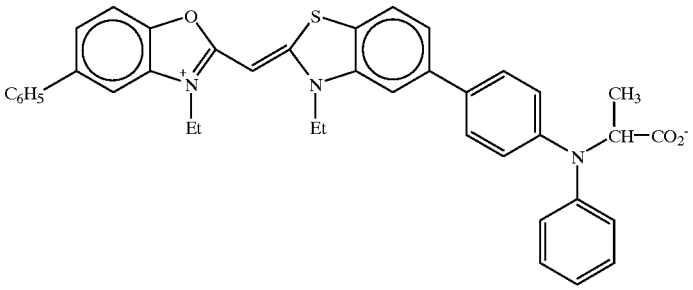
INV 30
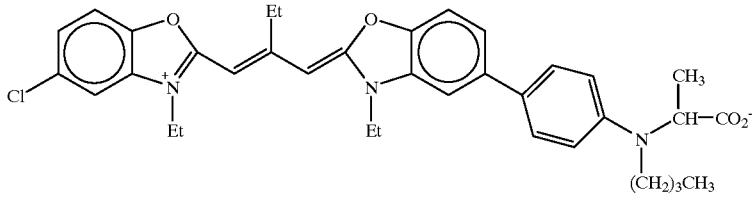

-continued
INV 31
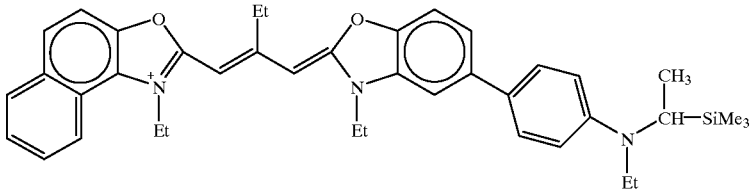
INV 32
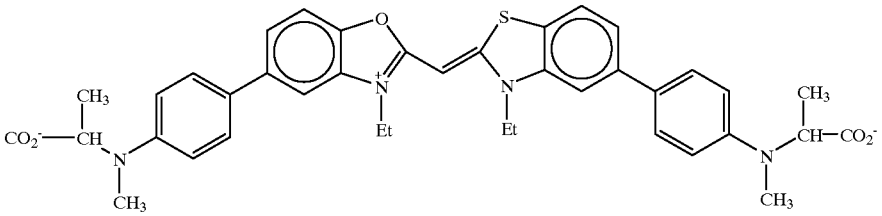
INV 33
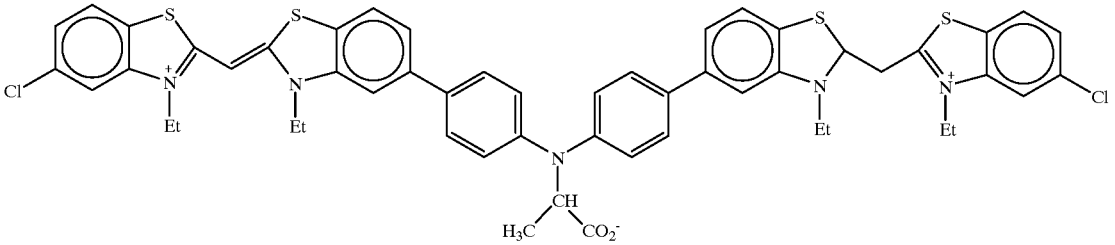
INV 34
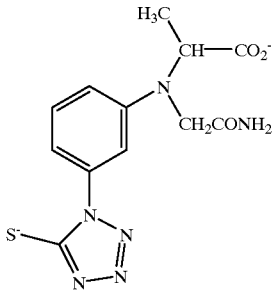
INV 35
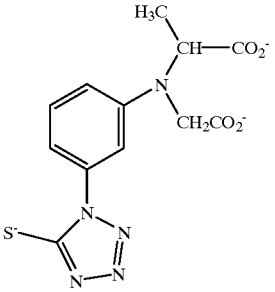

-continued

INV 36

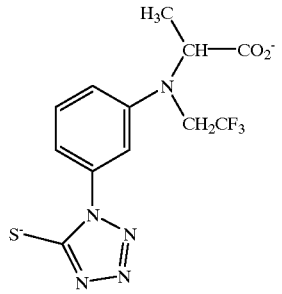

In the above formulae, counterion(s) required to balance the net charge of a compound are not shown as any counterion can be utilized. Common counterions that can be used include sodium, potassium, triethylammonium ($TEA^+$), tetramethylguanidinium ($TMG^+$), diisopropylammonium ($DIPA^+$), and tetrabutylammonium ($TBA^+$).

Table D combines electrochemical and laser flash photolysis data for the XY moiety contained in selected fragmentable electron donating sensitizers according to the formula $$A—(XY)_k \text{ or } (A)_k—XY \qquad Z—(XY)_k \text{ or } (Z)_k—XY$$

Specifically, this Table contains data for $E_1$, the oxidation potential of the parent fragmentable electron donating moiety X-Y; $k_{fr}$, the fragmentation rate of the oxidized X-Y (including $X\text{-}Y^{\bullet+}$); and $E_2$, the oxidation potential of the radical $X^{\bullet}$. In Table D, these characteristic properties of the moiety XY are reported for the model compound where A or Z has been replaced by a hydrogen atom.

$$A—(XY)_k \text{ or } (A)_k—XY \qquad Z—(XY)_k \text{ or } (Z)_k—XY$$

In the actual compounds, these characteristic properties may vary slightly from the values for the model compounds but will not be greatly perturbed. The data in Table D illustrate compounds useful in this invention that are fragmentable two-electron donating sensitizers and meet all the three criteria set forth above.

TABLE D

| Compound | $E_1$ (V) for XY moiety | $k_{fr}$ ($s^{-1}$) for XY moiety | $E_2$ (V) for XY moiety |
|---|---|---|---|
| Inv 3 | 0.58 | $1.7 \times 10^7$ | ~−0.85 |
| Inv 7 | 0.54 | $>2.0 \times 10^7$ | <−0.9 |
| Inv 13 | 0.64 | $5.3 \times 10^5$ | −0.81 |
| Inv 16 | 0.65 | $1.2 \times 10^5$ | <−0.9 |
| Inv 29 | 0.49 | $>10^7$ | <−0.9 |

Some comparative compounds similar to the general formulae given above are also listed below. The XY component in the comparative compound COMP 1 is present as an ethyl ester, and as such, does not fragment, and thereby fails to meet criteria two and three of the invention. Likewise, the XY component in the comparative compounds COMP 2 and COMP 3do not contain a fragmentable group as defined above, and thereby fails to meet criteria two and three of the invention.

COMP 1

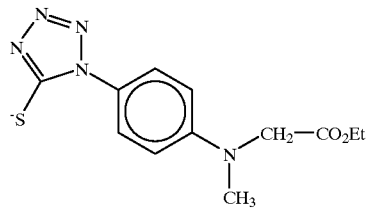

COMP 2

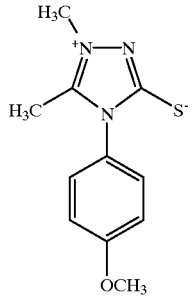

COMP 3

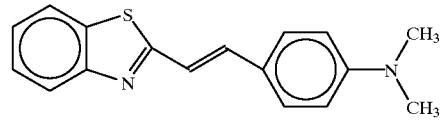

In the above formulae, counterion(s) required to balance the net charge of the comparison compounds are not shown as any counterion can be utilized. Common cationic counterions that can be used include sodium, potassium, triethylammonium ($TEA^+$), tetramethylguanidinium ($TMG^+$), diisopropylammonium ($DIPA^+$), and tetrabutylammonium ($TBA^+$). Common anionic counterions include halogen ions (e.g., chlorine, bromide, iodide, etc.), p-toluene sulfonate, p-chlorobenzene sulfonate, methane sulfonate, tetrafluoroborate ion, perchlorate ion, methylsulfate ion and ethylsulfate ion.

The fragmentable electron donors useful in this invention are vastly different from the silver halide adsorptive (one)-electron donors described in U.S. Pat. No. 4,607,006. The electron donating moieties described therein, for example phenothiazine, phenoxazine, carbazole, dibenzophenothiazine, ferrocene, tris(2,2'-bipyridyl) ruthenium, or a triarylamine, are well known for forming extremely stable, i.e., non-fragmentable, radical cations as noted in the following references J. Heterocyclic Chem., vol. 12, 1975, pp 397–399, J. Org. Chem., vol 42, 1977, pp 983–988, "The Encyclopedia of Electrochemistry of the Elements", Vol XIII, pp 25–33, A. J. Bard Editor, published by Marcel Dekker Inc., Advances in Physical Organic Chemistry, vol 20. pp 55–180, V. Gold Editor, 1984, published by Academic Press, NY. Also, the electron donating adsorptive compounds of U.S. Pat. No. 4,607,006 donate only one electron per molecule upon oxidation. In a preferred embodiment of the present invention, the fragmentable electron donors are capable of donating two electrons.

These fragmentable electron donors of the present invention also differ from other known photographically active compounds such as R-typing agents, nucleators, and stabilizers. Known R-typing agents, such as Sn complexes, thiourea dioxide, borohydride, ascorbic acid, and amine boranes are very strong reducing agents. These agents typically undergo multi-electron oxidations but have oxidation potentials more negative than 0 V vs SCE. For example the oxidation potential for $SnCl_2$ is reported in CRC Handbook of Chemistry and Physics, 55th edition, CRC Press Inc., Cleveland Ohio 1975, pp D122 to be ~−0.10 V and that for borohydride is reported in J. Electrochem. Soc., 1992, vol. 139, pp 2212–2217 to be −0.48 V vs SCE. These redox characteristics allow for an uncontrolled reduction of silver halide when added to silver halide emulsions, and thus the obtained sensitivity improvements are very often accompanied by undesirable levels of fog. Conventional nucleator compounds such as hydrazines and hydrazides differ from the fragmentable electron donors described herein in that nucleators are usually added to photographic emulsions in an inactive form. Nucleators are transformed into photographically active compounds only when activated in a strongly basic solution, such as a developer solution, wherein the nucleator compound undergoes a deprotonation or hydrolysis reaction to afford a strong reducing agent. In further contrast to the fragmentable electron donors, the oxidation of traditional R-typing agents and nucleator compounds is generally accompanied by a deprotonation reaction or a hydroylsis reaction, as opposed to a bond cleavage reaction.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A–113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image.

Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (mm). The tabular grains can be of any thickness compatible with achieving an aim average aspect ratio and/or average tabularity of the tabular grain emulsion. Preferably the tabular grains satisfying projected area requirements are those having thicknesses of <0.3 mm, thin (<0.2 mm) tabular grains being specifically preferred and ultrathin (<0.07 mm) tabular grains being contemplated for maximum tabular grain performance enhancements. When the native blue absorption of iodohalide tabular grains is relied upon for blue speed, thicker tabular grains, typically up to 0.5 mm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element of can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The fragmentable electron donating sensitizer compounds of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The compounds are generally used together with conventional sensitizing dye, and can be added before, during or after the addition of the conventional sensitizing dye.

The amount of fragmentable electron donating compound which is employed in this invention may range from as little as $1\times10^{-8}$ to as much as about $2\times10^{-3}$ mole per mole of silver in an emulsion layer. More preferably the concentration of the compounds is from about $5\times10^{-7}$ to about $2\times10^{-4}$ mole per mole of silver in an emulsion layer. Where the oxidation potential $E_1$ for the XY group of the fragmentable two-electron donating sensitizer is a relatively low potential, it is more active, and relatively less agent need be employed. Conversely, where the oxidation potential for the XY group of the fragmentable two-electron donating sensitizer is relatively high, a larger amount thereof, per mole of silver, is employed. For fragmentable one-electron donating sensitizers relatively larger amounts per mole of silver are also employed.

Conventional spectral sensitizing dyes can be used in combination with the fragmentable electron donor of this invention. Preferred sensitizing dyes that can be used are cyanine dyes, complex cyanine dyes, merocyanine dyes, complex merocyanine dyes, styryl dyes, and hemicyanine dyes. Preferably, the conventional spectral sensitizing dye is a compound of formulae VIII–XII set forth above. The ratio of conventional spectral sensitizing dye to the fragmentable electron donating sensitizing agent of the present invention, which may be determined through an ordinary emulsion test, is typically from about 99.99:0.01 to about 90:10 by mol.

Various compounds may be added to the photographic material of the present invention for the purpose of lowering the fogging of the material during manufacture, storage, or processing. Typical antifoggants are discussed in Section VI of *Research Disclosure I*, for example tetraazaindenes, mercaptotetrazoles, polyhydroxybenzenes, hydroxyaminobenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitvity. Examples of hydroxybenzene compounds are:

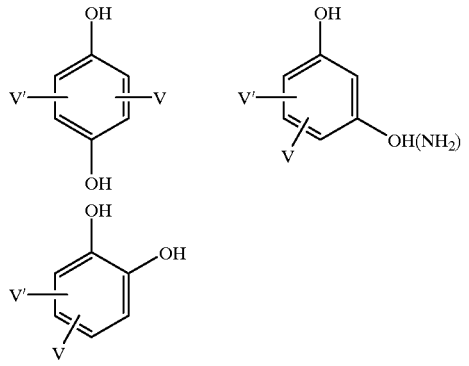

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, —$CH_2CH_2COOH$, —$CH_3$, —$CH_2CH_3$, —$C(CH_3)_3$, —$OCH_3$, —CHO, —$SO_3K$, —$SO_3Na$, —$SO_3H$, —$SCH_3$, or -phenyl.

Especially preferred hydroxybenzene compounds follow:

HB1

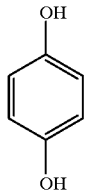

HB2

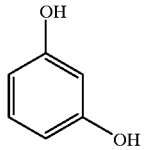

HB3

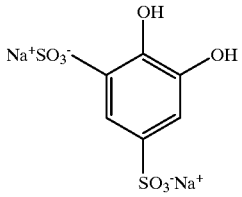

HB4

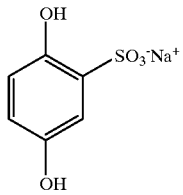

HB5

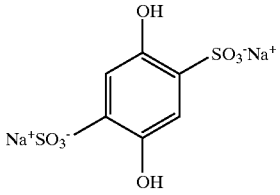

HB6

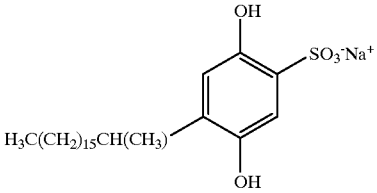

HB7

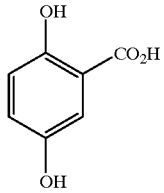

-continued

HB8

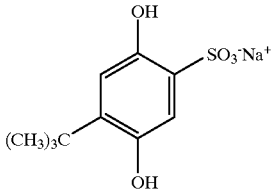

HB9

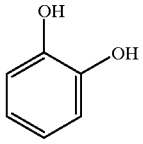

HB10

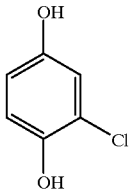

HB11

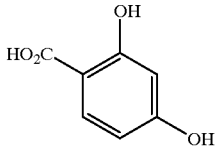

HB12

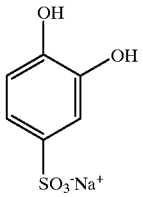

HB13

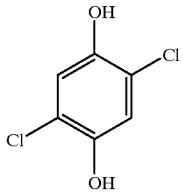

HB14

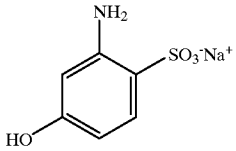

HB15

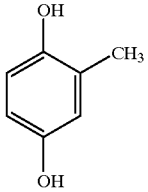

Hydroxybenzene compounds may be added to the emulsion layers or any other layer constituting the photographic material of the present invention. The preferred amount added is from $1\times10^{-3}$ to $1\times10^{-1}$ mol, and more preferred is $1\times10^{-3}$ to $2\times10^{-2}$ mol, per mol of silver halide.

Laser Flash Photolysis Method (a) Oxidation Potential of Radical X•

The laser flash photolysis measurements were performed using a nanosecond pulsed excimer (Questek model 2620, 308 nm, ca. 20 ns, ca. 100 mJ) pumped dye laser (Lambda Physik model FL 3002). The laser dye was DPS (commercially available from Exciton Co.) in p-dioxane (410 nm, ca. 20 ns, ca. 10 mJ). The analyzing light source was a pulsed 150W xenon arc lamp (Osram XBO 150/W). The arc lamp power supply was a PRA model 302 and the pulser was a PRA model M-306. The pulser increased the light output by ca. 100 fold, for a time period of ca. 2–3 ms. The analyzing light was focussed through a small aperture (ca. 1.5 mm) in a cell holder designed to hold 1 $cm^2$ cuvettes. The laser and analyzing beams irradiated the cell from opposite directions and crossed at a narrow angle (ca. 15°). After leaving the cell, the analyzing light was collimated and focussed onto the slit (1 mm, 4 nm bandpass) of an ISA H-20 monochromator. The light was detected using 5 dynodes of a Hamamatsu model R446 photomultiplier. The output of the photomultiplier tube was terminated into 50 ohm, and captured using a Tektronix DSA-602 digital oscilloscope. The entire experiment is controlled from a personal computer.

The experiments were performed either in acetonitrile, or a mixture of 80% acetonitrile and 20% water. The first singlet excited state of a cyanoanthracene (A), which acted as the electron acceptor, was produced using the nanosecond laser pulse at 410 nm. Quenching of this excited state by electron transfer from the relatively high oxidation potential donor biphenyl (B), resulted in efficient formation of separated, "free", radical ions in solution, $A^{\bullet-}+B^{\bullet+}$. Secondary electron transfer then occurred between $B^{\bullet+}$ and the lower oxidation potential electron donor X-Y, to generate $X\text{-}Y^{\bullet+}$ in high yield. For the investigations of the oxidation potentials of the radicals $X^{\bullet}$, typically the cyanoanthrancene concentration was ca. $2\times10^{-5}$ M to $10^{-4}$ M, the biphenyl concentration was ca. 0.1 M. The concentration of the X-Y donor was ca. $10^{-3}$ M. The rates of the electron transfer reactions are determined by the concentrations of the substrates. The concentrations used ensured that the $A^{\bullet-}$ and the $X\text{-}Y^{\bullet+}$ were generated within 100 ns of the laser pulse. The radical ions could be observed directly by means of their visible absorption spectra. The kinetics of the photogenerated radical ions were monitored by observation of the changes in optical density at the appropriate wavelengths.

The reduction potential ($E_{red}$) of 9,10-dicyanoanthracene (DCA) is −0.91 V. In a typical experiment, DCA is excited and the initial photoinduced electron transfer from the biphenyl (B) to the DCA forms a $DCA^{\bullet-}$, which is observed at its characteristic absorption maximum ($\lambda_{obs}$=705 nm), within ca. 20 ns of the laser pulse. Rapid secondary electron transfer occurs from X-Y to $B^{\bullet+}$ to generate $X\text{-}Y^{\bullet+}$, which fragments to give $X^{\bullet}$. A growth in absorption is then observed at 705 nm with a time constant of ca. 1 microsecond, due to reduction of a second DCA by the $X^{\bullet}$. The absorption signal with the microsecond growth time is equal to the size of the absorption signal formed within 20 ns. If reduction of two DCA was observed in such an experiment, this indicates that the oxidation potential of the $X^{\bullet}$ is more negative than −0.9 V.

If the oxidation potential of $X^{\bullet}$ is not sufficiently negative to reduce DCA, an estimate of its oxidation potential was obtained by using other cyanoanthracenes as acceptors. Experiments were performed in an identical manner to that described above except that 2,9,10-tricyanoanthracene (TriCA, $E_{red}$ −0.67 V, $\lambda_{obs}$=710 nm) or tetracyanoanthracene (TCA, $E_{red}$ −0.44 V, $\lambda_{obs}$=715 nm) were used as the electron acceptors. The oxidation potential of the $X^{\bullet}$ was taken to be more negative than −0.7 if reduction of two TriCA was observed, and more negative than −0.5 V if reduction of two TCA was observed. Occasionally the size of the signal from the second reduced acceptor was smaller than that of the first. This was taken to indicate that electron transfer from the $X^{\bullet}$ to the acceptor was barely exothermic, i.e. the oxidation potential of the radical was essentially the same as the reduction potential of the acceptor.

To estimate the oxidation potentials of $X^{\bullet}$ with values less negative than −0.5 V, i.e. not low enough to reduce even tetracyanoanthracene, a slightly different approach was used. In the presence of low concentrations of an additional acceptor, Q, that has a less negative reduction potential than the primary acceptor, A (DCA, for example), secondary electron transfer from $A^{\bullet-}$ to Q will take place. If the reduction potential of Q is also less negative than the oxidation potential of the $X^{\bullet}$, then Q will also be reduced by the radical, and the magnitude of the $Q^{\bullet-}$ absorption signal will be doubled. In this case, both the first and the second electron transfer reactions are diffusion controlled and occur at the same rate. Consequently, the second reduction cannot be time resolved from the first. Therefore, to determine whether two electron reduction actually takes place, the $Q^{\bullet-}$ signal size must be compared with an analogous system for which it is known that reduction of only a single Q occurs. For example, a reactive $X\text{-}Y^{\bullet+}$ which might give a reducing $X^{\bullet}$ can be compared with a nonreactive $X\text{-}Y^{\bullet+}$. Useful secondary electron acceptors (Q) that have been used are chlorobenzoquinone ($E_{red}$ −0.34 V, $\lambda_{obs}$=450 nm), 2,5-dichlorobenzoquinone ($E_{red}$ −0.18 V, $\lambda_{obs}$=455 nm) and 2,3,5,6-tetrachlorobenzoquinone ($E_{red}$ 0.00 V, $\lambda_{obs}$=460 nm).

(b) Fragmentation Rate Constant Determination

The laser flash photolysis technique was also used to determine fragmentation rate constants for examples of the oxidized donors X-Y. The radical cations of the X-Y donors absorb in the visible region of the spectrum. Spectra of related compounds can be found in "Electron Absorption Spectra of Radical Ions" by T. Shida, Elsevier, N.Y., 1988. These absorptions were used to determine the kinetics of the fragmentation reactions of the radical cations of the X-Y. Excitation of 9,10-dicyanoanthracene (DCA) in the presence of biphenyl and the X-Y donor, as described above, results in the formation of the $DCA^{\bullet-}$ and the $X\text{-}Y^{\bullet+}$. By using a concentration of X-Y of ca. $10^{-2}$ M, the $X\text{-}Y^{\bullet+}$ can be formed within ca. 20 ns of the laser pulse. With the monitoring wavelength set within an absorption band of the $X\text{-}Y^{\bullet+}$, a decay in absorbance as a function of time is observed due to the fragmentation reaction. The monitoring wavelengths used were somewhat different for the different donors, but were mostly around 470–530 nm. In general the $DCA^{\bullet-}$ also absorbed at the monitoring wavelengths, however, the signal due to the radical anion was generally much weaker than that due to the radical cation, and on the timescale of the experiment the $A^{\bullet-}$ did not decay, and so did not contribute to the observed kinetics. As the $X\text{-}Y^{\bullet+}$ decayed, the radical $X^{\bullet}$ was formed, which in most cases reacted with the cyanoanthracene to form a second $A^{\bullet-}$. To make sure that this "grow-in" of absorbance due to $A^{\bullet-}$ did not interfere with the time-resolved decay measurements, the concentration of the cyanoanthracene was maintained below ca. $2\times10^{-5}$ M. At this concentration the second reduction reaction occurred on a much slower timescale than the $X\text{-}Y^{\bullet+}$ decay. Alternatively, when the decay rate of the $X\text{-}Y^{\bullet+}$ was less than $10^6\ s^{-1}$, the solutions were purged with oxygen. Under these conditions the $DCA^{\bullet-}$ reacted with the oxygen to form $O_2^{\bullet-}$ within 100 ns, so that its absorbance did not interfere with that of the $X\text{-}Y^{\bullet+}$ on the timescale of its decay.

The experiments measuring the fragmentation rate constants were performed in acetonitrile with the addition of 20% water, so that all of the salts could be easily solubilized. Most experiments were performed at room temperature. In some cases the fragmentation rate was either too fast or too slow to be easily determined at room tempareture. When this happened, the fragmentation rate constants were measured as a function of temperature, and the rate constant at room temperature determined by extrapolation.

Typical examples of the synthesis of inventive compounds follows. Other compounds can also be synthesized by analogy using appropriate selected known starting materials.

SYNTHESIS EXAMPLE 1

The compound INV 1 was prepared according to scheme I as described below:

The amino-phenylmercaptotetrazole (1) (50.0 g, 0.258 mol) was stirred with triethylamine (38.2 mL, 0.274 mol) in 450 mL of dry acetonitrile at rt. After initial dissolution a white precipitate formed. Diethylcarbamyl chloride (35 mL, 0.274 mol) was dissolved in 50 mL acetonitrile and added dropwise. The solution was then heated at reflux for 3 h. The solution was chilled in an ice bath and the precipitated triethylammonium chloride removed by filtration. The solution was concentrated at reduced pressure to yielded an orange oil. This oil was filtered through a 250 g plug of silica gel using 2L of methylene chloride. The filtrate was concentrated at reduced pressure and 50 mL of methanol was added. The methanol solution was cooled to 0° C. and a white solid formed. The solid was collected, washed with ether, and dried to yield 40.3 g of the desired product (2).

SCHEME I

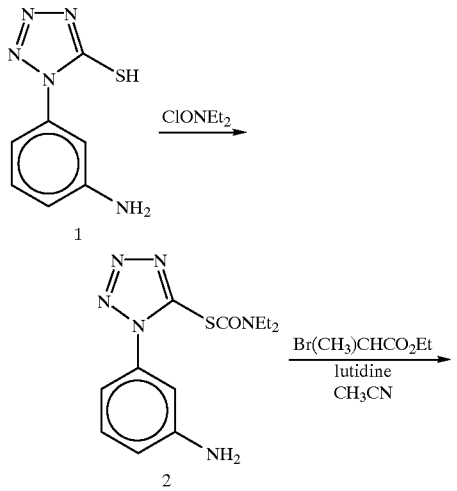

-continued

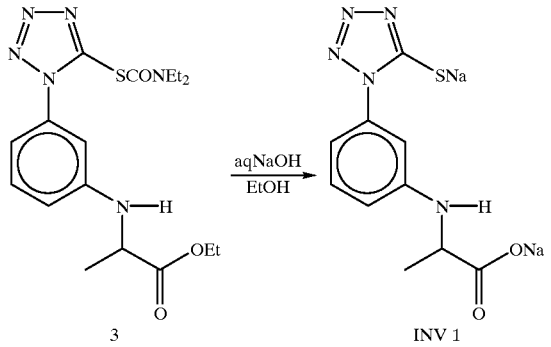

The protected PMT (2) (10 g, 34.2 mmol) was dissolved in 100 mL of dry acetonitrile, followed by 2,6-lutidine (4.4 mL) and ethyl-2-bromoproprionate (4.89 mL, 37.7 mmol). The reaction mixture was heated at reflux for 30 h. TLC analysis indicated the presence of a significant amount of starting material, so an additional 1 mL of bromo-ester and 0.9 mL of lutidine was added and the reaction mixture was refluxed for 7 h. The solution was cooled and concentrated at reduced pressure and ether was added. The resulting precipitate (lutidinium hydrochloride) was removed by filtration, and the filtrate was concentrated at reduced pressure. The resulting oil was charged onto a silica gel column and eluted with heptane:THF 2:1. The desired product (3) was isolated as a lt yellow solid (4.0 g, 30%).

The PMT adduct (3) (0.8 g, 2 mmol) was dissolved in 5 mL of ethanol and 4 mL of 0.1 N NaOH was added. The mixture was heated at 60° C. for 18 h under a $N_2$ atm, and then concentrated at reduced pressure. The resulting white solid was chromatographed on R8 reverse phase silica gel using water:methanol (2:1) as eluant. The desired product INV 1 was isolated as a white solid (0.5 g, 79%).

SYNTHESIS EXAMPLE 2

Thiocarbamylphenylmercaptotetrazole (2) (1.9 g, 6.5 mmol), ethyl bromoacetate (1.1 g, 6.5 mmol) and lutidine (0.7 g, 6.5 mmol) were dissolved in 20 mL of acetonitrile and heated at 75° C. under a nitrogen atmosphere for 18 hours. The solution was then cooled and partitioned between 100 mL of ethyl acetate and 100 mL of brine. The organic layer was separated, dried over anhydrous sodium sulfate and concentrated at reduced pressure. The resulting oil was subjected to chromatography on silica gel using THF:heptane (3:2) as eluant. In this manner 1.4 g (99%) of the desired intermediate was obtained.

The intermediate (0.76 g, 2.0 mmol) was dissolved in 10 mL of ethanol and 4 mL of 0.1N NaOH was added. The reaction mixture was heated at 60° C. for 18 hours under a nitrogen atmosphere. The solvent was removed at reduced pressure and the resulting solid subjected to reverse phase chromatography on R8 silica gel using methanol:water 1:2 as eluant. The desired product (INV 2) was isolated as a white solid (0.4 g, 68%).

SYNTHESIS EXAMPLE 3

Thiocarbamylphenylmercaptotetrazole (2) (2.9 g, 10 mmol), ethyl bromoacetate (3.4 g, 20 mmol) and lutidine (3.0 g, 28 mmol) were heated in a sealed tube at 120° C. for 24 hours. The tube contents were partitioned between 100 mL of ethyl acetate and 100 mL of brine, and the organic layer was separated, dried over anhydrous sodium sulfate and concentrated at reduced pressure. The resulting oil was chromatographed on silica gel using THF:heptane (3:2) as eluant. The chromatographed intermediate (1.5 g, 3.2 mmol) was dissolved in 20 mL of ethanol and 9.6 mL of 0.1 N NaOH was added. The mixture was heated at 60° C. for 18 hours. The solvent was removed at reduced pressure and the residue was subjected to reverse phase chromatography on R8 silica gel using water:methanol (2:1) as eluant to yield INV 3 as a white solid (0.4 g, 33%).

SYNTHESIS EXAMPLE 4

The compounds INV 4 and INV 5 were prepared according to scheme II as described below:

Preparation of Ethyl N-methyl-N-phenylglycinate.

A solution of 16.7 g (100 mmol) of ethyl bromoacetate, 10.7 g (100 mmol) of N-methylaniline, and 12.9 g (100 mmol) of N,N-diisopropylethylamine in 100 mL of acetonitrile was allowed to stand for 24 hr. and then diluted with 200 ml of ether. The amine salt was filtered and the filtrate concentrated, dissolved in 150 ml of $CH_2Cl_2$, washed with water, filtered through a plug of sodium sulfate/silica and distilled: 15.5 g (80%), b.p. 132°/12 mm.

Preparation of Ethyl N-methyl-N-(4-nitrosophenyl) glycinate.

A solution of 15.5 g (80 mmol) of ethyl N-methyl-N-phenylglycinate in 80 g of ice and 40 mL of conc.HCl was stirred at 0–5° while a solution of 6 g (87 mmol) of $NaNO_2$ in 40 mL of water was added dropwise over 30 min. After stirring at this temp. for 1 hr, a solution of 27 g (250 mmol) of $Na_2CO_3$ in 150 mL of water was added dropwise with cooling. The green solid was collected, washed with cold water, extracted into $CH_2Cl_2$, passed thorugh silica with $CH_2Cl_2$ to remove an impurity, and the product eluded with 10% ethyl acetate/$CH_2Cl_2$ to give 14.7 g (66 mmol, 83%) mp 55–56° after washing with 10% ethyl acetate/hexane. Anal. $C_{11}H_{14}N_2O_3$ (222): Calcd.: C,59.45; H,6,35; N,12.60. Found: C,59.46; H,6.14; N,12.49. MS(FD) m/z 222. $^1$H NMR($CDCl_3$)δ: 7.8,broad s,2H,ArH; 6.69,d,2H,ArH; 4.22, q,2H,$CH_2$—O; 4.20,s,2H,$CH_2$—N; 3.23,s,3H,$CH_3$—N; 1.27,t,3H,$CH_3$—C.

Preparation of Ethyl N-methyl-N-(4-isothiocyanatophenyl) glycinate.

A solution of 14.7 g (66 mmol) of ethyl N-methyl-N-(4-nitrosophenyl)glycinate in 200 mL of ethyl acetate was reduced (10% Pd/C, 50 psi $H_2$) until uptake was complete, dried 1 hr ($Na_2SO_4$), filtered, concentrated, and dissolved in a solution of 12.5 g (70 mmol) of thiocarbonyldimidazole in 100 mL $CH_2Cl_2$/300 ml toluene. When tlc showed only product (2 hr,Rf 0.6, $CH_2Cl_2$), the solution was washed with 2×100 mL of water, passed throug a silica plug to remove color, and recrystallized from hexane (300 mL) to give 13.6g (54 mmol, 82%) mp 90–91°. Anal. $C_{12}H_{14}N_2O_2S$ (250): Calcd.: C,57.58; H,5.64; N,11.19; S,12.81. Found: C,57.63; H,5.59; N,11.17; S,12.49. MS(FD) m/z250. $^1$H NMR ($CDCl_3$)δ: 7.10,d,2H,ArH; 6.58,d,2H,ArH; 4.18,q,2H, $CH_2$—O; 4.05,s,2H,$CH_2$—N; 3.07,s,3H,$CH_3$—N; 1.25,s, 3H,$CH_3$—C.

Preparation of Ethyl N-Methyl-N-{4-(1H-tetrazol-5-thiol-4-yl)phenyl}glycinate.

A mixture of 6.5 g (100 mmol) of finely ground $NaN_3$, 24 g (96 mmol) of ethyl N-methyl-N-(4-isothiocyanatophenyl) glycinate, and 300 mL of absolute ethanol was stirred at reflux until solution occurred (~30 min) and tlc showed the absence of the isothiocyanate. The solution was concentrated and the residue partitioned between 300 L of water and 100 mL of ethyl acetate. The aqueous layer was washed twice with 75 mL portions of ethyl acetate to remove impurities, concentrated to 150 mL, cooled in ice and acidified with 9 mL (99 mmol) of conc. HCl. The oil that separarated solidified and was collected, washed with water, dissolved in ethyl acetate, filtered through a plug of silica, concentrated to a solid, and washed with 200 mL of 10% ethyl acetate/hexane to give 23.5 g (80 mmol, 83%) of product: mp 134–136°. An analytical sample was prepared by passing an ethyl acetate solution of the ester through silica and washing the resulting solid with 10% ethyl acetate/hexane followed by water: mp 137–138°. Anal. $C_{12}H_{15}N_5O_2S$•1/2$H_2O$ (302): Calcd.: C,47.67; H,5.31; N,23.16; S,10.60. Found: C,47.90; H,5.11; N,22.98; S,10.67. MS(FD) m/e 293. $^1$H NMR($CDCl_3$)δ: 13.8, broad s,1H,SH; 7.64,d,2H, ArH; 6.74,d,2H,ArH; 4.20,q,2H,$CH_2$—O; 4.11,s,2H,$CH_2$—N; 3.12,s,3H,$CH_3$—N; 1.25,t,3H, $CH_3$—C.

Preparation of N-Methyl-N-{4-(1H-tetrazol-5-thiol-4-yl) phenyl}glycine, dipotassium salt (INV 4).

A solution of 11.5 g (175 mmol) of KOH and 23.5 g (80 mmol) of ethyl N-methyl-N-{4-(1H-tetrazol-5-thiol-4-yl) phenyl}glycinate in 200 mL of water was slowly concentrated to an oil at reduced pressure (40° bath). Water was removed by azeotropic distillation using 2×200 mL of acetonitrile leaving 32 g of white solid which was purified by digestion with acetonitrile (2×200 mL) followed by ethanol (2×300 mL) giving 26 g (76 mmol,95%), mp 279°. Anal. $C_{10}H_9K_2N_5O_2S$ (341): Calcd.: C,35.17; H,2.66; N,20.51; S,9.39. Found: C,34.85; H,2.76; N,20.27; S,8.64. MS($ES^+$) m/z 266, ($ES^-$) m/z 264. $^1$H NMR(DMSO-$d_6$)δ: 7.45,d,2H,ArH; 6.54,d,2H,ArH; 3.55,s,2H,$CH_2$—N; 2.93,s, 3H,$CH_3$—N.

Preparation of N-Methyl-N-{4-(1H-1,2,4-triazol-3-thiol-4-yl)phenyl}glycine, dipotassium salt.

A solution of 3.50 g (14 mmol) of ethyl N-methyl-N-(4-isothiocyanatophenyl)glycinate and 0.84 g (14 mmol) of formylhydrazine in 200 mL of ethanol was left for 24 hr, concentrated to a gum, and the product crystallized with toluene: 3.63 g (11.7 mmol, 84%). The white solid was heated 30 min with 1.5 g of KOH in 50 mL of methanol at reflux, concentrated to a solid and purified by stirring 1 hr with 100 mL of ethanol twice to give 3.15 g (9.2 mmol, 81%), mp 268°dec. Anal. $C_{11}H_{10}K_2N_4O_2S$•1/2$H_2O$ (350): Calcd.: C, 37.80; H, 3.17; N, 16.03; S, 9.17. Found: C,37.50; H,3.26; N, 15.78; S, 8.60. MS($ES^+$) m/z 265, ($ES^-$) m/z 263. $^1$H NMR(DMSO-$d_6$)δ: 7.16,d,2H,ArH; 6.50,d,2H,ArH; 3.53,s,2H,$CH_2$—N; 2.91,s,$CH_3$—N.

Preparation of 1-Methyl-1-acetyl-4-{4-(N-methyl-N-carboethoxymethylamino)phenyl}-3-thiosemicarbazide.

A solution of 1.25 g (5.0 mmol) of ethyl N-methyl-N-(4-isothiocyanatophenyl)glycinate and 0.44 g (5.0 mmol) of 1-methyl-1-acetylhydrazine in 40 ml of 1/1 isoproply alcohol/ether was left uncovered so the ether could evaporate over a 24 hr period. The product was collected and washed with isopropyl alcohol to give 1.32 g (3.9 mmol, 78%), mp 162° dec?. Anal. $C_{15}H_{22}N_4O_3S$ (338): Calcd.: C,53.24; H,6.55; N,16.56; S,9.48. Found: C,53.12; H, 6.45; N,17.05; S,8.90. MS(FD) m/z 338. $^1$H NMR(DMSO-d6)δ: 9.76,s,2H,NH; 7.11,d,2H,ArH; 6.58,d,2H,ArH; 4.15,s,2H, CH2—N; 4.05,q,2H,CH2—O; 2.93,s,3H,CH3—N; 1.92,s, 3H,CH3CO; 1.14,t,3H,CH3—C.

Preparation of 1,5-Dimethyl-4-{4-(N-methyl-N-carbethoxymethylamino)phenyl}-1,2,4-triazolium-3-thiolate.

A solution of 2.03 g (6.06 mmol) of 1-methyl-1-acetyl-4-{4-(N-methyl-N-carboethoxymethylamino)phenyl}-3-thiosemicarbazide in 50 ml of butanol was heated at reflux until tlc showed no starting material (Rf 0.3,EtOAc,5 hr).

Solvent was distilled and the residue crystallized with ethyl acetate. The solid (1.2 g) was recrystallized from 25 ml of water to give 0.978 g (3.05 mmol,50%), mp 211°. Anal. $C_{15}H_{20}N_4O_2S$ (320): Calcd.: C,56.23; H,6.29; N,17.49; S,10.01. Found: C,56.30; H,6.20; N,17.93; S,9.61. MS(FD) 320. $^1$H NMR (DMSO-d6):δ 7.08,d,2H,ArH; 6.71,d,2H, ArH; 4.23,s,2H, CH3—N; 4.08,q,2h,CH2—O; 3.68,s,3H, CH3—N$^+$; 3.29,s,3H,CH3—N; 2.23,s,3H,CH3—C═; 1.16, t,3H,CH3—C.

Preparation of 1,5-Dimethyl-4-{4-(N-methyl-N-carboxymethylamino)phenyl}-1,2,4-triazolium-3-thiolate potassium salt(INV 5).

A solution of 181 mg (2.74 mmol) of KOH in 5 ml of water was added to a solution of 878 mg (2.74 mmol) of 1,5-dimethyl-4-{4-(N-methyl-N-carbethoxymethylamino) phenyl}-1,2,4-triazolium-3-thiolate in 25 ml of water and concentrated under vacuum at 50°. Portions of ethanol were added to the oil and distilled until a solid was obtained: 805 mg (2.44 mmol, 89%) mp 302°. Anal. $C_{13}H_{15}KN_4O_2S$ (330): Calcd.: C,47.25; H,4.57; N,16,95; S,9.70. Found: C,47.19; H,4.68; N,17.11; S,9.26. MS(ES−) m/z 127,291, 583. $^1$H NMR(DMSO-$d_6$)δ: 6.95,d,2H,ArH; 6.54,d,2H, ArH; 3.67,s,3H,CH3—N$^+$; 3.48,s,2H,CH2—N; 2.93,s,3H, CH3—N; 2.23,s,3H,CH3—C═.

SYNTHESIS EXAMPLE 5

The compound INV 23 was prepared according to Scheme III. To a stirred solution of 2-methyl benzothiazole (9.73 g, 0.0653 mole) and p- N-methyl,N-(2-ethyl propionato)aminobenzaldehyde (15.35 g, 0.0653 mole) in 45 mL of N,N-dimethylformamide was added at room temperature solid potassium tert-butoxide (7.32 g, 0.0653 mole) all at once. The reaction mixture quickly turns dark brown with a mild exotherm. The reaction mixture was stirred at room temperature for 48 hours, and then poured into 1-L of ice-cold water while stirring with a glass rod. The free carboxylic acid product was precipitated out with glacial acetic acid (3.9 g, 0.0653 mole). It was washed with water to free it from dimethylformamide and was air dried. The product is obtained as yellow solid (yield 25 g). 6.77 g(0.02 mole) of the yellow solid was dissolved in 100 mL of dimethylformamide and treated with sodium hydroxide (0.8 g, 0.02 mole) solution in 100 mL of methanol at room temperature. Methanol was removed with a rotary evaporator while keeping the bath temperature below 40° C. The residual solution which consisted of the sodium salt of INV 23 was diluted with 2 liters of anhydrous ether. The product crystallized out upon triturating with a stainless steel spatula, and the solid was filtered, washed with anhydrous Scheme II

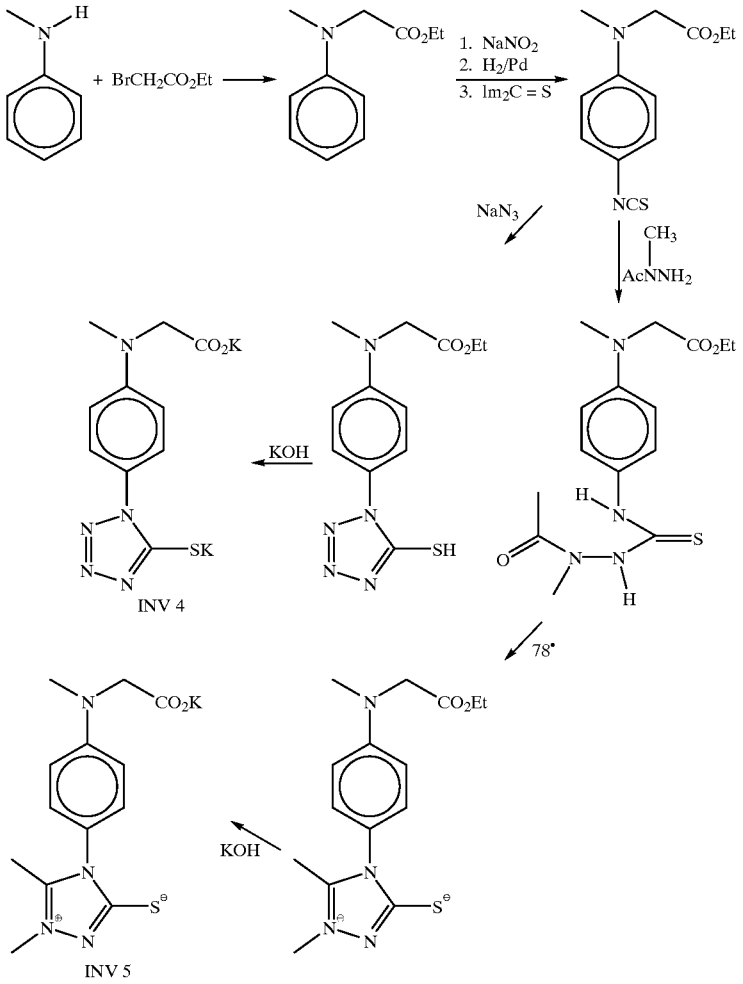

ether (3×100 mL) and pentane (2×100 mL). The desired product, INV 23, was dried in vacuum oven at 30° C. Yield 7 g.

Scheme III

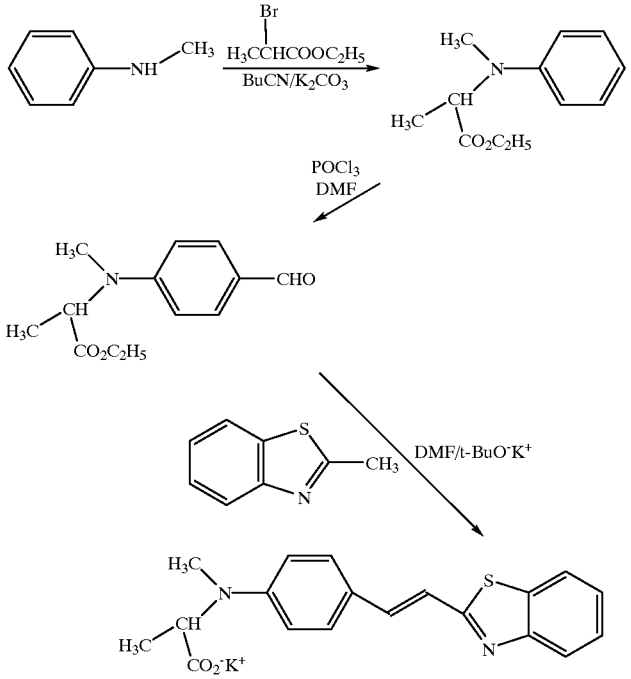

SYNTHESIS EXAMPLE 6

The compound INV 34 was prepared as described below:

The thiocarbamate ester (3) of scheme I, prepared as described in synthesis example 1(1.95 g, 5.0 mmol), bromoacetonitrile (3.0 g, 25 mmol), and sodium bicarbonate (0.42 g, 5 mmol) were added to 5 mL of acetonitrile and the mixture was charged into a sealed tube apparatus. The reaction mixture was heated at 100° C. for 24 hours. The tube contents were then cooled and partitioned between 200 mL of ethyl acetate and 100 mL of brine. The organic layer was separated, dried over anhydrous sodium sulfate, and concentrated at reduced pressure. The resulting yellow oil was charged onto a silica gel column and eluted with ethyl acetate:heptane (1:1). The desired acetonitrile adduct was isolated as a colorless oil (1.5 g, 70%).

The acetonitrile adduct (0.5 g) was dissolved in 5 mL of THF and heated to 50° C. A total of 5 equivalents of 1 N aqueous NaOH was then added over a 5 hour period. The mixture was heated an additional 2 hours at 50° C., and then cooled and concentrtaed at a reduced pressure. The resulting white solid was chromatographed on a medium pressure liquid chromatograph using R8 reverse phase silica gel as the adsorbant and acetonitile:water (1:5) as eluant. The desired amide adduct INV 34 was isolated as a while solid (0.15 g).

SYNTHESIS EXAMPLE 7

The compound INV 35 was prepared as described below:

The compound INV 34 (0.1 g) was dissolved in 2 mL of 1N NaOH and the solution was heated at 50° C. for 18 hours. The reaction mixture was cooled and concentrated at reduced pressure. The resulting white solid was subjected to reverse phase silica gel chromatography (R8) using acetonitrile:water as the eluant (1:4). The desired adduct INV 35 was isolated as a white solid (0.065 g).

SYNTHESIS EXAMPLE 8

The compound INV 36 was prepared as described below:

The thiocarbamate ester (3) of scheme I, prepared as described in synthesis example 1(1.95 g, 5.0 mmol), trifluoroethyl triflate (10 g, 43 mmol ) and 2 mL of diisopropylethylamine were added to 10 mL of acetonitrile and the mixture was heated at reflux for 24 hours. The reaction mixture was cooled, and then partitioned between 200 mL ethyl acetate and 100 mL brine. The organic layer was separated, dried over anhydrous sodium sulfate and concentarted at reduced pressure. The resulting brown oil was chromatographed on silica gel using heptane: ethyl acetate (2:1) as the eluant. The unexpected adduct (4) was obtained in 20% yield.

4

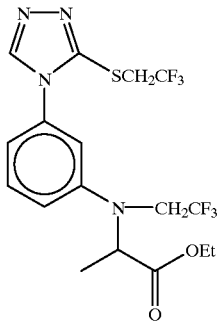

Treatment of the adduct (4) with 3 equivalents of 1 N NaOH at 50° C. for 24 hours, followed by concentration at reduced pressure provided the desired adduct INV 36. This material was used without further purification.

The following examples illustrate the beneficial use of fragmentable electron donors in silver halide emulsions.

EXAMPLE 1

An AgBrI tabular silver halide emulsion (Emulsion T-1) was prepared containing 4.05% total I distributed such that the central portion of the emulsion grains contained 1.5% I and the perimeter area contained substantially higher I as described by Chang et. al., U.S. Pat. No. 5,314,793. The emulsion grains had an average thickness of 0.103 $\mu$m and average circular diameter of 1.25 $\mu$m. Emulsion T-1 was precipitated using deionized gelatin. The emulsion was sulfur sensitized by adding 1,3-dicarboxymethyl-1,3-dimethyl-2-thiourea at 40° C.; the temperature was then raised to 60° C. at a rate of 5° C./3 min and the emulsions held for 20 min before cooling to 40° C. The amounts of the sulfur sensitizing compound used was $8.5\times10^{-6}$ mole/mole Ag. The chemically sensitized emulsion was then used to prepare the experimental coating variations indicated in Table I.

All of these experimental coating variations contained the hydroxybenzene, 2,4-disulfocatechol (HB3) at a concentration of 13 mmole/mole Ag, added to the melt before any further addenda. The blue spectral sensitizing dye D-I was added to the emulsion from a methanol solution at a level corresponding to 0.91×10–3 mole per mole of silver. The fragmentable electron donating sensitizer (FED) compound INV 1–6 were dissolved in methanol solution and added to the emulsion at the relative concentrations indicated in Table I. At the time of FED sensitizer addition, the emulsion melts had a VAg of 85–90 mV and a pH of 6.0. Additional water, gelatin, and surfactant were then added to the emulsion melts to give a final emulsion melt that contained 216 grams of gel per mole of silver. These emulsion melts were coated onto an acetate film base at 1.61 g/m$^2$ of Ag with gelatin at 3.22 g/m$^2$. The coatings were prepared with a protective overcoat which contained gelatin at 1.08 g/m$^2$, coating surfactants, and a bisvinylsulfonylmethyl ether as a gelatin hardening agent.

D-I

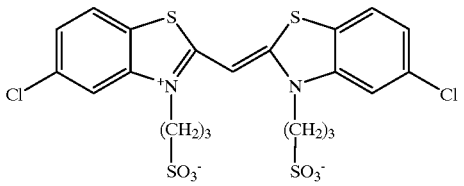

For photographic evaluation, each of the coating strips was exposed for 0.1 sec to a 365 nm emission line of a Hg lamp filtered through a Kodak Wratten filter number 18A and a step wedge ranging in density from 0 to 4 density units in 0.2 density steps. The exposed film were developed for 6 min in Kodak Rapid X-ray Developer (KRX). $S_{365}$,relative sensitivity at 365 nm, was evaluated at a density of 0.15 units above fog. Relative sensitivity was set equal to 100 for the control emulsion coating with no fragmentable electron donating sensitizer agent or conventional spectral sensitizer added (test no. 1).

TABLE I

Speed and fog results for combinations of FED on Emulsion T-1

| Test No. | Type of Sensitizing Dye | Amount of Sensitizing Dye added (mmol/mol Ag) | Type of FED | Amount of FED added (mmol/mol Ag) | Photographic Sensitivity $S_{365}$ | Fog | Remarks |
|---|---|---|---|---|---|---|---|
| 1 | none | | control | 0 | 100 | 0.03 | control |
| 2 | D-I | 0.91 | none | 0 | 95 | 0.03 | comparison |
| 3 | D-I | 0.91 | INV 5 | 0.055 | 154 | 0.03 | invention |
| 4 | D-I | 0.91 | INV 6 | 0.055 | 115 | 0.03 | invention |
| 5 | D-I | 0.91 | INV 4 | 0.055 | 145 | 0.03 | invention |
| 6 | D-I | 0.91 | INV 1 | 0.055 | 158 | 0.03 | invention |
| 7 | D-I | 0.91 | INV 2 | 0.055 | 136 | 0.03 | invention |
| 8 | D-I | 0.91 | INV 3 | 0.055 | 129 | 0.03 | invention |

The data in Table I compare the photographic sensitivities for emulsions containing a conventional blue spectral sensitizing dye and various fragmentable electron donating sensitizer compounds. The addition of the conventional sensitizing dye D-I causes some sensitivity decrease for the 365 nm exposure relative to the undyed control (test no. 2) due to desensitization. Improved sensitivity for the 365 nm exposure was shown for the examples which contained mixtures of D-I and a fragmentable electron donating sensitizing agent INV 1–6(test nos. 3–8). The data in Table I show that Inv 1–6 gave sensitivity $S_{365}$ increases relative to the comparison emulsion coating of up to a factor of about 1.6. No increase in fog accompanied these sensitivity increases.

EXAMPLE 2

A pure AgBr tabular silver halide emulsion (Emulsion T-2) was prepared containing emulsion grains with an average thickness of 0.14 $\mu$m and average circular diameter of 3.0 $\mu$m. The emulsion was spectrally sensitized by adding a solution of dyes D-IV and D-V in a 1:4 ratio by weight. The emulsion was then optimally sensitized with sulfur plus gold plus selenium at 40° C.; the temperature was then raised to 65° C. at a rate of 5° C./3 min, and the emulsions held for 10 min before cooling to 40° C. To the emulsion was then added 2 g/Ag mole of the sodium salt of 4-hydroxy-6-methyl-1,3,3a,7-tetraazaindene and 9 mmole/Ag mole of the disodium salt of 3,5-disulfocatechol (HB3). INV 4 was then added to the emulsion from an aqueous solution in the amount indicated in Table II. The emulsion was then coated on clear 7 mil PET support at coverages of 21.7 mg/sq.dm Ag, 32.4 mg/sq.dm gel and 6.5 mg/sq.dm of poly (butylacrylate latex). An overcoat, comprising 7.2 mg/sq.dm of gel and 2.2 wt % of total gel of bis(vinylsulfonylmethyl) ether was then applied to form a film suitable for X-ray use with a calcium tungstate phosphor screen.

For photographic evaluation, each of the coating strips were exposed with a 2850K tungsten source filtered with a Wratten 38 filter to simulate a calcium tungstate phosphor screen exposure and with a step wedge ranging in density from 0 to 4 density units in 0.2 density steps. The exposed strips were processed in a Kodak X-Omat™ processor set for a 90 sec processing cycle. $S_{W38}$, relative sensitivity for this filtered exposure, was evaluated at a density of 0.20 units above fog. Relative sensitivity was set equal to 100 for the control emulsion coating with no fragmentable electron donating sensitizer agent added (test no. 1). The results are summarized in Table II below.

TABLE II

Speed and fog results for combinations of FED on Emulsion T-V

| Test No. | Type of FED added | Amount of INV 4 added ($10^{-5}$ mol/mol Ag) | Photographic Sensitivity $S_{W38}$ | Fog | Remarks |
|---|---|---|---|---|---|
| 1 | control | 0 | 100 | 0.075 | control |
| 2 | INV 4 | 0.38 | 117 | 0.083 | invention |
| 3 | INV 4 | 1.1 | 129 | 0.089 | invention |
| 4 | INV 4 | 3.8 | 148 | 0.108 | invention |

The results show that INV 4 increased the sensitivity of this X-ray emulsion by a factor up to 1.5 with very little increase in fog.

D-IV

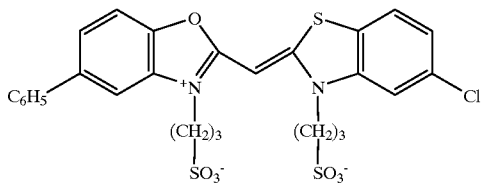

D-V

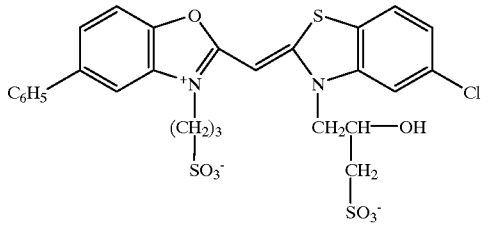

EXAMPLE 3

A series of pure AgBr tabular silver halide emulsions (Emulsion T-3–T-4) were prepared containing emulsion grains with dimensions indicated in Table III. The emulsions were spectrally sensitized by adding a methanol solution of dye D-VI. 300 mg/Ag mole of KI was added to improve the J aggregation of dye D-VI. The emulsions were then optimally sensitized with sulfur plus gold plus selenium at 40° C.; the temperature was then raised to 65° C. at a rate of 5° C./3 min, and the emulsions held for 10 min before cooling to 40° C. To the emulsions was then added 2 g/Ag mole of the sodium salt of 4-hydroxy-6-methyl-1,3,3a,7-tetraazaindene and 9 mmole/Ag mole of the disodium salt of 3,5-disulfocatechol (HB3). INV 4 was then added to the emulsions from an aqueous solution in the amount indicated in Table III. The emulsions were then coated on clear 7 mil PET support at coverages of 21.7 mg/sq.dm Ag, 32.4 mg/sq.dm gel and 6.5 mg/sq.dm of poly(butylacrylate latex). An overcoat, comprising 7.2 mg/sq.dm of gel and 2.2 wt % of total gel of bis(vinylsulfonylmethyl)ether was then applied to form a film suitable for X-ray use.

For photographic evaluation, each of the coating strips were exposed at 546 nm using a mercury vapor lamp filtered with a 550 nm interference filter to isolate the 546 emission line and with a step wedge ranging in density from 0 to 4 density units in 0.2 density steps. This exposure wavelength closely matches the main emission wavelength of gadolinium oxysulfide phosphor screens. The exposed strips were processed in a Kodak X-Omat™ processor set for a 90 sec processing cycle. $S_{546}$, relative sensitivity for this filtered exposure, was evaluated at a density of 0.20 units above fog. For each emulsion variation, relative sensitivity was set equal to 100 for the control coating with no fragmentable electron donating sensitizer agent added (test no. 1, 5, 9). The results are summarized in Table III below.

D-VI

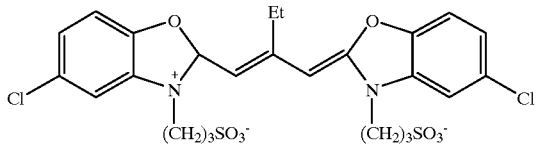

TABLE III

Speed and for results for INV 4 on green dyed emulsions.

| Test No. | Emulsion Size | Amount of INV 4 added ($10^{-5}$ mol/mol Ag) | $S_{546}$ | Fog | Remarks |
|---|---|---|---|---|---|
| 1 | 0.81 μm × 0.115 μm | 0 | 100 | 0.038 | control |
| 2 | 0.81 μm × 0.115 μm | 1.1 | 117 | 0.062 | invention |
| 3 | 0.81 μm × 0.115 μm | 2.3 | 123 | 0.088 | invention |
| 4 | 0.81 μm × 0.115 μm | 4.5 | 129 | 0.133 | invention |
| 5 | 1.2 μm × 0.12 μm | 0 | 100 | 0.034 | control |
| 6 | 1.2 μm × 0.12 μm | 1.1 | 115 | 0.036 | invention |
| 7 | 1.2 μm × 0.12 μm | 2.3 | 117 | 0.043 | invention |
| 8 | 1.2 μm × 0.12 μm | 4.5 | 126 | 0.053 | invention |
| 9 | 1.8 μm × 0.10 μm | 0 | 100 | 0.041 | control |
| 10 | 1.8 μm × 0.10 μm | 1.1 | 123 | 0.061 | invention |
| 11 | 1.8 μm × 0.10 μm | 2.3 | 135 | 0.118 | invention |
| 12 | 1.8 μm × 0.10 μm | 4.5 | 132 | 0.090 | invention |

The data of Table III show that the fragmentable electron donor compound INV 4 significantly increases the sensitivity of each emulsion. These sensitivity increases are accompanied by minor increases in fog. These results demonstrate that INV 4 improves the sensitivity of emulsions that are useful with green emitting gadolinium oxysulfide X-ray screens.

EXAMPLE 4

The sulfur sensitized AgBrI tabular silver halide emulsion T-1 from Example 1 was used to prepare the experimental coating variations described in Table IV. All of these experimental coating variations contained the hydroxybenzene, 2,4-disulfocatechol (HB3) at a concentration of 13 mmole/mole Ag, added to the melt before any further addenda. The blue spectral sensitizing dye D-I was added to the emulsion from a methanol solution at a level corresponding to $0.91\times10^{-3}$ mole per mole of silver. The fragmentable electron donating sensitizer (FED) compound was dissolved in methanol solution and added to the emulsion at the relative concentrations indicated in Table I. At the time of FED sensitizer addition, the emulsion melts had a VAg of 85–90 mV and a pH of 6.0. After 5 min at 40° C., additional water, gelatin, and surfactant were then added to the emulsion melts to give a final emulsion melt that contained 216 grams of gel per mole of silver. These emulsion melts were coated onto an acetate film base at 1.61 g/m$^2$ of Ag with gelatin at 3.22 g/m$^2$. The coatings were prepared with a protective overcoat which contained gelatin at 1.08 g/m$^2$, coating surfactants, and a bisvinylsulfonylmethyl ether as a gelatin hardening agent.

For photographic evaluation, each of the coating strips was exposed for 0.1 sec to a 365 nm emission line of a Hg lamp filtered through a Kodak Wratten filter number 18A and a step wedge ranging in density from 0 to 4 density units in 0.2 density steps. The exposed film strips were developed for 6 min in Kodak Rapid X-ray Developer (KRX). $S_{365}$, relative sensitivity at 365 nm, was evaluated at a density of 0.15 units above fog.

TABLE IV

Speed and fog results for combinations of FED and blue sensitizing dye on Emulsion T-1

| Test No. | Type of Sensitizing Dye | Total amount of Sensitizing Dye and FED added ($10^{-3}$ mol/mol Ag) | Type of FED | Amount of FED in mixture ($10^{-3}$ mol/mol Ag) | Photographic Sensitivity $S_{365}$ | $S_{WR2B}$ | Fog | Remarks |
|---|---|---|---|---|---|---|---|---|
| 1 | D-I | 0.91 | none | 0.000000 | 100 | 100 | 0.02 | control |
| 2 | D-I | 0.91 | Comp 3 | 0.009100 | 107 | 107 | 0.03 | comparison |
| 3 | D-I | 0.91 | Comp 3 | 0.004550 | 105 | 107 | 0.04 | comparison |
| 4 | D-I | 0.91 | INV 23 | 0.000910 | 195 | 200 | 0.05 | invention |
| 5 | D-I | 0.91 | INV 23 | 0.000455 | 186 | 200 | 0.11 | invention |
| 6 | D-I | 0.91 | INV 23 | 0.009100 | 191 | 204 | 0.12 | invention |
| 7 | D-I | 0.91 | INV 23 | 0.018200 | 182 | 195 | 0.18 | invention |
| 8 | D-I | 0.91 | INV 23 | 0.004550 | 174 | 195 | 0.27 | invention |

The data in Table IV compare the photographic sensitivities for the emulsion containing the blue spectral sensitizing dye and the fragmentable electron donating sensitizer compound INV 23. For this exposure, relative sensitivity was set equal to 100 for the control emulsion coating with no fragmentable electron donating sensitizer agent added (test no. 1). Improved sensitivity for the 365 nm exposure was shown for the examples which contained the fragmentable electron donating sensitizing agent (test nos. 2–8). The data in Table I show that INV 23 gave up to a factor of 1.7 to 1.98 sensitivity increase relative to the control. The comparison compound Comp 3 has a chemical structure that is very similar to INV 32, but Comp 3 does not contain an XY moiety as described herein. Comp 3 affords only a very slight increase in emulsion sensitivity.

Additional testing was carried out to determine the response of the coatings to a spectral exposure. Each of the coating strips was exposed for 0.1 sec to a 3000 K color temperature tungsten lamp filtered to give an effective color temperature of 5500 K and further filtered through a Kodak Wratten filter 2B and a step wedge ranging in density from 0 to 4 density units in 0.2 density steps. This filter passes only light of wavelengths longer than 400 nm, thus giving light absorbed mainly by the sensitizing dye. The exposed film strips were developed for 6 min in Kodak Rapid X-ray Developer (KRX). $S_{WR2B}$, relative sensitivity for this Kodak Wratten 2B filter exposure, was evaluated at a density of 0.15 units above fog. For this spectral exposure, the relative sensitivity was set equal to 100 for the control coating with no fragmentable electron donating compound added.

The data of Table IV show that sensitivity advantages were also obtained for spectral exposures of the blue sensitizing dye using the Kodak Wratten 2B filter. The data show that increases relative to the control of a factor of about 2 were obtained for the experimental coatings containing the fragmentable electron donating sensitizer compound INV 23. The comparison compound COMP 3 provided only a very minor sensitivity increase to the silver halide emulsion. Overall, these results show that INV 23 can significantly increase the sensitivity of a silver halide emulsion to both intrinsic and spectral exposures.

EXAMPLE 5

The sulfur sensitized AgBrI tabular emulsion T-1 as described in Example 1 was used to prepare coatings containing the fragmentable electron-donating sensitizer INV-5 or the comparative compound COMP-2 in combination with the blue spectral sensitizing dye D-I as listed in Table X. The sensitizing dye was added to the emulsion at 40° C., followed by INV-5 or COMP-2 and the coatings were prepared as described in Example 1, except that no disulfocatechcol was added to the coating melts.

$S_{365}$, relative sensitivity at 365 nm, was evaluated as described in Example 1. Relative sensitivity for this exposure was set equal to 100 for the control dyed emulsion coating with no fragmentable electron donating sensitizer agent added (test no. 1).

The data in Table V illustrates that INV-5 gave large sensitivity increases, of a factor of greater than 2.0, when added to this blue-dyed tabular emulsion. These sensitivity gains could be obtained with essentially no increase in fog levels. In contrast, the comparison compound COMP 2, which has the same tetrazole ring as INV-5 but lacks the connected fragmentable electron donating moiety described in this invention, gave only small sensitivity increases (a factor of 1.2 or less).

TABLE V

Speed and Fog Results for INV-5 and Comparative Compound with Emulsion T-2

| Test No. | Compound | Amount of Compound added ($10^{-3}$ mol/mol Ag) | Sens. Dye | Amount of Sens. Dye ($10^{-3}$ mol) | Photographic Sensitivity $S_{365}$ | Fog | Remarks |
|---|---|---|---|---|---|---|---|
| 1 | none | 0 | D-I | 0.91 | 100 | 0.04 | control |
| 2 | INV-5 | 0.045 | D-I | 0.91 | 209 | 0.04 | invention |
| 3 | INV-5 | 0.14 | D-I | 0.91 | 224 | 0.06 | invention |

TABLE V-continued

Speed and Fog Results for INV-5 and Comparative Compound with Emulsion T-2

| Test No. | Compound | Amount of Compound added ($10^{-3}$ mol/mol Ag) | Sens. Dye | Amount of Sens. Dye ($10^{-3}$ mol/mol Ag) | Photographic Sensitivity $S_{365}$ | Fog | Remarks |
|---|---|---|---|---|---|---|---|
| 4 | COMP-2 | 0.045 | D-1 | 0.91 | 120 | 0.04 | comparison |
| 5 | COMP-2 | 0.14 | D-I | 0.91 | 112 | 0.04 | comparison |

EXAMPLE 6

The AgBrI tabular silver halide emulsion T-1 as described in Example 1 was optimally chemically and spectrally sensitized by adding NaSCN, $1.07\times10^{-3}$ mole/mole Ag of the blue sensitizing dye D-I, $Na_3Au(S_2O_3)_2 \cdot 2H_2O$, $Na_2S_2O_3 \cdot 5H_2O$, and a benzothiazolium finish modifier and then subjecting the emulsion to a heat cycle to 65° C. The hydroxybenzene compound, 2,4-disulfocatechcol (HB3) at a concentration of $13\times10^{-3}$ mole/mole Ag and the antifoggant and stabilizer tetraazaindene at a concentration of 1.75 gm/mole Ag were added to the emulsion melt after the chemical sensitization procedure. Various fragmentable electron donating sensitizers as listed in Table VI were added to the emulsion after the additions of HB3 and tetraazaindene.

The melts were prepared for coating by adding additional water, deionized gelatin, and coating surfactants. Coatings were prepared by combining the emulsion melts with a melt containing deionized gelatin and an aqueous dispersion of the cyan-forming color coupler CC-1 and coating the resulting mixture on acetate support. The final coatings contained Ag at 0.80 g/m$^2$, coupler at 1.61 g/m$^2$, and gelatin at 3.22 g/m$^2$. The coatings were overcoated with a protective layer containing gelatin at 1.08 g/m$^2$, coating surfactants, and a bisvinylsulfonylmethyl ether as a gelatin hardening agent.

$S_{365}$, relative sensitivity at 365 nm, was evaluated as described in Example 1, except that the exposure time used was 0.01 s. Relative sensitivity for this exposure was set equal to 100 for the control dyed emulsion coating with no deprotonating electron donating sensitizer agent added (test no. 1).

Additional testing was carried out to determine the response of the coatings to a spectral exposure. The dyed coating strips were exposed for 0.01 sec to a 3000 K color temperature tungsten lamp filtered to give an effective color temperature of 5500 K and further filtered through a Kodak Wratten filter number 2B and a step wedge ranging in density from 0 to 4 density units in 0.2 density steps. This filter passes only light of wavelengths longer than 400 nm, thus giving light absorbed mainly by the sensitizing dye. The exposed film strips were developed for 6 min in Kodak Rapid X-ray Developer (KRX). $S_{WR2B}$, relative sensitivity for this Kodak Wratten filter 2B exposure, was evaluated at a density of 0.15 units above fog. The relative sensitivity for this spectral exposure was set equal to 100 for the control dyed coating with no deprotonating electron donating compound added (test no. 1).

The data in Table VI compare the sensitivity increases obtained when INV-1, INV-2, INV-4, or INV-5 were added to the fully sensitized, blue-dyed emulsion T-1. The data in Table VI show that, on this optimally sensitized, blue-dyed tabular emulsion, all of these compounds gave good speed increases for both intrinsic and spectral exposures with only very small fog increases.

TABLE VI

Speed and Fog Results for Inventive Compounds with fully sensitized, blue-dyed emulsion T-1, color format

| Test No. | Compound | Amount of Compound added ($10^{-6}$ mol/mol Ag) | Photographic Sensitivity $S_{365}$ | $S_{WR2B}$ | Fog | Remarks |
|---|---|---|---|---|---|---|
| 1 | none | 0.00 | 100 | 100 | 0.05 | comparison |
| 2 | INV-1 | 14 | 174 | 178 | 0.08 | invention |
| 3 | INV-1 | 45 | 178 | 186 | 0.06 | invention |
| 4 | INV-l | 140 | 166 | 186 | 0.13 | invention |
| 5 | INV-2 | 14 | 138 | 129 | 0.09 | invention |
| 6 | INV-2 | 45 | 148 | 141 | 0.06 | invention |
| 7 | INV-2 | 140 | 151 | 145 | 0.14 | invention |
| 8 | INV-4 | 4.5 | 148 | 141 | 0.08 | invention |
| 9 | INV-4 | 14 | 158 | 151 | 0.06 | invention |
| 10 | INV-4 | 45 | 158 | 155 | 0.10 | invention |
| 11 | INV-5 | 4.5 | 141 | 148 | 0.06 | invention |
| 12 | INV-5 | 14 | 151 | 162 | 0.07 | invention |
| 13 | INV-5 | 45 | 158 | 166 | 0.06 | invention |

CC-1

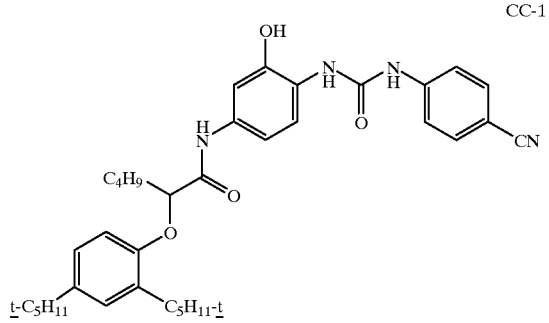

EXAMPLE 7

The AgBrI tabular silver halide emulsion T-1 as described in Example 1 was optimally chemically sensitized by adding NaSCN, carboxymethyl-trimethyl-2-thiourea, bis(1,4,5-trimethyl-1,2,4-triazolium-3-thiolate) gold(I) tetrafluoroborate, and a benzothiazolium finish modifier and then subjecting the emulsion to a heat cycle to 65° C. The antifoggant 2,4-disulfocatechcol (HB3) at a concentration of $13\times10^{-3}$ mole/mole Ag was added to the emulsion melt after the chemical sensitization procedure. The emulsion was then dyed with blue sensitizing dye D-I or green sensitizing dye D-II. The antifoggant and stabilizer tetraazaindene at a concentration of 1.75 gm/mole Ag was then added. Various fragmentable electron donating sensitizing agents as listed in Table VII were subsequently added to the emulsion.

The melts were used to prepare black and white format coatings as described in Example 1. The coating strips obtained were then tested using the 365 nm exposure and the Kodak Wratten 2B exposure as described in Example 6. Development was for 6 min in Kodak Rapid X-ray Developer (KRX). For each exposure, relative sensitivity was set equal to 100 for the control emulsion coating with no fragmentable electron donating sensitizer agent added (test no. 1).

The data in Example Table VII show the sensitivity increases obtained when the FED compounds INV-34, INV-35, or INV-36 were added to the sulfur and gold sensitized emulsion containing a blue or a green-spectral sensitizing dye. At the optimum compound concentrations, speed increases of up to 1.4× could be obtained with only small increases in fog.

TABLE VII

Speed and Fog Results for FED Compounds on a Sulfur and Gold Sensitized Emulsion containing a Blue or a Green Spectral Sensitizing Dye.

| Test No. | Compound | Amount of Compound ($10^{-6}$ mol/molAg) | Type of Sensit-izing Dye | Amount of Sensitizing Dye ($10^{-3}$ mol/molAg) | Photographic Sensitivity $S_{365}$ | $S_{WR2B}$ | Fog | Remarks |
|---|---|---|---|---|---|---|---|---|
| 1 | none | 0 | D-I | 1.0 | 100 | 100 | 0.05 | comparison |
| 2 | INV-34 | 45 | D-I | 1.0 | 141 | 148 | 0.08 | invention |
| 3 | INV-35 | 4.5 | D-I | 1.0 | 115 | 115 | 0.06 | invention |
| 4 | INV-35 | 14 | D-I | 1.0 | 120 | 126 | 0.06 | invention |
| 5 | none | 0 | D-II | 0.9 | 100 | 100 | 0.09 | comparison |
| 6 | INV-34 | 3.2 | D-II | 0.9 | 129 | 123 | 0.10 | invention |
| 7 | INV-34 | 10 | D-II | 0.9 | 120 | 115 | 0.13 | invention |
| 8 | INV-36 | 3.2 | D-II | 0.9 | 107 | 102 | 0.09 | invention |
| 9 | INV-36 | 10 | D-II | 0.9 | 107 | 102 | 0.10 | invention |

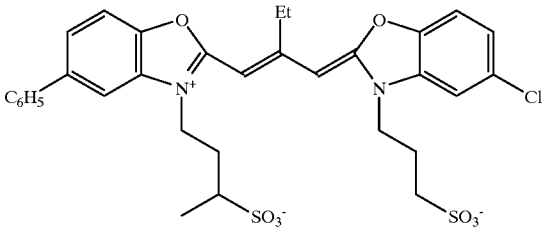

D-II

The invention has been described in detail with particular reference to preferred embodiments, but it will be understood that variations and modifications can be effected within the spirit and scope of the invention.

What is claimed is:

1. A photographic element comprising at least one silver halide emulsion layer in which the silver halide is sensitized with a compound of the formula:

$$\begin{array}{c} A\text{—}(XY)_k \\ \text{or} \\ (A)_k\text{—}XY \end{array} \quad \text{or} \quad \begin{array}{c} Z\text{—}(XY)_k \\ \text{or} \\ (Z)_k\text{—}XY \end{array}$$

wherein A is a silver halide adsorptive group that contains at least one atom of N, S, P, Se, or Te that promotes adsorption to silver halide; Z is a light absorbing group; k is 1 or 2; and XY is a fragmentable electron donor moiety wherein X is an electron donor group and Y is a leaving group other than hydrogen, and wherein:

1) XY has an oxidation potential between 0 and about 1.4 V; and 2) the oxidized form of XY undergoes a bond cleavage reaction to give the radical $X^{\bullet}$ and the leaving fragment Y.

2. A photographic element comprising at least one silver halide emulsion layer in which the silver halide is sensitized with a compound of the formula:

$$\begin{array}{c} A\text{—}(XY)_k \\ \text{or} \\ (A)_k\text{—}XY \end{array} \quad \text{or} \quad \begin{array}{c} Z\text{—}(XY)_k \\ \text{or} \\ (Z)_k\text{—}XY \end{array}$$

wherein A is a silver halide adsorptive group that contains at least one atom of N, S, P, Se, or Te that promotes adsorption to silver halide, and Z is a light absorbing group, k is 1 or 2, and XY is a fragmentable electron donor moiety in which X is an electron donor group and Y is a leaving group other than hydrogen, and wherein:

1) XY has an oxidation potential between 0 and about 1.4 V;

2) the oxidized form of XY undergoes a bond cleavage reaction to give the radical $X^{\bullet}$ and the leaving fragment Y; and 3) the radical $X^{\bullet}$ has an oxidation potential $\leqq -0.7$ V (that is, equal to or more negative than about −0.7 V).

3. A photographic element according to claim 1 or claim 2, wherein A is a silver-ion ligand moiety or a cationic surfactant moiety.

4. A photographic element according to claim 3, wherein A is a silver-ion ligand moiety.

5. A photographic element according to claim 1 or claim 2, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

6. A photographic element according to claim 5, wherein A is selected from sulfur acids and their Se and Te analogs.

7. A photographic element according to claim 6, wherein A is of the formula:

R"—SH and R'"—SH wherein:

R" is an aliphatic, aromatic, or heterocyclic group, which may be substituted with functional groups comprising halogen, oxygen, sulfur or nitrogen atom, and R'" is an aliphatic, aromatic, or heterocyclic group substituted with a $SO_2$ functional group.

8. A photographic element according to claim 7, wherein A is a heterocyclic thiol of the formula:

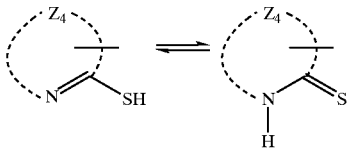

wherein:

$Z_4$ represents the remaining members for completing a preferably 5- or 6-membered ring which may contain one or more additional heteroatoms, such as nitrogen, oxygen, sulfur, selenium or tellurium atom, and is optionally benzo- or naphtho-condensed.

9. A photographic element according to claim 8, wherein the heterocyclic thiol is selected from the group consisting of: mercaptotetrazole, mercaptotriazole, mercaptothiadiazole, mercaptoimidazole, mercaptooxadiazole, mercaptothiazole, mercaptobenzimidazole, mercaptobenzothiazole, mercaptobenzoxazole, mercaptopyrimidine, mercaptotriazine, phenylmercaptotetrazole, 1,2,4-triazolium 3-thiolate, and 4,5,-diphenyl-1,2,4-triazolium-3-thiolate.

10. A photographic element according to claim 5, wherein A is a nitrogen acid of the formula:

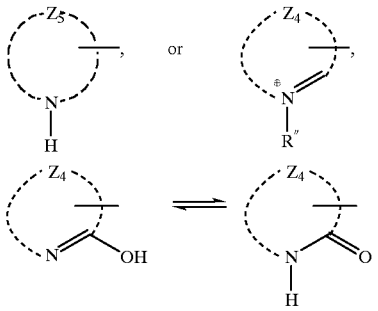

wherein:

$Z_4$ represents the remaining members for completing a ring which may contains one or more additional heteroatoms, and is optionally benzo- or naphtho-condensed, $Z_5$ represents the remaining members for completing a ring which contains at least one additional heteroatom and is optionally benzo or naptho-condensed, and R" is an aliphatic, aromatic, or heterocyclic group, and may be substituted with functional groups comprising a halogen, oxygen, sulfur or nitrogen atom.

11. A photographic element according to claim 10, wherein the nitrogen heterocycle is selected from the group consisting of heterocyclic nitrogen acids including azoles, purines, hydroxy azaindenes, and imides.

12. A photographic element according to claim 10, wherein the nitrogen acid comprises a uracil, tetrazole, benzotriazole, benzothiazole, benzoxazole, adenine, rhodanine, or substituted 1,3,3a,7-tetraazaindene moiety.

13. A photographic element according to claim 5, wherein A is a cyclic and acyclic thioether or a Se or Te analog thereof.

14. A photographic element according to claim 13, wherein A is selected from the group consisting of:

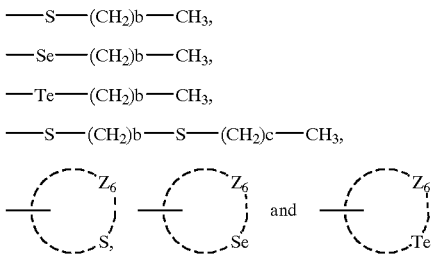

wherein:

b=1–30, c=1–30 with the proviso that b+c is ≦ to 30, and $Z_6$ represents the remaining members for completing a 5- to 18-membered ring which optionally may contain an additional S, Se, or Te atom.

15. A photographic element according to claim 14, wherein A is $—SCH_2CH_3$, 1,10-dithia-4,7,13,16-tetraoxacyclooctadecane, $—TeCH_2CH_3$, $—SeCH_2CH_3$, $—SCH_2CH_2SCH_2CH_3$, or thiomorpholine.

16. A photographic element according to claim 5, wherein A is a phosphine.

17. A photographic element according to claim 16, wherein A is a compound of the formula:

$$(R'')_2—P$$

wherein each R" is independently an aliphatic, aromatic, or heterocyclic group, and may be substituted with functional groups comprising halogen, oxygen, sulfur or nitrogen atoms.

18. A photographic element according to claim 16, wherein A is $P(CH_2CH_2CN)_2$, or m-sulfophenylmethylphosphine.

19. A photographic element according to claim 5, wherein A is a thionamide, thiosemicarbazide, telluroureas or selenourea of the formula:

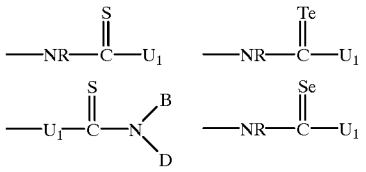

wherein:

$U_1$ represents $—NH_2$, —NHR", $—NR"_2$, —NH—NHR", —SR", OR";

B and D represent R" or, may be linked together to form, the remaining members of a 5- or 6-membered ring; and R" represents an aliphatic, aromatic or heterocyclic group, and R is hydrogen or alkyl or an aryl group.

20. A photographic element according to claim 19, wherein A is a thionamide selected from the group consisting of N,N'-tetraalkylthiourea, N-hydroxyethyl benzthiazoline-2-one, and phenyldimethyldithiocarbamate, and N-substituted thiazoline-2-one.

21. A photographic element according to claim 5, wherein A is a carbon acid of the formula:

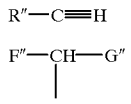

wherein:

R" is an aliphatic, aromatic, or heterocyclic group, and may be substituted with functional groups based on halogen, oxygen, sulfur or nitrogen atoms and where F" and G" are independently selected from —$CO_2R$", —COR", CHO, CN, $SO_2R$", SOR", $NO_2$, such that the pKa of the CH is between 5 and 14.

22. A photographic element according to claim 3, wherein A is a cationic surfactant moiety.

23. A photographic element according to claim 22, wherein A is dimethyldodecylsulfonium, tetradecyltrimethylammonium, N-dodecylnicotinic acid betaine, and decamethylenepyridinium ion.

24. A photographic element according to claim 1 or claim 2, wherein A is selected from the group consisting of: an alkyl mercaptan, a cyclic or acyclic thioether group, benzothiazole, tetraazaindene, benzotriazole, tetralkylthiourea, and mercapto-substituted hetero ring compounds.

25. A photographic element according to claim 1 or claim 2, wherein A has the structure:

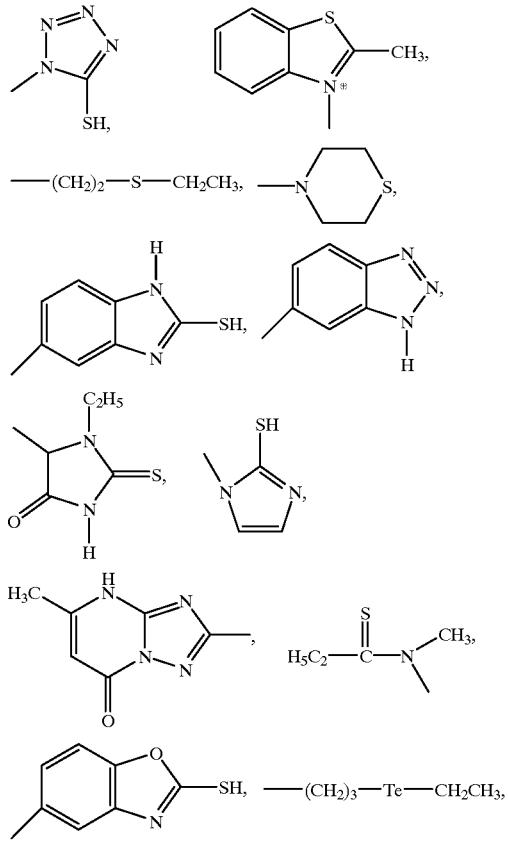

-continued

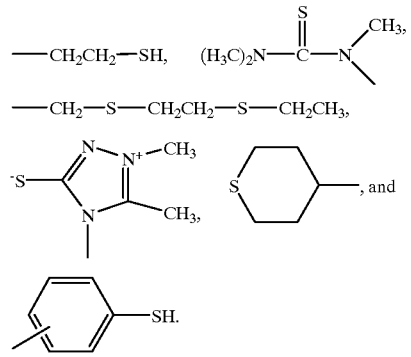

26. A photographic element according to claim 1 or claim 2, wherein Z is a spectral sensitizing agent.

27. A photographic element according to claim 26 wherein the spectral sensitizing agent is a cyanine, merocyanine, styryl, hemicyanine, or complex cyanine dye.

28. A photographic element according to claim 27, wherein Z is represented by the formulae (VIII)–(XII) below:

(VIII)

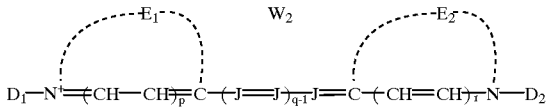

wherein:

$E_1$ and $E_2$ represent the atoms necessary to form a substituted or unsubstituted hetero ring and may be the same or different, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl, and $W_2$ is a counterion as necessary to balance the charge;

(IX)

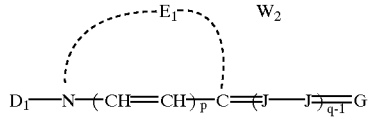

wherein $E_1$, $D_1$, J, p, q and $W_2$ are as defined above for formula (VIII) and G represents

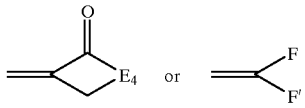

wherein $E_4$ represents the atoms necessary to complete a substituted or unsubstituted heterocyclic nucleus, and F and F' each independently represents a cyano group, an ester group, an acyl group, a carbamoyl group or an alkylsulfonyl group;

(X)

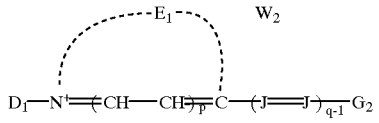

wherein $D_1$, $E_1$, J, p, q and $W_2$ are as defined above for formula (VIII), and $G_2$ represents a substituted or unsubstituted amino group or a substituted or unsubstituted aryl group;

(XI)

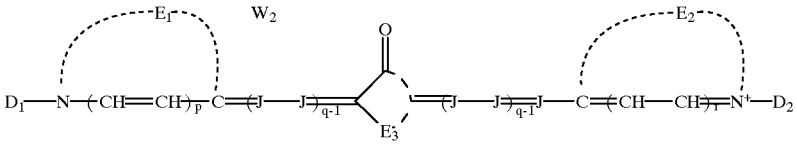

wherein $D_1$, $E_1$, $D_2$, $E_2$, J, p, q, r and $W_2$ are as defined for formula (VIII) above, and $E_3$ is defined the same as $E_4$ for formula (IX) above;

(XII)

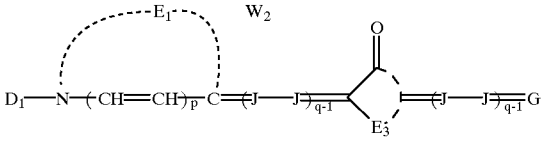

wherein $D_1$, $E_1$, J, G, p, q, r and $W_2$ are as defined above for formula (VIII) above and $E_3$ is as defined for formula (XI) above.

29. A photographic element according to claim 1 or claim 2, wherein X is of formula (I):

(I)

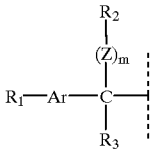

wherein:

m is 0 or 1;

Z is O, S, Se or Te;

Ar is an aryl group or a heterocyclic group;

$R_1$ is R, carboxyl, amide, sulfonamide, halogen, $NR_2$, $(OH)_n$, $(OR')_n$ or $(SR)_n$; where R' is alkyl or substituted alkyl;

n is 1–3;

$R_2$ is R or Ar';

$R_3$ is R or Ar';

$R_2$ and $R_3$ together can form 5- to 8-membered ring;

$R_2$ and Ar can be linked to form 5- to 8-membered ring;

$R_3$ and Ar can be linked to form 5- to 8-membered ring;

Ar' is an aryl group or a heterocyclic group; and

R is a hydrogen atom or an unsubstituted or substituted alkyl group.

30. A photographic element according to claim 29, wherein X is selected from the group consisting of:

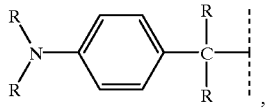

-continued

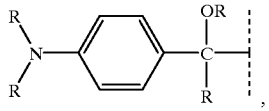

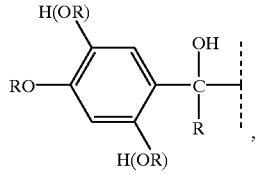

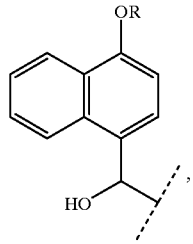

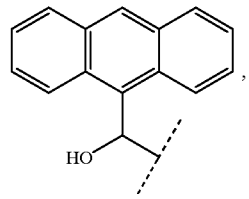

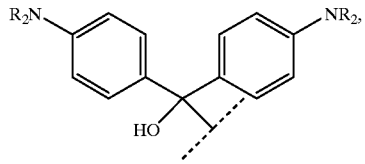

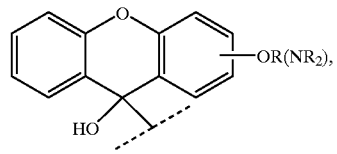

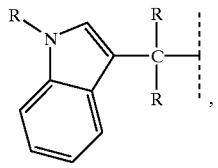

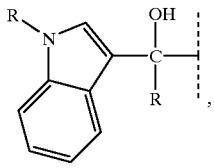

-continued

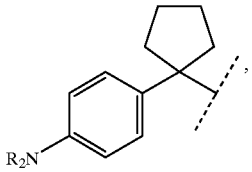

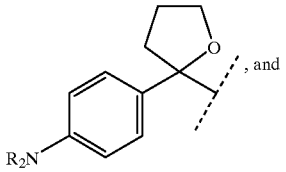

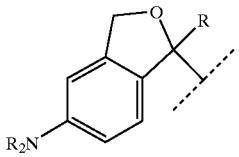

wherein R is a hydrogen atom or a substituted or unsubstituted alkyl group.

31. A photographic element according to claim 1 or claim 2, wherein X is of formula (II):

(II)

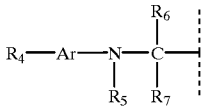

wherein:

Ar is an aryl group or a heterocyclic group;

$R_4$ is a substituent having a Hammett sigma value of −1 to +1;

$R_5$ is R or Ar';

$R_6$ is R or Ar';

$R_7$ is R or Ar';

$R_5$ and Ar can be linked to form 5- to 8-membered ring;

$R_6$ and Ar can be linked to form 5- to 8-membered ring, in which case $R_6$ can comprise a hetero atom;

$R_5$ and $R_6$ can be linked to form 5- to 8-membered ring;

$R_6$ and $R_7$ can be linked to form 5- to 8-membered ring;

Ar' is an aryl group or a heterocyclic group; and

R is a hydrogen atom or an unsubstituted or substituted alkyl group.

32. A photographic element according to claim 31, wherein X is selected from the group consisting of:

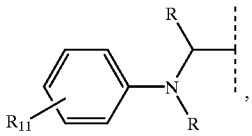

-continued

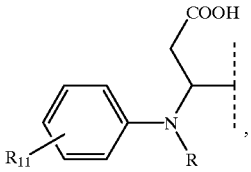

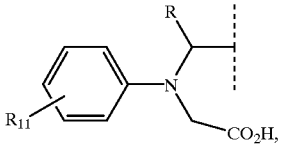

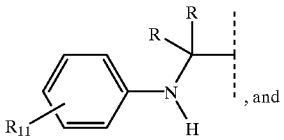

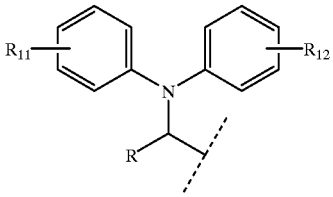

wherein $R_{11}$ and $R_{12}$ are independently H, alkyl, alkoxy, alkylthio, halo, carbamoyl, carboxyl, amido, formyl, sulfonyl, sulfonamido or nitrile and R is a hydrogen atom or an unsubstituted or substituted alkyl group.

33. A photographic element according to claim 31, wherein X is selected from the group consisting of:

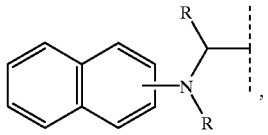

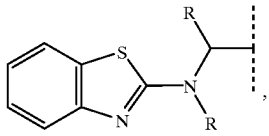

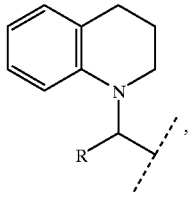

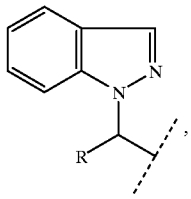

-continued

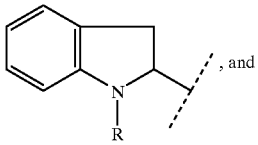

, and

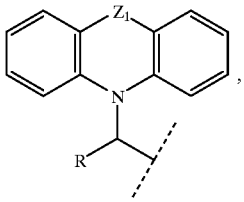

, wherein $Z_1$ is covalent bond, S, O, Se, NR, $CR_2$, CR═CR or $CH_2CH_2$ and R is a hydrogen atom or a substituted or unsubstituted alkyl group.

34. A photographic element according to claim 31, wherein X has the structure:

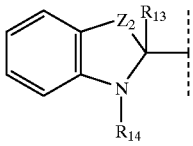

wherein $Z_2$ is S, O, Se, NR, $CR_2$ or CR═CR, and $R_{13}$ is an unsubstituted or substituted alkyl or aryl group, and $R_{14}$ is a hydrogen atom or an unsubstituted or substituted alkyl or aryl group and R is a hydrogen atom or a substituted or unsubstituted alkyl group.

35. A photographic element according to claim 1 or claim 2, wherein X is of formula (III):

(III)

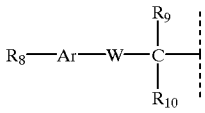

wherein:

W is O, S or Se;

Ar is an aryl group or a heterocyclic group;

$R_8$ is R, carboxyl, $NR_2$, $(OR)_n$, or $(SR)_n$;

n is 1–3

$R_9$ and $R_{10}$ are independently R or Ar';

$R_9$ and Ar can be linked to form 5- to 8-membered ring;

Ar' is an aryl group or a heterocyclic group; and

R is a hydrogen atom or an unsubstituted or substituted alkyl group.

36. A photographic element according to claim 35, wherein X is selected from the group consisting of:

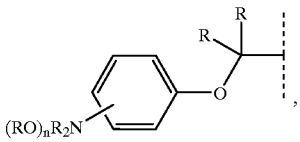

-continued

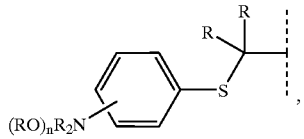

,

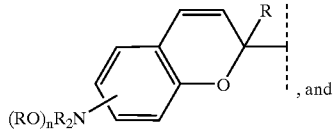

, and

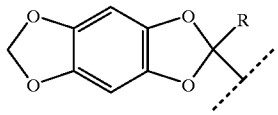

wherein n is 1–3, and R is a hydrogen atom or an unsubstituted or substituted alkyl group.

37. A photographic element according to claim 1 or claim 2, wherein X is of formula (IV):

(IV)

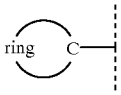

wherein "ring" represents a substituted or unsubstituted 5-, 6- or 7-membered unsaturated ring.

38. A photographic element according to claim 37, wherein X is selected from the group consisting of

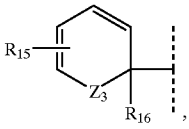

,

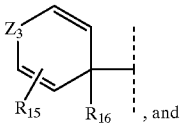

, and

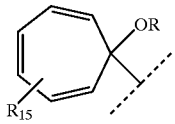

wherein $Z_3$ is O, S, Se or NR; $R_{15}$ is OR or $NR_2$;

$R_{16}$ unsubstituted alkyl or substituted alkyl and R is a hydrogen atom or an unsubstituted or substituted alkyl group.

39. A photographic element according to claim 1 or claim 2, wherein Y is:

(1) X', where X' is an X group as defined in structures I–IV and may be the same as or different from the X group to which it is attached (2)

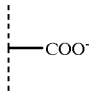

(3)

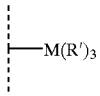

where M=Si, Sn or Ge; and R'=alkyl or substituted alkyl; or (4)

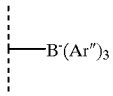

where Ar"=aryl or substituted aryl.

40. A photographic element according to claim 38, wherein Y is COO—, $Si(R')_3$ or X'.

41. A photographic element according to claim 40, wherein Y is COO— or $Si(R')_3$.

42. A photographic element according to claim 1 or claim 2, wherein the compound of the formula $A\text{-}(XY)_k$ or $(A)_k\text{-}XY$ is of the formula:

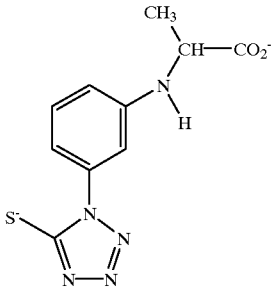

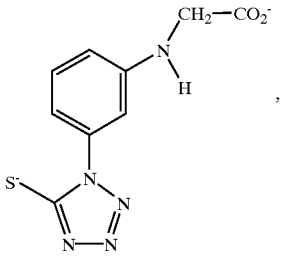

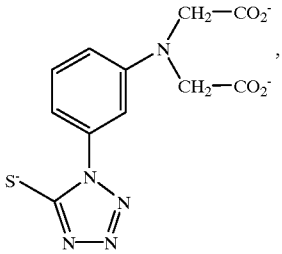

-continued

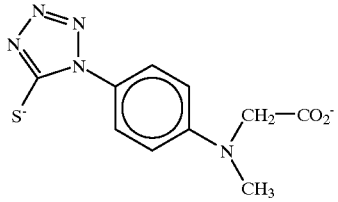

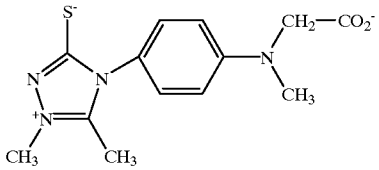

, and

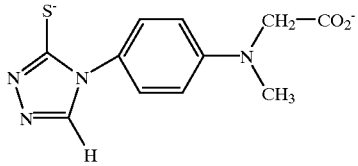

43. A photographic element according to claim 1 or claim 2, wherein the compound of the formula $A\text{-}(XY)_k$ or $(A)_k\text{-}XY$ is of the formula:

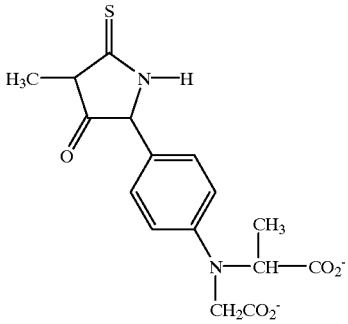

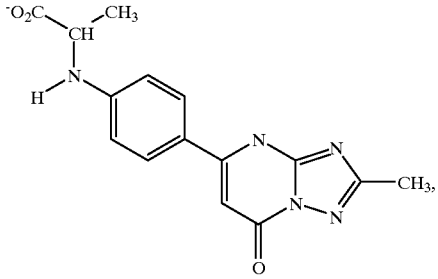

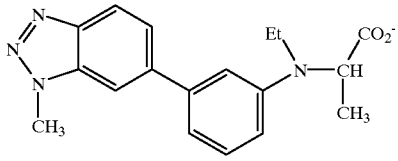

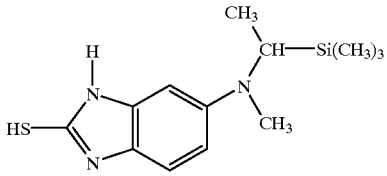

-continued
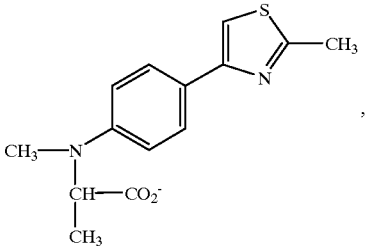
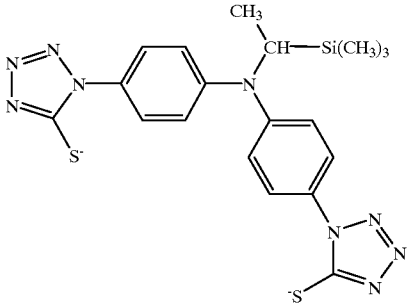
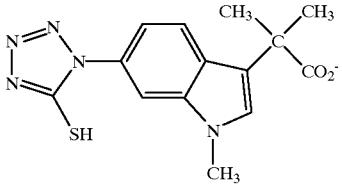
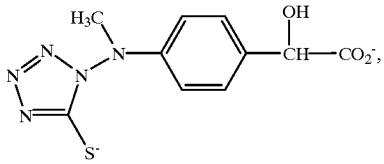
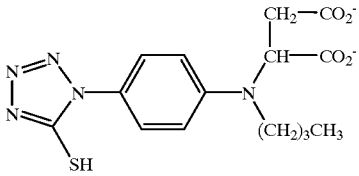
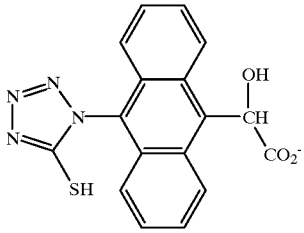
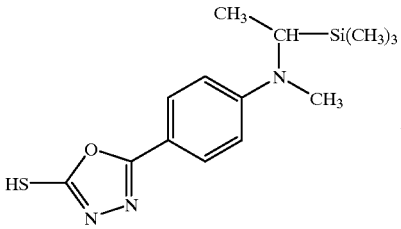
-continued
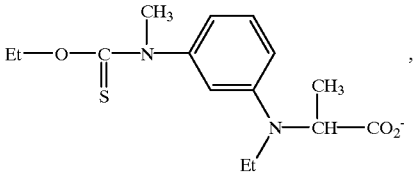
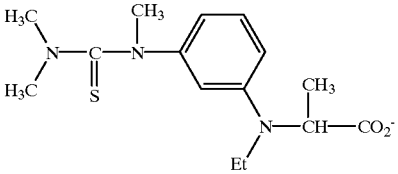
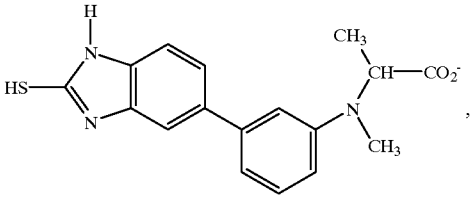
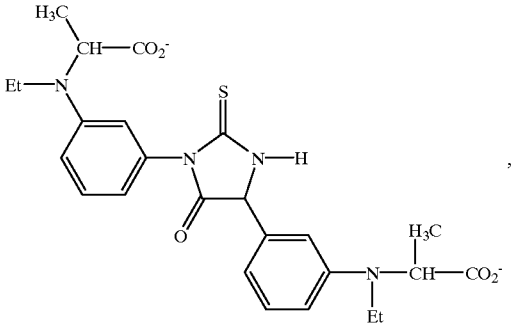
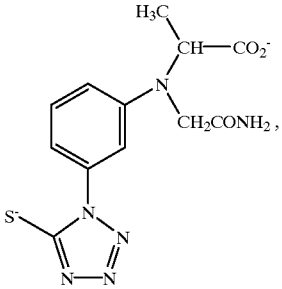
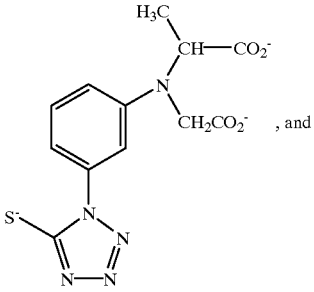
, and -continued

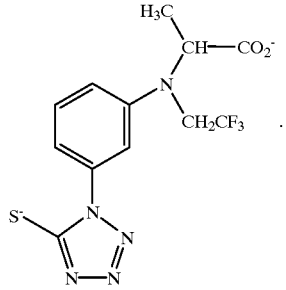

44. A photographic element according to claim 1 or claim 2 wherein A is of the formula:

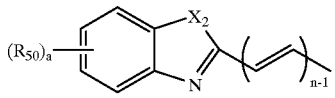

wherein:

$X_2$ is O, S, N, or $C(R_{52})_2$, $R_{52}$ is substituted or unsubstituted alkyl, a is an integer of 1–4, n is an integer of 1–3, and each $R_{50}$ is independently a hydrogen atom, a halogen atom, a substituted or unsubstituted alkyl group, or a substituted or unsubstituted aryl group.

45. A photographic element according to claim 1 or claim 2, wherein the compound of the formula A-$(XY)_k$ or $(A)_k$-XY is of the formula:

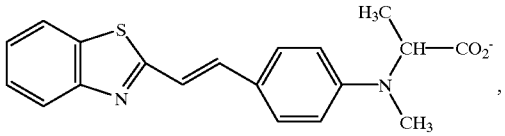

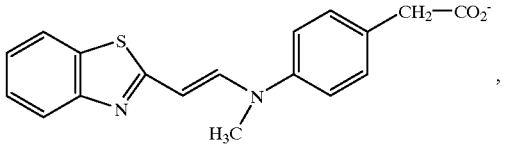

and

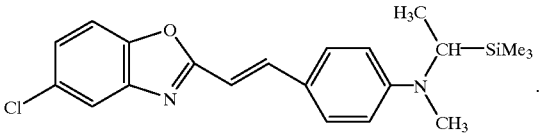

46. A photographic element according to claim 1 or claim 2, wherein the compound of the formula Z-$(XY)_k$ or $(Z)_k$-XY is of the formula:

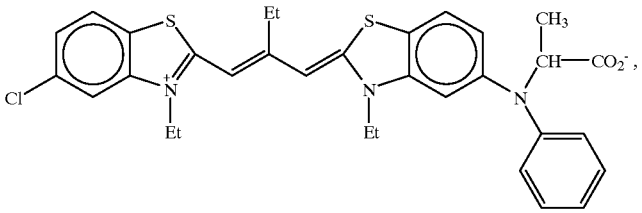

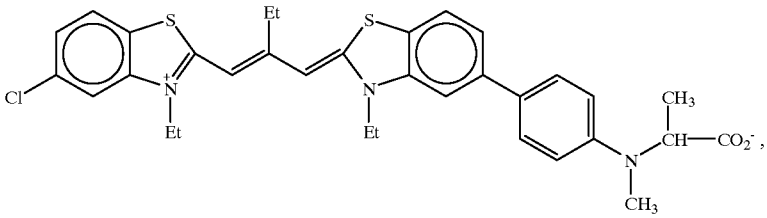

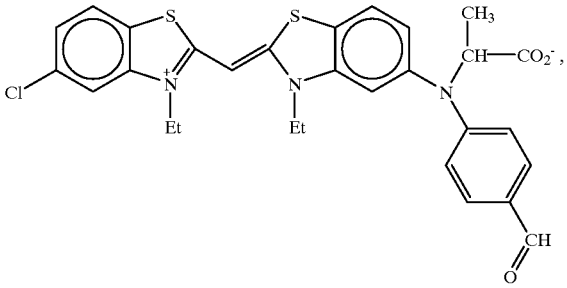

-continued
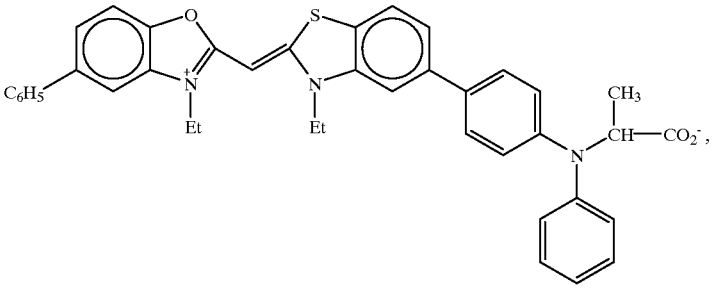
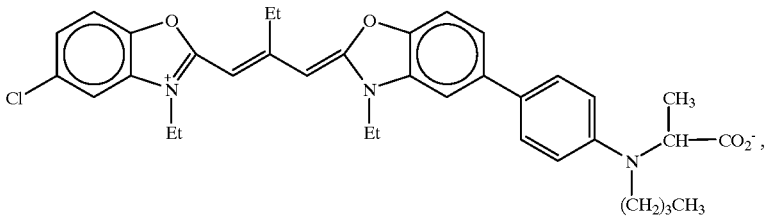
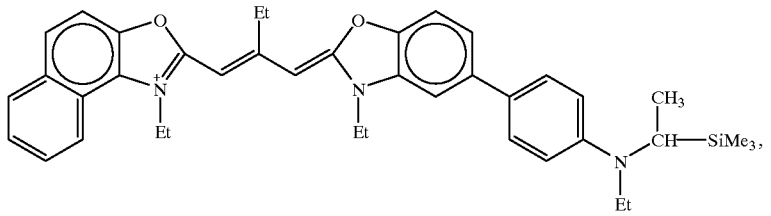
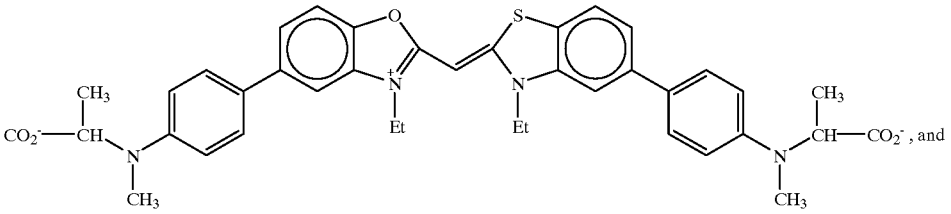
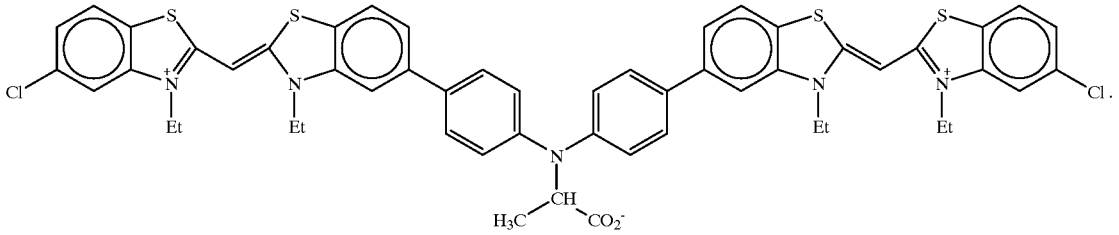

47. A photographic element according to claim 1 or claim 2, wherein the emulsion layer further contains a sensitizing dye.

48. A photographic element according to claim 47, wherein the sensitizing dye is selected from dyes of formula (VIII) through (XII):

(VIII)

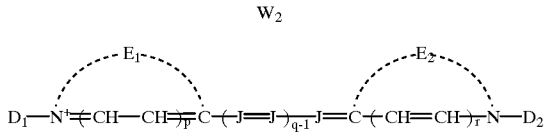

wherein:

$E_1$ and $E_2$ represent the atoms necessary to form a substituted or unsubstituted hetero ring and may be the same or different, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl, and $W_2$ is a counterion as necessary to balance the charge;

(IX)

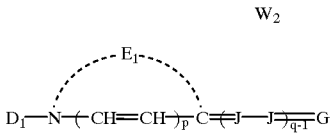

wherein $E_1$, $D_1$, J, p, q and $W_2$ are as defined above for formula (VIII) and G represents

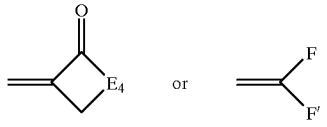

wherein $E_4$ represents the atoms necessary to complete a substituted or unsubstituted heterocyclic nucleus, and F and F' each independently represents a cyano group, an ester group, an acyl group, a carbamoyl group or an alkylsulfonyl group;

(X)

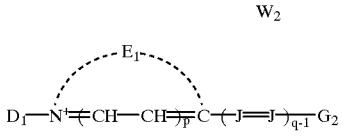

wherein $D_1$, $E_1$, J, p, q and $W_2$ are as defined above for formula (VIII), and $G_2$ represents a substituted or unsubstituted amino group or a substituted or unsubstituted aryl group;

(XI)

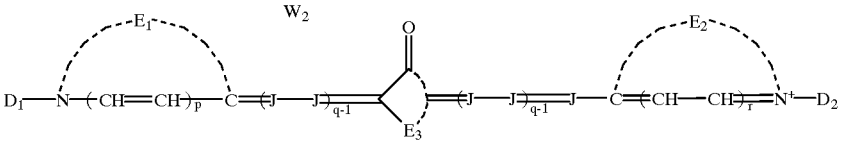

wherein $D_1$, $E_1$, $D_2$, $E_2$, J, p, q, r and $W_2$ are as defined for formula (VIII) above, and $E_3$ is defined the same as $E_4$ for formula (IX) above;

(XII)

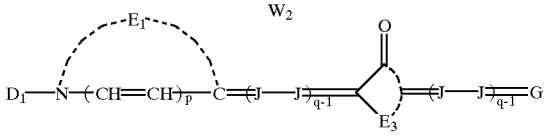

wherein $D_1$, $E_1$, J, G, p, q, r and $W_2$ are as defined above for formula (VIII) above and $E_3$ is as defined for formula (XI) above.

49. A photographic element according to claim 1 or claim 2, comprising a plurality of layers wherein one or more of the layers of the element contains a hydroxybenzene compound.

50. A photographic element according to claim 49, wherein the hydroxybenzene compound has the formula:

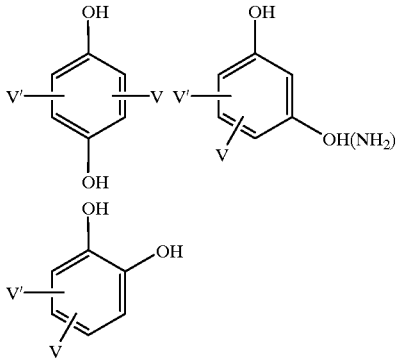

wherein V and V' each independently represent —H, —OH, a halogen atom, —OM (where M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

* * * * *